US007786371B1

(12) United States Patent
Moates

(10) Patent No.: US 7,786,371 B1
(45) Date of Patent: Aug. 31, 2010

(54) MODULAR SYSTEM FOR MIDI DATA

(76) Inventor: Eric L. Moates, 314 M Elm Edders Dr., Anniston, AL (US) 36206

( * ) Notice: Subject to any disclaimer, the term of this patent is extended or adjusted under 35 U.S.C. 154(b) by 299 days.

(21) Appl. No.: 11/598,962

(22) Filed: Nov. 14, 2006

(51) Int. Cl.

| | |
|---|---|
| ***G10H 7/00*** | (2006.01) |
| ***G10H 1/32*** | (2006.01) |
| ***A63J 17/00*** | (2006.01) |
| ***A63J 5/10*** | (2006.01) |
| ***A63J 5/02*** | (2006.01) |

(52) U.S. Cl. ..... 84/645; 84/464 R; 84/644

(58) Field of Classification Search ..... 84/645, 84/477 R, 464 R, 464 A

See application file for complete search history.

(56) References Cited

U.S. PATENT DOCUMENTS

| | | | | |
|---|---|---|---|---|
| 4,945,806 | A * | 8/1990 | Merrill, Jr. | 84/645 |
| 5,986,201 | A * | 11/1999 | Starr et al. | 84/645 |
| 2004/0001601 | A1 * | 1/2004 | Wang | 381/124 |

OTHER PUBLICATIONS

InLine MIDI Monitor—Intro. Jan. 24, 2001. <http://web.archive.org/web/20010124052700/http://www.circuitcellar.com/design2k/winners/grand.htm>.*

InLine MIDI Monitor—Abstract. Mar. 9, 2001. <http://web.archive.org/web/20010309225810/http://www.circuitcellar.com/advertise/cc-advertising/d2k-winners/InLineMIDIMonitor.htm>.*

MIDI Monitor. Oct. 25, 2005. <http://web.archive.org/web/20051025001607/http://www.ucapps.de/midimon.html>.*

* cited by examiner

*Primary Examiner*—Jeffrey Donels
*Assistant Examiner*—Andrew R Millikin
(74) *Attorney, Agent, or Firm*—Mark Clodfelter

(57) ABSTRACT

Rack mountable, user-programmable electronic modules are disclosed that may be used separately, or combined into an integrated system, to analyze, display, troubleshoot, or perform signal conversion on contents or a Musical Instrument Data Interface (MIDI) data stream. Signal conversion capabilities include conversion from a standard MIDI unbalanced current-driven signal format to other electronic forms, such as a balanced differential voltage format, or optical fiber or wireless media formats, that are more suitable for longer distance transmission, and include conversion from a format suitable for long distance back to a standard MIDI format. Custom, remotely controllable dimmer packs responsive to MIDI messages also provide verification and operating condition data, as may be useful in controlling and monitoring lights, pyrotechnics, lasers, fountains, music, and other elements of an animated display or entertainment show, back to a computer which may also be running custom software of the instant invention.

29 Claims, 32 Drawing Sheets

LARGE MIDI
SHOW CONTROL EXAMPLE

Computer
Midi data generator
Keyboard
MML
MLC
MTC
MA1

Keyboard
MA1
MML
MLC
MML
MML

MML
MML
MLC
MTC

Figure 6

| Column 1 | Column 2 | Column 3 | Column 4 | Column 5 |
|---|---|---|---|---|
| **Message Received** | **Match means LED =** | **Timed Turn off ?** | **Program-ming Delay?** | **LED Position Assignable** |
| **Note Off (8X)** | OFF | N/A | N/A | NO |
| **Note On (9X)** | velocity = brightness | NO | NO | YES |
| **Polyphonic Aftertouch (AX)** | velocity = brightness | NO | YES | YES |
| **Control Change (BX)** | data 2 = brightness | 3 seconds | YES | YES |
| Control Change (BX) Exceptions Control Damper Pedal (40) | = < 63 OFF, = > 64 ON | NO | YES | YES |
| Control Portamento (41) | = < 63 OFF, = > 64 ON | NO | YES | YES |
| Control Sostenuto (42) | = < 63 OFF, = > 64 ON | NO | YES | YES |
| Control Soft Pedal (43) | = < 63 OFF, = > 64 ON | NO | YES | YES |
| Control Legato Ft Switch (44) | = < 63 OFF, = > 64 ON | NO | YES | YES |
| Control Hold 2 (45) | = < 63 OFF, = > 64 ON | NO | YES | YES |
| Control Local Control On/Off (7A) | 0 = OFF, 127 = ON, all other = no change | NO | YES | YES |
| **Program Change (CX)** | pgm # = brightness, or full brightness for any | 3 seconds | YES | YES |
| **Channel Aftertouch (DX)** | velocity = brightness | NO | YES | YES |
| **Pitch Wheel (EX)** | position = brightness | 3 seconds | YES | YES |
| **System Exclusive (F0 / F7)** | ON full | 3 seconds | NO | YES |
| **Midi Time Code (F1)** | ON full | 3 seconds | NO | YES |
| **Song Position Pointer (F2)** | ON full | 3 seconds | NO | YES |
| **Song Select (F3)** | ON full | 3 seconds | NO | YES |
| **Undefined (F4)** | ON full | 3 seconds | NO | YES |
| **Undefined (F5)** | ON full | 3 seconds | NO | YES |
| **Tune Request (F6)** | ON full | 3 seconds | NO | YES |
| **Timing Clock (F8)** | ON full | 3 seconds | NO | YES |
| **Undefined (F9)** | ON full | 3 seconds | NO | YES |
| **Start (FA)** | ON full | 3 seconds | NO | YES |
| **Continue (FB)** | ON full | 3 seconds | NO | YES |
| **Stop (FC)** | ON full | 3 seconds | NO | YES |
| **Undefined (FD)** | ON full | 3 seconds | NO | YES |
| **Active Sensing (FE)** | ON full | 3 seconds | NO | YES |
| **System Reset (FF)** | ON full | 3 seconds | NO | YES |

*AUTO DIMMING*

MODULAR SYSTEM FOR MIDI DATA

FIELD OF THE INVENTION

This invention deals with electronic modules or devices that analyze, monitor, manipulate, and/or display Musical Instrument Digital Interface (MIDI) data from any device that generates MIDI data such as musical instruments, keyboards, and computers. This invention also deals with systems, such as animated parks, commercial, or lawn displays, or household or office entertainment or ambience control systems, which make use of such modules to monitor and view MIDI data sent to remotely controlled devices and/or MIDI data received from remote devices.

BACKGROUND OF THE INVENTION

In a process of creating and using MIDI data streams either from a musical instrument, computer or any device that generates MIDI data, or in monitoring, controlling, or troubleshooting an animated display, entertainment show, or ambience environment involving use of MIDI data streams to control and synchronize remotely located lighting, sound producing, or other effects control devices, such as decorative dynamic fountains coordinated with music and lighting, or video displays, projectors, and/or monitors, there is a need to analyze, manipulate, monitor, and view MIDI data on a stand alone device independent of the generating device or receiving devices. With the electronic modules, or a modular system employing such modules of the instant invention, a user can customize a configuration employing MIDI data streams to accomplish specific control, monitoring, analysis, and troubleshooting tasks. Each module processes and displays the data differently, and modules can be assembled and integrated in any configuration on a large or small scale. The capabilities provided by single or integrated modules of the instant invention are useful in analyzing and troubleshooting MIDI data streams used to control and synchronize musical instruments and other devices that may be grouped together, as in a recording studio, or in a group as used together on or in the vicinity of a stage as in a musical concert or show production. The capabilities provided by the instant invention are also particularly useful in producing, monitoring and troubleshooting animated entertainment displays and shows, as in lawn Christmas displays, displays in municipal or theme parks, or commercial displays, as in trade shows or outdoor advertisements, that may involve use of MIDI data streams to control and synchronize multiple devices located remotely from, and may not be visible from, one or more control locations from which one or multiple MIDI data streams may be sent to such multiple remote devices. In some applications involving display or show installations, verification or other data may be transmitted from remotely-located MIDI-controlled devices back to a central monitoring location where monitoring, or comparisons with transmitted data, may be performed using capabilities of the instant invention to help confirm or troubleshoot MIDI data streams received at remotely-located devices, or to monitor other operational conditions independent of the MIDI data stream. MIDI message verification data may simply be echoed as physical layer signals or may be regenerated from digital data received at remotely located devices, as describe herein.

The capabilities of the instant invention are very beneficial to musicians, computer programmers, MIDI software developers, computer-controlled show operators, and anyone else who wants to control and coordinate remote devices using MIDI data streams and analyze, manipulate, monitor or view data in data streams or files comprising primarily MIDI data.

BRIEF DESCRIPTION OF THE DRAWINGS

FIG. 6 is a table that shows how responses of light emitting devices to specific messages may be programmed on an MML module.

FIG. 7*a* is a front panel, FIG. 7*b* is a blank rear panel, FIG. 7*c* is a rear panel for use with connectors, and FIG. 7*d* is a circuit board.

DETAILED DESCRIPTION OF THE DRAWINGS

Although the Musical Instrument Digital Interface (MIDI) standard was developed primarily for control of digital or digital-enabled musical instruments, the MIDI data structure includes sufficient flexibility to permit MIDI data streams to also be used for control and coordination or synchronization of other devices, such as lighting devices, animated water fountains, pyrotechnic devices, and the like that, with appropriate modifications in accordance with some aspects of the instant invention, may be integrated and synchronized in a coordinated display or entertainment show. Use of MIDI data streams is particularly beneficial for control and coordination of displays, shows, or ambience environments involving coordination of music, sound effects, lighting, fountains, lasers, pyrotechnics, and other elements of an integrated display, show, or other environment. Whether a MIDI data stream is used to coordinate an integrated system of devices used in such a display, show production, or ambience environment, or used simply for controlling musical instruments as originally intended, it is useful to have a capability to intercept and display all or selected contents of a MIDI data stream in order to confirm expected contents in the data stream, confirm data received at remote devices matches data transmitted and/or matches data intended for a given remote device, to support troubleshooting when devices do not perform or respond as expected, or for other purposes.

Figure 1:
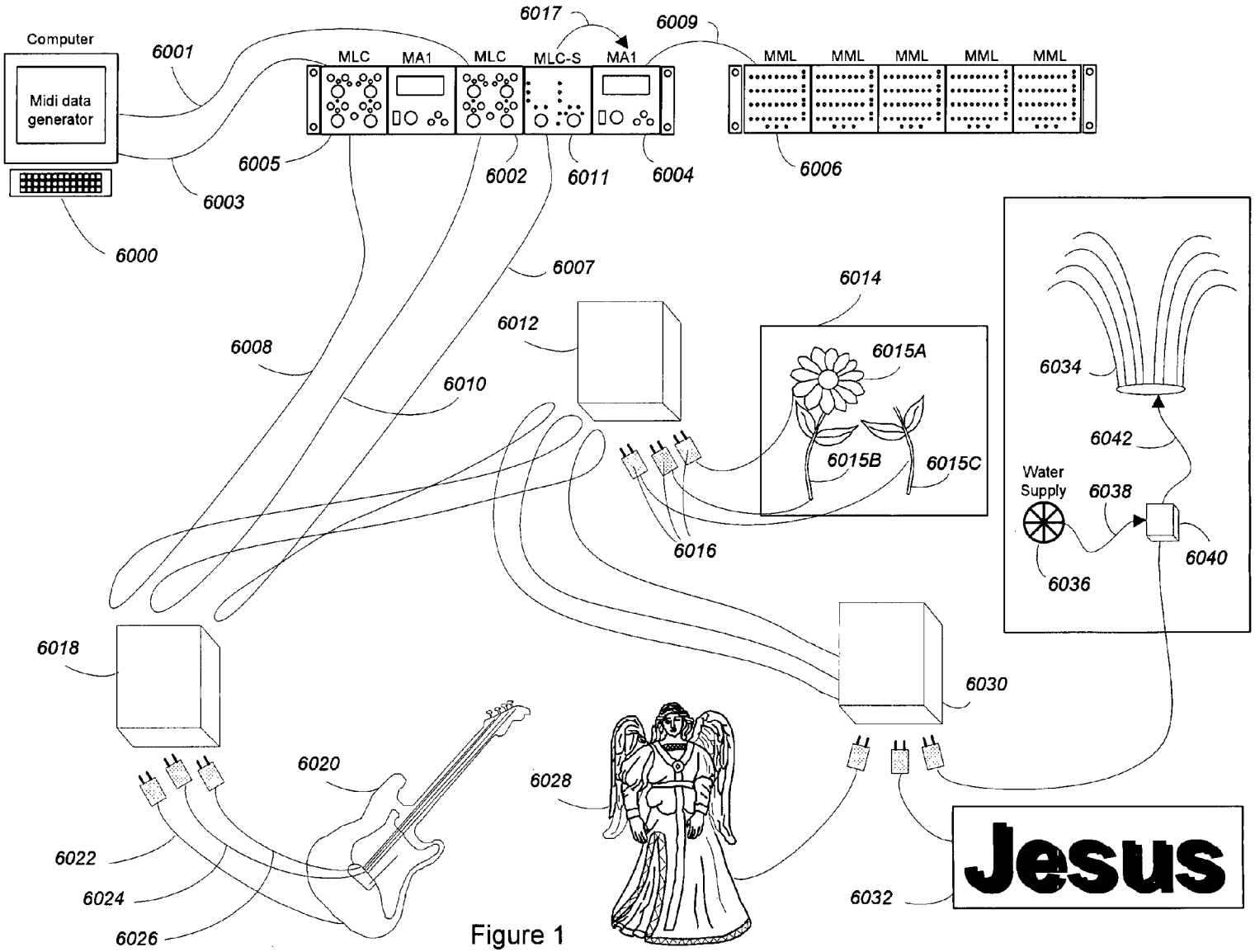
FIG. 1 is an illustration of an example application of the instant invention in controlling and monitoring elements of a lawn display involving animated lighted objects and fountains controlled and monitored via use of MIDI data streams.

FIG. 1 and the description below provide an example application of the instant invention. More detailed descriptions are provided later herein for modules referenced in the following description of FIG. 1. In FIG. 1, modules 6002, 6004, 6005, 6006, 6011 of the instant invention are used in a lawn display or show environment using multiple mini-light strings 6016, 6022, 6024, 6026 attached to wire frames 6015A, 6015B, 6015C, 6020, 6028, 6032 or other support structures in a given shape, or other lights or set of lights in a particular pattern. This configuration could be used in large scale indoor or outdoor shows, and may be connected to one central location or computer 6000 for simply turning them on and off or playing a complex show pattern involving coordination and control of multiple elements through use of MIDI data streams. MLC module 6002 is a dual MIDI-to-Line-level and Line-level-to-MIDI converter module which, when combined with an MLC-S module 6011, as explained later herein, provides both input source select switch control and signal conversion capabilities for converting MIDI data from standard MIDI signals to formats more suitable for longer distance (up to 4000 feet) transmission. MA1 module 6004 is a MIDI Analyzer module. MML 6006 is a MIDI Monitor via LED (light emitting diode) module. Not shown in the example of FIG. 1, but also part of the instant invention, is an MTC module, which is a MIDI Time Code reader and display module. Each of these modules is further described later herein.

In FIG. 1, computer 6000 may be used to control a sequence of a show using a MIDI protocol output data stream which may be sent over a conventional MIDI cable 6001 to MLC module 6002 to be converted to a different signal transmission format, such as a balanced differential voltage format, that will allow the data to be sent longer distances (e.g., up to 4000 feet or more) than supported by standard MIDI signal format. A long distance transmission cable 6010, which may be, for example, CAT5e Ethernet cable, fiber optic cable, or other suitable media with appropriate drivers and receivers, including wireless media, may be used to transmit signal streams including MIDI data to LMD2 dimmer packs 6012, 6018, 6030, and other devices, from MLC module 6002. In FIG. 1, the cable loops shown near dimmer packs 6018, 6012 are a shorthand way of showing that the signal path may simply loop through some dimmer packs, as in a daisy chain fashion. In such a configuration, cables may be physically connected to input and output terminals that, in effect, relay data on the cable to other LDM2 dimmer packs or other devices connected downstream, but also allow each LDM2 dimmer pack to monitor and respond to selected MIDI messages transmitted via wire pairs within such a cable. Circuits within each LMD2 dimmer pack receive and process the MIDI data stream, using channel numbers, note numbers, and other MIDI messages to select and respond to commands to which a given LMD2 dimmer pack has been programmed to respond, as described later herein. For example, a "Note On" command with a "velocity" value greater than 0 may be used to energize a specific power supply circuit of an LMD2 dimmer pack via a triac, relay, or similar device. Similarly, a "Note Off" command, or a "Note On" command with a velocity value of 0, may be used to de-energize a particular power supply circuit. LMD2 dimmer packs may be programmed to respond, for example, to "Note On," "Note Off," "Channel volume," custom "Control change" fade up or fade down, "All note Off," and other standard or modified MIDI messages. LMD2 dimmer packs are also individually addressable for special features and functions. By using the FO/F7 (hex), system exclusive command described in the MIDI specification, and by each LMD2 unit having its own address, each LMD2 unit can be addressed individually, and in doing so, any configuration settings can be updated, changed, reconfigured, cleared, reset etc. and any custom settings, configurations, registers, statistics, settings, etc. can be read from any of the LMD2 units individually. Other features of LMD2 dimmer packs, described later herein, provide measurement and diagnostic capabilities that allow a user to remotely monitor environmental or performance information, such as AC Voltage, AC frequency, AC amperage, DC voltage, temperature, and/or other data parameters of each LMD2 dimmer pack individually via use of MIDI messages. Such data may be encoded, for example, using the "system exclusive" data element described in the MIDI data stream specification, available from various commercial sources (e.g., www-.midi.org). Cable 6008 may also be connected in daisy chain fashion to provide a return signal path from one or more LMD2 dimmer packs back to MLC module 6005, where signals may be converted from a longer distance signal format (e.g., balanced differential voltage) back to a standard MIDI signal format, and then returned back to computer 6000 over a standard MIDI cable 6003. Special MIDI decoding, analysis, and display software of the instant invention may then be used on computer 6000 in some embodiments to interpret, analyze, and/or display data returned from LMD2 dimmer packs 6012, 6018, 6030 or from other devices. Wire frame 6020 may be loaded with multiple strings of lights that may be wired to different circuits for different effects. For example, one circuit 6022 may be a string of lights that outlines a guitar's outer frame. Separate light string circuits 6024, 6026 may represent guitar strings. Having multiple, independently-controlled light string circuits allows the three circuits in this example to be illuminated at appropriate times to give an illusion or representation of the guitar of FIG. 1 playing. LMD2 dimmer pack 6018 provides AC power to each circuit individually and energizes each circuit responsive to commands embedded in the MIDI data stream transmitted over data transmission cable 6010. In another example, a separate display 6014 may be used to give an illusion of a flower dancing, by energizing separate circuits of light strings 6015A and 6015B, and then alternately energizing and de-energizing circuits supplying light strings 6015C and 6015B via plugs 6016 responsive to commands in a MIDI data stream transmitted to LMD2 dimmer pack 6012. An angel wire frame 6028 and non-animated sign 6032 are examples of single circuit displays that may also be controlled via a MIDI data stream from computer 6000 to LMD2 dimmer pack 6030. Another cable or other communication link 6007, or wire pair within a cable, may be used as a signal return path, which may also be used for a verification loop. In some embodiments, cable 6007 may be used to transmit data from transmission cable or link 6010 as received and regenerated by circuitry within an LMD2 dimmer pack or other devices, in order to provide verification that transmitted data is being received correctly at each LMD2 dimmer pack or at other devices which may also receive the MIDI data stream. MIDI data stream signals returned via cable 6007 to combined MLC-S/MLC module 6011 may be connected via line input terminals into side A on an MLC module (not visible in FIG. 1) mounted on the backside of, and coupled to, MLC-S 6011, so that signals may be electronically switched to both the line out and MIDI out connectors (not shown) of the MLC module, with signals provided to the MIDI out connector being converted within the MLC module from a line input signal format (as arriving from cable 6007) to standard MIDI signal format. The MIDI output from the MLC coupled to MLC-S 6011 may then be connected, via a standard MIDI cable 6017, to a MIDI input of MA1 module 6004 which may be used to analyze and/or display the return data for verification or troubleshooting. The "loop thru" connector of MA1 6004 may be connected, via another MIDI cable 6009, to a MIDI input of one or more MML modules 6006, which may be programmed to provide selected visual displays, via light emitting diodes (LEDs) or other light emitting devices, responsive to contents of the returned MIDI data stream. Such displays may be used to provide additional confirmation and analysis of integrity of the returned data. In some installations, a copy of a transmitted MIDI data stream may be routed to one bank of MML modules and a copy of the returned verification data stream may be routed to a second bank of MML modules mounted adjacent the first bank of MML modules in order to provide a direct visual comparison of transmitted and received data. In other embodiments, a copy of the verification data stream may be routed to computer 6000 after being converted to standard MIDI data format, and a comparison of transmitted and received (verification) data streams may be made using software or firmware developed for such purpose. Note that although the connection paths between various modules and LMD2 dimmer packs are illustrated and referred to above as separate cables 6007, 6008, 6010, the connections could be made over different wire pairs in the same Ethernet or similar multi-pair or fiber-optic cable, or the MIDI data stream could be transmitted over wireless links, such as an RF or infrared local area network.

In an example as in FIG. 1, LMD2 dimmer pack 6030 may also control a display 6034 using water, such as a decorative fountain. For such an application, LMD2 dimmer pack 6030 may be equipped with a relay circuit instead of a dimmer circuit for one of the controlled power outlets. Where display 6034 is a fountain, a water supply 6036 may be connected to water display 6034 via hose 6038 through electrically controlled solenoid valve 6040. When the applicable power outlet is energized via MIDI command to LMD2 dimmer pack 6030, valve 6040 opens and allows water to flow through hose 6042 to fountain display 6034. In a modification of this example, an applicable power outlet in an LMD2 dimmer pack could be used to alternately energize a pump responsive to commands in a MIDI data stream to create desired effects.

Figure 2:
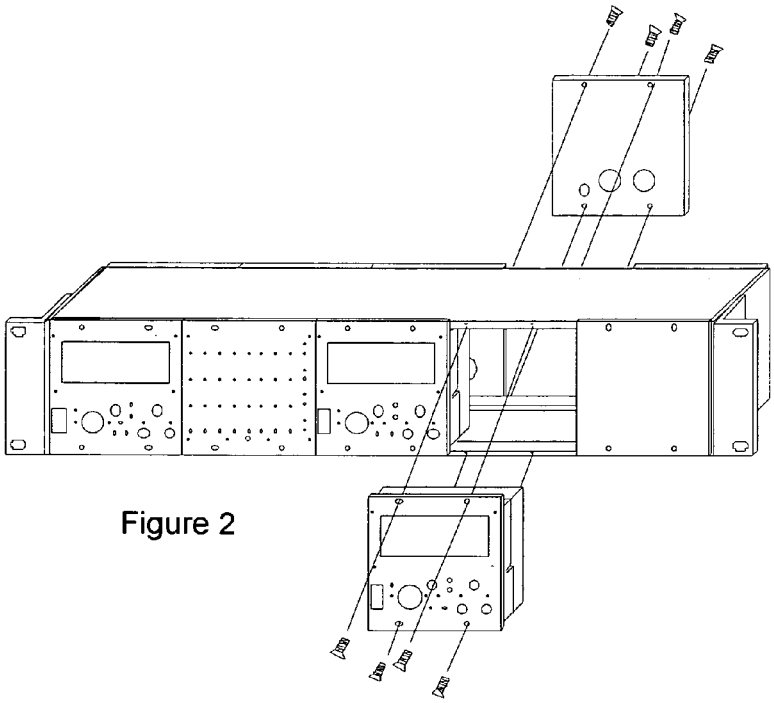
FIG. 2 is an illustration showing how several modules of the instant invention may be arranged in a chassis.

FIG. 2 shows an example of a unit assembled using three different type electronic modules of the instant invention demonstrating the flexibility and customizable features of systems which may be assembled using modules of the instant invention.

Figure 3:
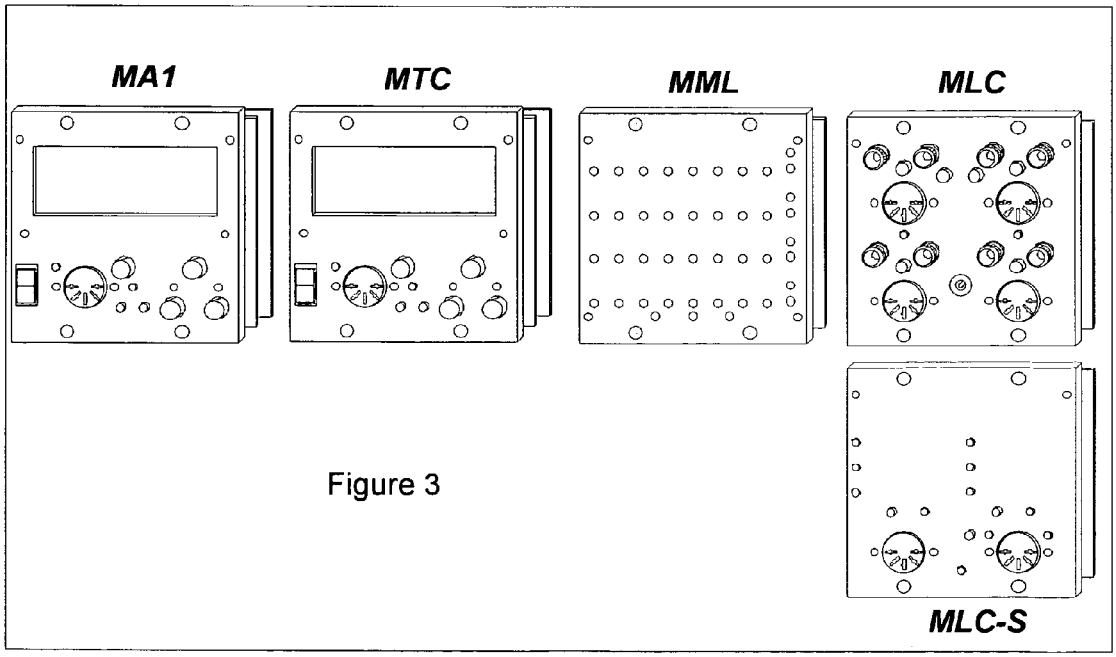
FIG. 3 is an illustration of the face plates and printed circuit boards (PCB) of multiple modules of the instant invention.

FIG. 3 shows a front view of each of five types of modules of the instant invention that could be used to assemble a custom unit or system for monitoring, displaying, or converting MIDI data streams. Such a unit or system, comprising a single module or multiple modules of the same or different types, may be used to analyze, manipulate, monitor, and view all or selected contents of a MIDI data stream from a computer or any other device that generates MIDI data.

An MML module is user programmable so that specific LEDs or other light-emitting devices are illuminated in response to specific MIDI messages. LEDs or other light emitting components of an MML module respond to contents of selected MIDI messages to which they are programmed to respond in near real time by either varying the brightness of emitted light or by turning an emitting component (e.g., LED) on or off according to the specific type of message being received. Multiple light emitting devices on the display of the MML module, which may be arranged in rows or another pattern, may be used and programmed to separately illuminate in response to different MIDI messages.

An MA1 module is a module, including a liquid crystal display, that will decode and display in near real time the last MIDI message received and will store the last several messages for analysis. By changing the software filtering options a user can customize and select only desired messages to be displayed. An input MIDI data stream is then constantly analyzed by the MA1 module for specific types of messages and will display such messages accordingly. By changing modes on the MA 1 module a user can analyze the MIDI data in different formats, such as hexadecimal bytes or decoded data for more human readable MIDI messages such as note and note values.

An MTC module is a module, including a liquid crystal display, that will decode and display MIDI Time Code Data in near real time. In some embodiments, an MTC module may be the same physical module as an MA1 module, the only difference being the software and how the module displays the data.

An MLC module will allow a user to convert the electronic form of a MIDI data stream from an unbalanced current driven protocol (standard MIDI signal format/waveform) to a balanced voltage driven protocol/format, and vice versa, to achieve specific short and long transmission paths for MIDI specific data protocols. The MLC-S module is an optional addition to the MLC module and adds user options, indicators, access to the ribbon cable/bus, and an additional input and output.

Figures 4A, 4B, 4C:
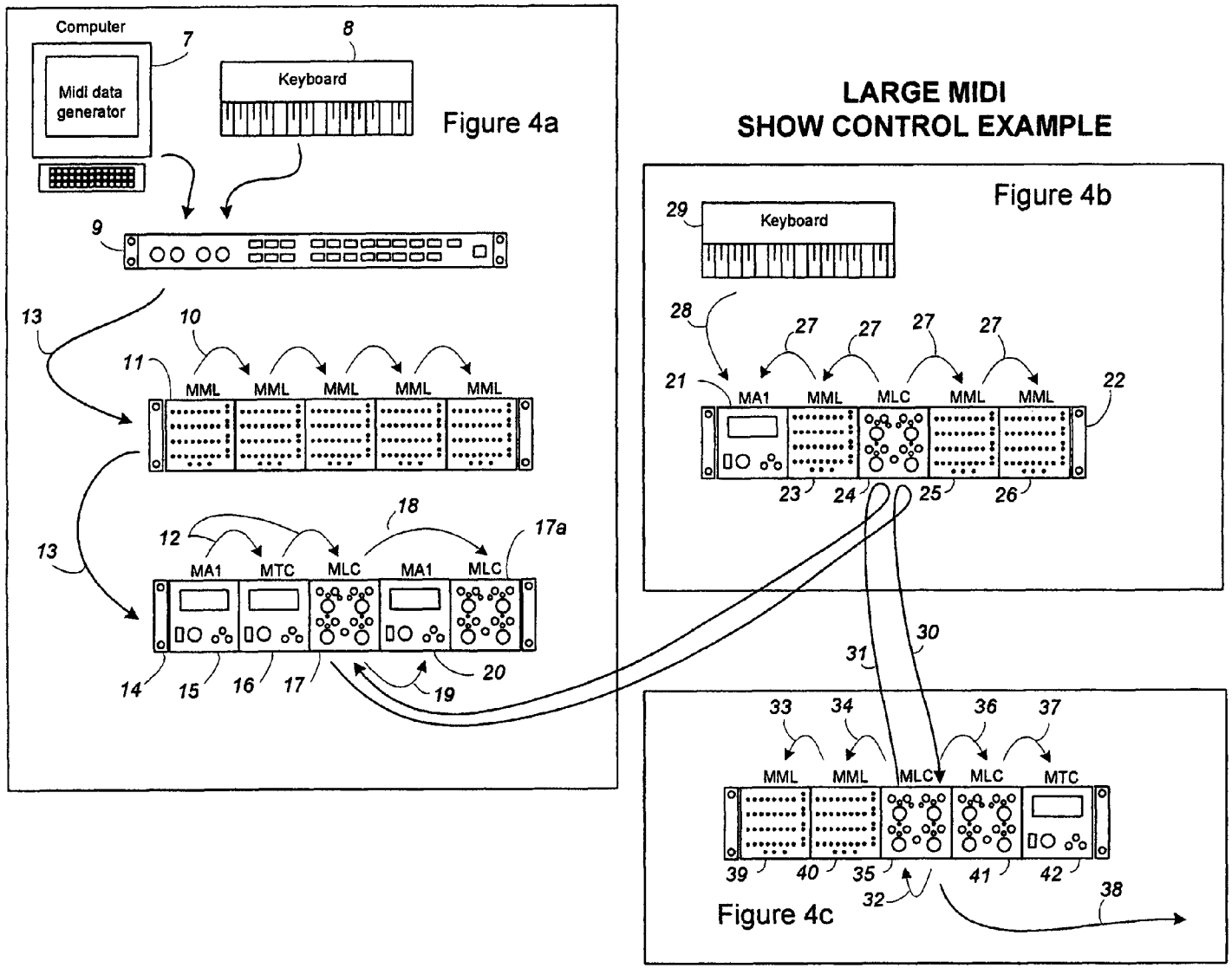
FIGS. 4*a*, 4*b*, 4*c* are illustrations of applications of modules of the instant invention in monitoring and helping control portions of an entertainment show using MIDI data streams for coordination.

FIGS. 4*a*, 4*b*, 4*c* and 5*a*, 5*b*, 5*c* are additional examples of possible module layouts and uses. FIGS. 4*a*, 4*b*, 4*c* is an example of a larger scale show control layout. FIGS. 4*a*, 4*b*, 4*c* show how modules of the instant invention may be integrated and installed in different regions to provide a capability for monitoring and helping to control various aspects of an entertainment event, such as a light show of a concert.

FIG. 4*a* illustrates MIDI-related components that may be placed in a control room or data generating area. FIG. 4*b* illustrates components that may be placed in an auxiliary monitoring booth, secondary hub or a data override area. FIG. 4*c* illustrates monitoring and relay components that may be backstage in a theater, may comprise another redistribution hub to extend an additional 4000 feet, or may be used for monitoring and verification retransmissions at an end of a remote connection or receiving hub up to 4000 feet from a distribution area. Depending on how each module is programmed or setup, each area could monitor, analyze, distribute or redistribute, switch receive or transmit data sources, and with the addition of future modules could provide other functionality.

In FIG. 4*a*, a computer 7 and a keyboard 8 could be MIDI generators sending data to a conventional patcher 9, which may route MIDI data to two chassis or racks of modules 11, 14 via MIDI cables 13. Chassis 11 comprising a set of 5 MML modules could be configured to monitor every programmed MIDI message of the show, including messages from or to keyboards, wireless MIDI devices, computers, controls, and the like.

Any of the 5 modules in chassis 11 could be the main receive unit, or could receive up to 5 different signals, (1 per unit), if the module has an input/output printed circuit board. In this example embodiment, the first module is the main unit. A chassis internal ribbon cable/bus 10 is used to distribute the data to the other four modules. Each MML module may include 32 programmable LEDs where each LED may be programmed to respond to a different MIDI message, totaling 160 possible different message types and values per chassis. In chassis 14 MIDI data may be received in one of the modules via MIDI cable 13 and distributed to other modules within the chassis so that modules 15, 16, 17, and 17*a* within the chassis receive MIDI data via internal ribbon cables/buses 12, 18. MA1 module 15 may be programmed to filter all but 'Note On' and 'Note Off' messages to show only those messages and an MTC module 16 may be used to display MIDI time code data if that data is present on the bus. MLC module 17 is used to convert signals from the internal bus 12 to a balanced voltage driven signal for a long distance cable run 30 from the A side of the MLC module. The B side of MLC module 17 receives verification data back from a long distance cable run 31, converts the received signal back to standard MIDI format, and retransmits the verification data via an external MIDI cable 19, from MLC module 17 to MA1 module 20. MA1 module 20 may be programmed to display the data for verification and/or monitoring integrity of the data. MLC module 17*a* may be used as another data distribution source or as a backup to module 17.

In FIG. 4*b*, chassis 22 supports 5 modules and may be coupled to an external MIDI generating device such as a keyboard 29 which may be used to send data to MA1 module 21 via MIDI cable 28. MA1 module 21, having the functionality to switch input sources, may be configured to analyze data from keyboard 29, or be switched to view MIDI data from chassis internal ribbon cable 27, which may be distributed from MLC module 24, which is the 'main' unit in this example, receiving MIDI data via cables 30, 31. Also in this example long distance transmission cables 30 and 31 are only looped through MLC module 24 in a "daisy-chain" fashion so that other modules in chassis 22 only monitor MIDI data on cables 30 and 31. The three MML modules 23, 25, 26 could be programmed to view the pertinent MIDI messages to this area. Even though this example shows only one loop through this area there could be up to 32 modules, LMD2 dimmer packs, and other devices, possibly hundreds of feet apart, per cable run without redistributing the data.

FIG. 4*c* represents monitoring and retransmission modules at an end of a cable run 30. MLC module 35 receives MIDI data in a balanced voltage form on the B side of the module and, via MIDI cable 32, received data in standard MIDI signal form is looped over into the A side of the MLC module to be sent back, e.g., to chassis 14 (FIG. 4*a*) via cable 31, for verification purposes. Received data could be retransmitted via media 38 to other sources such as show control equipment, switches, dimmers and the like. Received data may also be distributed via chassis internal ribbon cable/bus sections 33, 34, 36, 37 to other modules for viewing, analyzing, monitoring or redistribution. Long distance distribution media 30, 31, 38 could be wire pairs in a multiple pair cable, such as category 5e cabling used for Ethernet connections, but in some embodiments where modules include, or are coupled to, fiber optic or wireless transmit and receive elements, long distance distribution media may be fiber optic or wireless media.

Figure 5C:
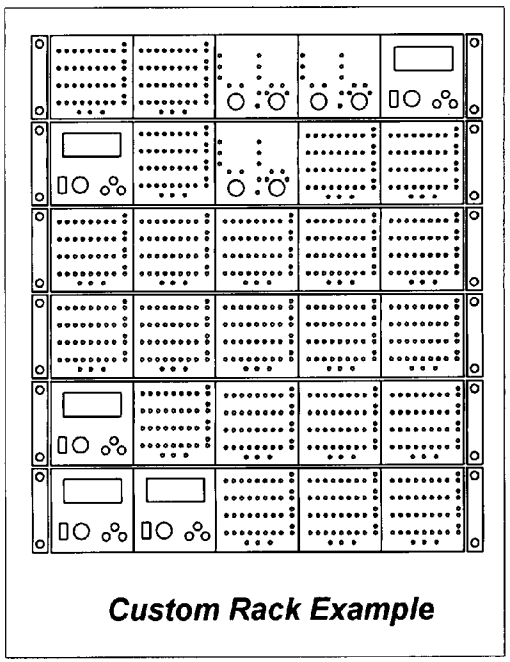
FIG. 5*c* is an illustration showing how multiple modules of the instant invention may be mounted in a rack to monitor and help troubleshoot multiple aspects of a large display.
Figure 5A:
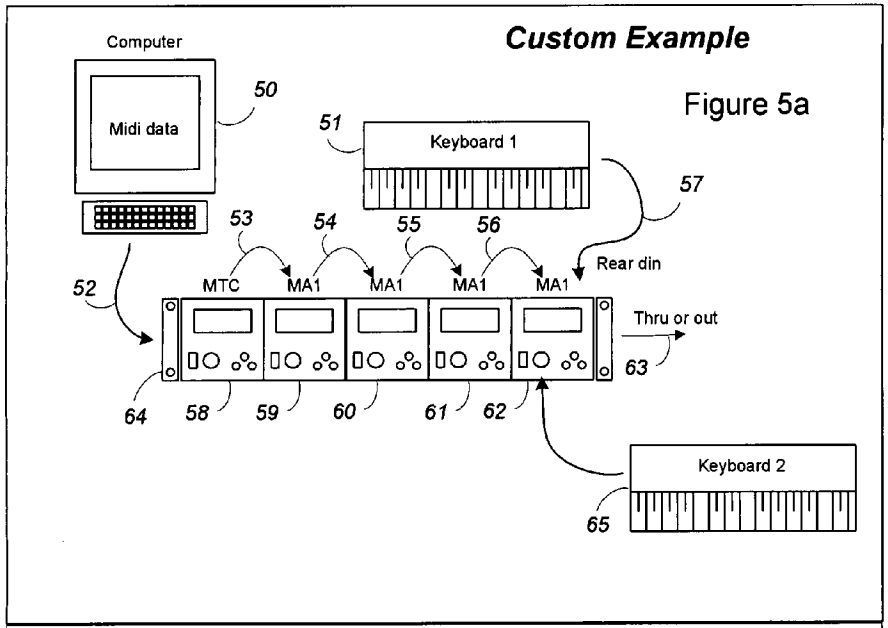
FIGS. 5*a* and 5*b* are illustrations showing applications of modules of the instant invention used to monitor, analyze, and troubleshoot MIDI messages in a development or small show environment.
Figure 5B:
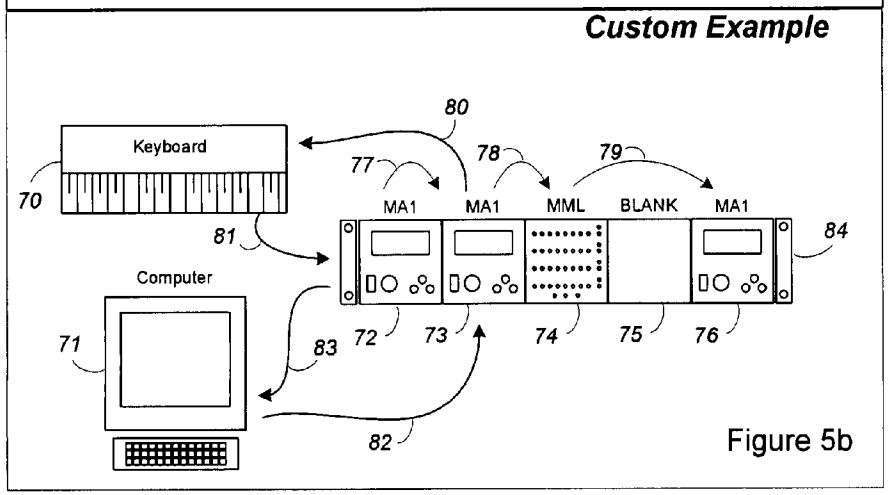
Figure 7A:
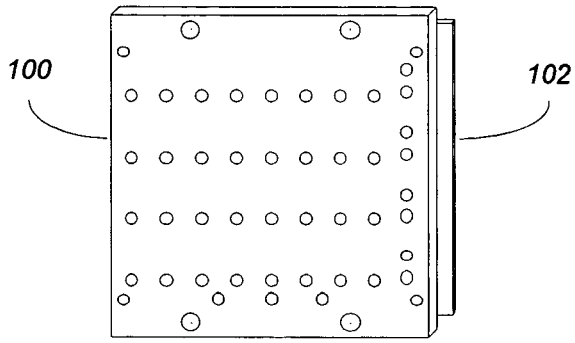
FIGS. 7*a* through 7*d* are illustrations of components that may be used with an MML module, where
Figure 7B:
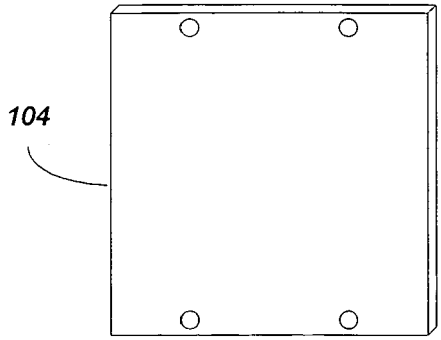
Figure 7C:
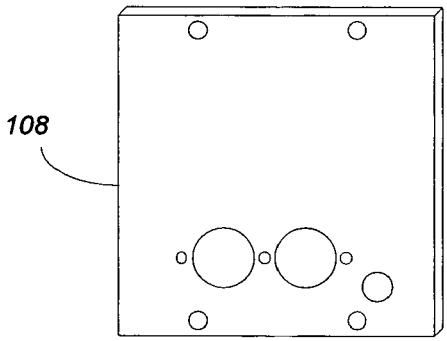
Figure 7D:
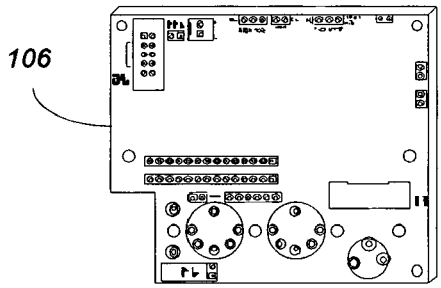

FIGS. 5*a*, 5*b*, and 5*c* provide other examples of configurations and applications of modules of the instant invention. FIG. 5*a* provides another example of how an MTC module and multiple MA1 modules of the instant invention may be combined, for example, in a MIDI music development studio, to provide a capability for monitoring multiple messages within a MIDI data stream. As shown in FIG. 5*a*, an example configuration may include 3 MIDI generating devices such as a computer 50 and two keyboards 51, 65. Chassis 64 includes MTC module 58 that may be used to decode and display the MIDI time code data received via MIDI cable 52 and redistributed via chassis internal ribbon cable/bus sections 53, 54, 55, and 56. MA1 module 59 could be programmed to filter out messages such as 'pitch wheel' and 'program change' messages, MA1 module 60 could be programmed to filter out 'note on' and 'note off' messages, and MA1 module 61 could be programmed to filter out all but 'note on' messages. MA1 module 62, having three inputs, could be switched from chassis internal ribbon cable/bus 56 to MIDI cable 57, via rear MIDI input, sent from keyboard 51, or to MIDI data sent from keyboard 65 via front MIDI input on MA1 module 62. Loop out 63 from module 62 could be set up to echo data from MIDI cable 57 and source computer 50 or keyboard 62.

FIG. 5*b* provides an example of how an MML module and multiple MA1 modules may be combined to provide a different monitoring capability for monitoring content of a MIDI data stream. This configuration illustrates how a user can easily see the data from the keyboard to the computer and then from the computer to the keyboard. In FIG. 5*b* MA1 module 72 is used to view MIDI data from keyboard 70 to computer 71 and MA1 module 73 is used to view MIDI data from computer 71 via cable 82 which passes through MA1 module 73 and is then sent to the keyboard 70 via cable 80. With keyboard 70 sending MIDI data via cable 81 to module 72, the loop out MIDI data (e.g., via a MIDI THRU connector on MA1 module 72) is sent via MIDI cable 83 to computer 71. MIDI data may be sent via MIDI cable 82 to module 73 which can be switched from the chassis internal ribbon cable/bus 77, 78, and 79 to a rear input MIDI input and then its loop out option may be used to send MIDI data via MIDI cable 80 back to keyboard 70. Blank 75 is an unused space, and MML module 74 and MA1 module 76 are used to view, analyze, and/or monitor pertinent messages.

FIG. 5*c* illustrates how multiple MML modules and other modules may be combined in a rack to provide a more extensive monitoring capability for one or more MIDI data streams. FIG. 5*c* is an example of how multiple chasses can be custom configured and expanded later as needed.

MML Module

An MML module is a MIDI message monitoring device. In an example embodiment where the light emitting devices are LEDs, each LED of a row of (e.g., eight) LEDs is programmable to be responsive to a specific message and will respond each time that message is received. Some messages will vary the brightness of an LED responsive to the value of the data byte, while others may turn on full, turn off, or turn on full and then time out and turn off.

Any 9X hex thru FX hex (X representing a hexadecimal variable here and through this document) MIDI messages can be assigned to any LED. The table shown in FIG. 6 gives a detailed description of how LEDs' responses to specific messages may be programmed. The table includes a sample list of messages and responses that may be programmed. Column 1 is a list of messages that may be received. The digits in parenthesis represent the hexadecimal status byte of the message. Column 2 shows how corresponding LEDs will respond (i.e., LED positions that are programmed/assigned to respond to a matching message) either by turning off, changing brightness level, responding to a threshold for on/off (see below), or by turning fully on. 'Control change' messages 40 through 45 hex may produce a threshold response whereby, if the data byte is 63 hex or less the matching LEDs will turn off, and if the data byte is 64 hex or greater, then the matching LEDs will turn on. 'Control change' 7A will cause a response only if the data byte is either 0 or 127. If the data byte value is 0, the matched LED position will turn off; if the data byte value is 127, the matched LED position will turn on; and all other values of the data byte will not cause a change in the status of the LED. As a programming option, an MML module may be programmed to respond to a 'Program Change' message in one of two ways, either the program number data byte will vary the brightness of the respective LED or will turn on fully with any matched message. Column 3 shows messages for which an LED position may be programmed to turn off after a preset time of 3 seconds or possibly another predetermined time. Column 4 shows how an LED position of an MML module may be configured to respond to a respective message while in a programming mode. The programming mode of a CPU in a given row of an MML includes a message assignment section that receives a message from a MIDI generating device and assigns that message type, and following data byte if pertinent, to the respective LED that is on, stores the value (s) in EEPROM, and advances to the next position to be programmed. In effect, this could be viewed as a training session and the programming message may be viewed as a training message. If a 'Note On' message is sent as a programming/training message and received at a MML module CPU in program mode, for example, there is no noticeable delay, the 'Note On', Channel number, and note value are stored in EEPROM and the next position LED is illuminated to represent the next position to be programmed, if the LED position just programmed is position 7 or less. Some devices are limited in the ability to send only one of a particular message type i.e. 'pitch wheel' from a keyboard. A 'YES' in Column 4 indicates if a programming delay, typically 5 seconds, will take place if the respective message is received. If so, the respective LED will blink for the 5 second delay and then advance to the next position. This will give the user time to stop sending the message(s), so that only that LED position will be programmed to respond to that message. After programming the previous position, the user may program the next position by sending another message, skip the next position by pressing the program button, or exit the programming mode using the module reset button. In some embodiments, some messages cause the ML module to initiate a preset delay within the MML module to give a user time to stop sending a 'programming message.' A 'programming message' is an example message of a message type an LED position is being programmed to respond to, sent to a module while in programming mode. In effect, the message portion of the programming mode may be viewed as a training session used to train an LED position on the type of message it is being programmed to respond to. To assign a message to an LED position in order to program a desired response for the LED position, a 'programming message' of the desired type and content, such as a 'note on' with a desired channel and note value—for instance C#3, is sent from a MIDI generating device to the MML module while the CPU for a given row of an MML module is in a programming mode for a given LED position. In this programming mode, the MML module uses parameter values in the 'programming message' to set or 'program' message values to which a given LED position will respond. A 'YES' value in Column 4 may be used for programming an LED position to respond to a message such as a 'pitch wheel' message. If a 'pitch wheel' message is sent from a keyboard as a 'programming message,' a user can not typically send just one pitch wheel signal when he or she touches the wheel. The delay allows a module to accept the 1$^{st}$ message received, e.g., 'pitch wheel' as a 'programming message' and will store values from this message for programming the response of a respective LED position. The module will then wait, typically 5 seconds, blink the respective LED, indicating that position has been programmed and appropriate values stored, and then advance to the next position, which may then be programmed using a next programming message, or a user may exit the programming mode using the module reset button. Column 5 shows the messages for/to which a given LED position may be preprogrammed/assigned to respond. In some embodiments, the only message that would not typically be programmed/assigned to an LED position is a 'Note Off' message, as shown in column 5, but if this message is received and a matched LED position or positions are on, the matching LED or LEDs may turn off.

FIGS. 7*a* through 7*d* show components for an MML module before they are mounted into a chassis. Face plate 100 (FIG. 7*a*) may have one or more printed circuit boards 102 attached and then face plate 100 may be mounted to a chassis. A blank panel 104 (FIG. 7*b*) may be used as a rear panel, or a rear module panel 108 (FIG. 7*c*) with input/output openings may be mounted to the rear of the chassis if an optional input/output printed circuit board 106 (FIG. 7*d*) is attached.

Figure 8A:
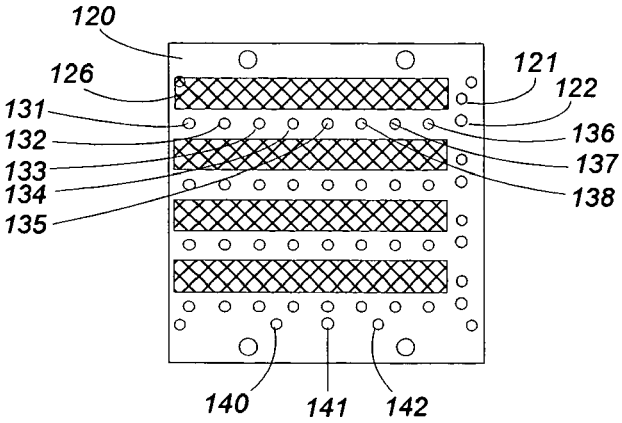
FIGS. 8*a* and 8*b* are illustrations of front and rear panels, respectively, of an MML module of the instant invention.

FIG. 8*a* provides a more detailed description of an MML module face plate including example locations of switches, LEDs, and connectors. Front mount panel 120 will typically have a printed circuit board attached to its backside. Indicator 121 is a Row 1 lamp test, programming mode, and incoming data indicator. Button 122 is a Program button for Row 1 and is used for entering a lamp test mode or for entering a programming mode which, as described earlier, is used to assign messages to LED positions and configure custom settings. Areas 126 are provided for labeling LED positions. LEDs 131 through 138 are LEDs that respond to MIDI messages and provide a "MIDI message indicator via LED" capability. Items 121 through 138 are duplicated on each of the next three rows in this example.

Face plate 120 and an attached circuit board, as described below, also provide a module global power indicator 140, a module global reset button 141, and a module global data indicator 142.

Figure 8B:
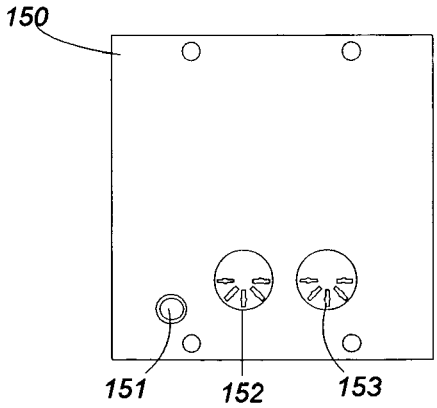

A rear mount panel 150 (FIG. 8*b*) is the backside view of an MML module if printed circuit board 106, for example, was installed on to printed circuit board 102, and has optional access openings for connectors for power input 151, MIDI Input 152, and MIDI THRU 153. Connector access openings are optional and would typically be added if no other modules within a chassis have a circuit board with power and data inputs.

Figure 9:
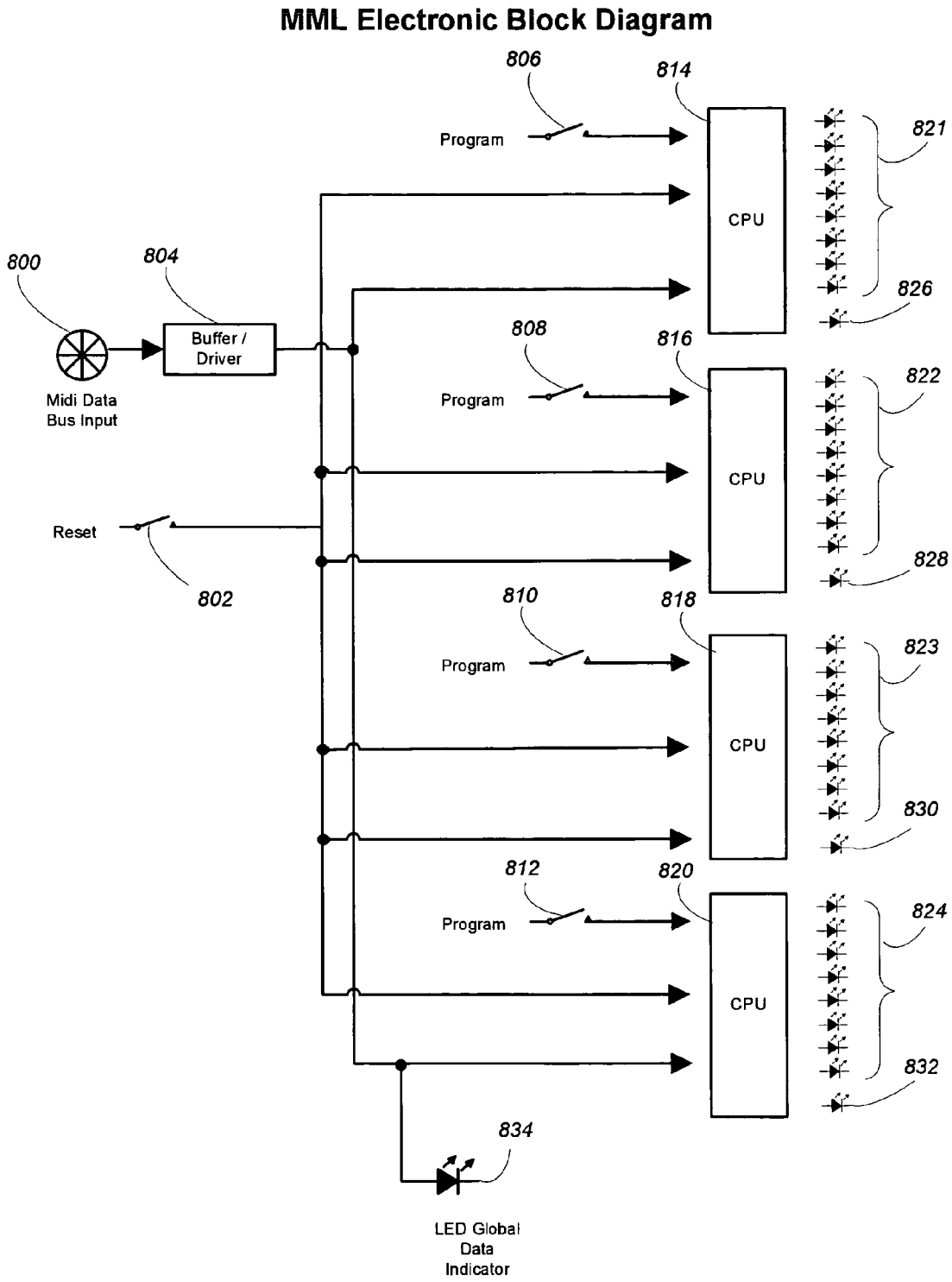
FIG. 9 is an electronic block diagram for electronic components of an MML module.

FIG. 9 is an electronic block diagram for electronics within an MML module. MIDI data input source 800 is buffered at 804 and multiplied to source four CPUs 814, 816, 818, 820 and a module global LED data indicator 834 (which is the same as indicator 142, FIG. 8*a*). CPUs used in some embodiments of the instant invention, including other modules described herein, may be programmable integrated circuits, such as Microchip™ 16F627A or 16F648A chips, that include serial port(s), analog to digital (A/D) converters, random access memory, flash program memory, and EEPROM or other memory capable of storing and retaining user programmed values after power is removed. LED groups 821, 822, 823, 824 are groups of eight LED MIDI message indicators for decoded incoming messages in a MIDI data stream. Each CPU has an LED data and mode indicator 826, 828, 830, 832. Reset switch 802, is a module global reset button (e.g., button 141, FIG. 8*a*) and is connected to a module global reset bus for all four CPUs, and may also be connected to a chassis reset cable/bus connection, which will allow a chassis reset button on another module (e.g., button 408, FIG. 12*a*) in the same chassis to also reset this module when so configured (e.g., via jumper(s) to a reset wire(s) in a ribbon cable/bus connecting modules). Switches 806, 808, 810, and 812 are program buttons (e.g., button 122, FIG. 8*a*) and cause each respective CPU to enter a lamp test mode, or a program mode wherein a user can make programming assignments of messages to LED positions and set module configurations, as explained earlier.

MML Operation

An MML module powers up in a receive mode. LED 140 (FIG. 8*a*) indicates power is present to the module. Reset button 141 (FIG. 8*a*) may be used to reset CPUs for all 4 rows. LED 142 (FIG. 8*a*) is a module global data indicator and will typically be configured to blink each time data is received.

Each row of LEDs may operate independently of other LED rows. For example, although one row may be in a programming or lamp test mode, other rows may be in a normal receive mode. Each row may be programmed, for example, to ignore all incoming messages except for 8 programmed messages. When a MIDI message matching a preprogrammed message assignment is received, one or more LEDs programmed to respond to that message may respond either by changing brightness responsive to subsequent data byte(s) or by turning on full brightness, and each LED may stay on until an appropriate message is received to turn it off or until a timer (e.g., a 3 second timer) elapses.

One of the features of an MML module is the way the module responds to 'NOTE' messages. For example, if an LED position is programmed to respond to a 'NOTE ON' message, then that LED position may respond to other messages, too. Thus, if a particular LED position is programmed to respond to a 'NOTE ON' MIDI message (i.e., a 3 byte MIDI message where byte 1—"status byte"—value correlates to 'note on', channel 3; byte 2 value provides the note value (e.g., c#3); and byte 3 provides a 'velocity' value ranging from 0 to 127) with values channel 01, "NOTE ON" with channel 01 (if channel response is turned on), NOTE C#3, and velocity value of 0, or "NOTE OFF" with channel 01 (if channel response is turned on), NOTE C#3, or an "ALL NOTE OFF" (Control 123) message with channel 01 (if channel response is turned on), or, a "CHANNEL VOLUME" (Control 07) message with channel 01 (if channel response is turned on).

If a respective "NOTE OFF" or an "ALL NOTE OFF" message is received the MML module will turn off the particular LED (and other LEDs that may be programmed to respond to a respective "NOTE ON" message). If a "CHANNEL VOLUME" message is received and the channel information matches the programmed channel, the MML module will change brightness of the particular LED (and any other LED programmed to respond to a channel 01, 'NOTE ON" message) responsive to the value of the following data byte. One formula that may be used to control brightness is: "note velocity"—(127—channel volume)=LED illumination level.

Anytime while a row of LEDs in an MML module is in receive mode a user may place the row in a lamp test mode by tapping the respective program button in that row. The 1st tap will illuminate the LED's at 33%, the 2nd tap at 66%, and the 3rd tap at 100% brightness. Tapping the program button once more will turn off the LEDs and return the row to the receive mode.

MML Software

Figure 10A:
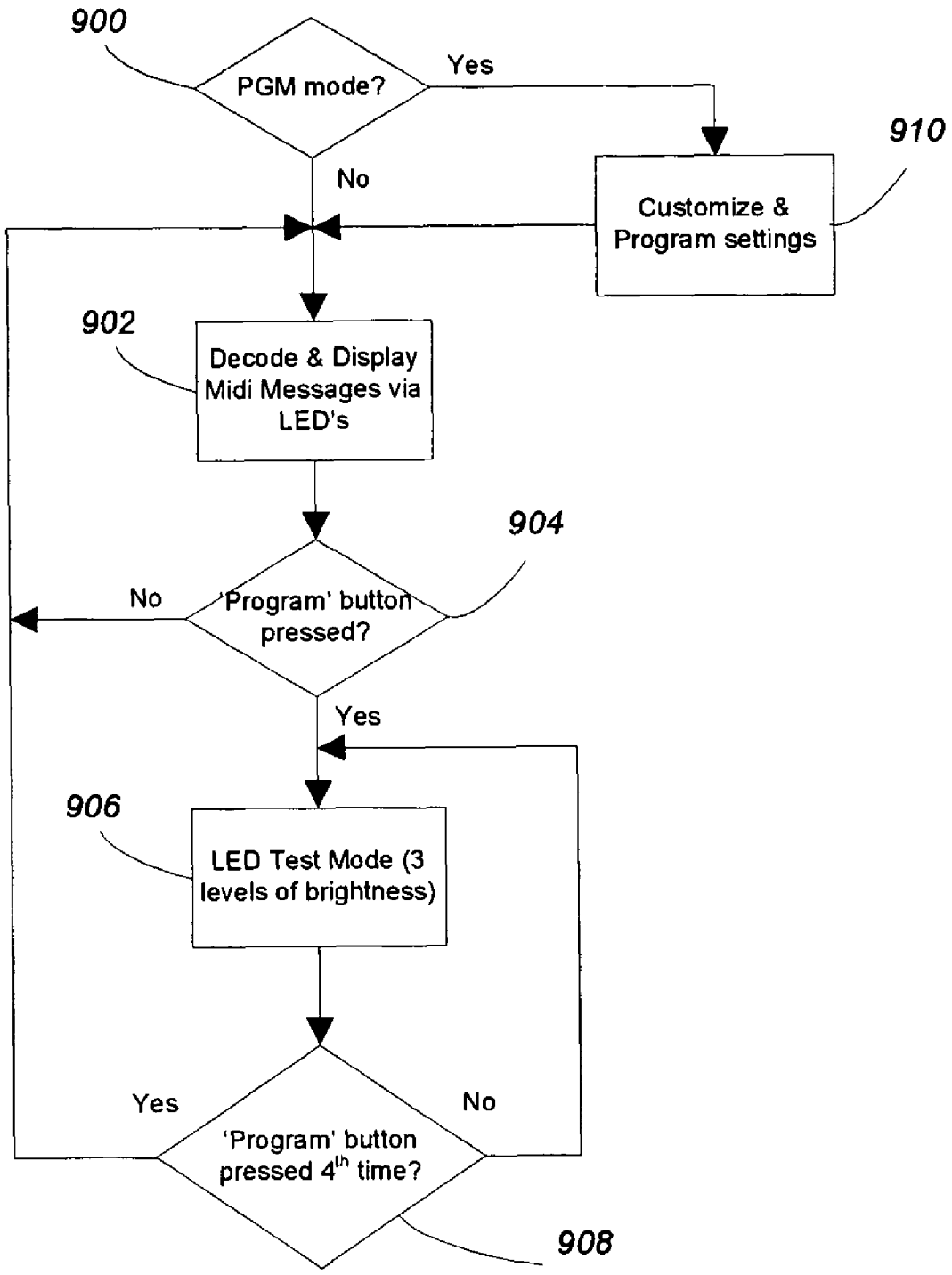
FIG. 10*a* is a general software flow chart for CPUs in an MML module.

FIG. 10*a* is a flow chart for software that may be used on each CPU (814, 816, 818, or 820, FIG. 9) within an MML module. Decision block 900 determines an initial software flow for a given CPU upon energizing or resetting of an MML module. If a Program Button (e.g., button 122, FIG. 8*a*) for a particular row is pressed during power-up or resetting of an MML module, the CPU for that particular row will enter a program mode and allow a user to customize and or program the LED positions for that row at block 910. Otherwise, control passes to block 902 where the CPU enters a receive mode and, if a MIDI message has been received, the CPU for each row of LEDs decodes the message and updates any changes of one or more LEDs within its respective row responsive to prior programming. Otherwise, when no MIDI message has been received, control passes to block 904 and then loops back prior to block 902 unless the Program Button for that row of LEDs is pressed. When a MIDI message is received by the CPU and the message matches a preprogrammed message assignment to which one or more LED positions controlled by the CPU have been programmed to respond, then the respective LED(s) will illuminate according to preprogrammed settings (e.g., see descriptions in FIG. 6). If the Program Button for the respective row is pressed when program control reaches block 904, then control passes to block 906 and LEDs in the row are illuminated at approximately 33% brightness. In an example embodiment, control then passes to block 908 to await another press on the Program Button, then loops back to block 906 unless the Program Button has been pressed four times in this sequence. When control passes through block 906 a second time in a lamp test sequence, LEDs in the row are illuminated at approximately 66% brightness, and control passes again to block 908 to await another Program Button press, upon which control is looped back to block 906 unless Program Button has been pressed four times. When the control passes back to block 906 for the third time in a lamp test sequence, LEDs in the row are driven to 100% brightness. Control again passes to block 908 to await another press on the Program Button. When Program Button is pressed a fourth time in a lamp test sequence, control loops from block 908 back to block 902 to re-establish receive mode and determine if a MIDI message has been received. Another embodiment of this sequence is explained in more detail later herein in association with FIG. 10*f*.

Figure 10B:
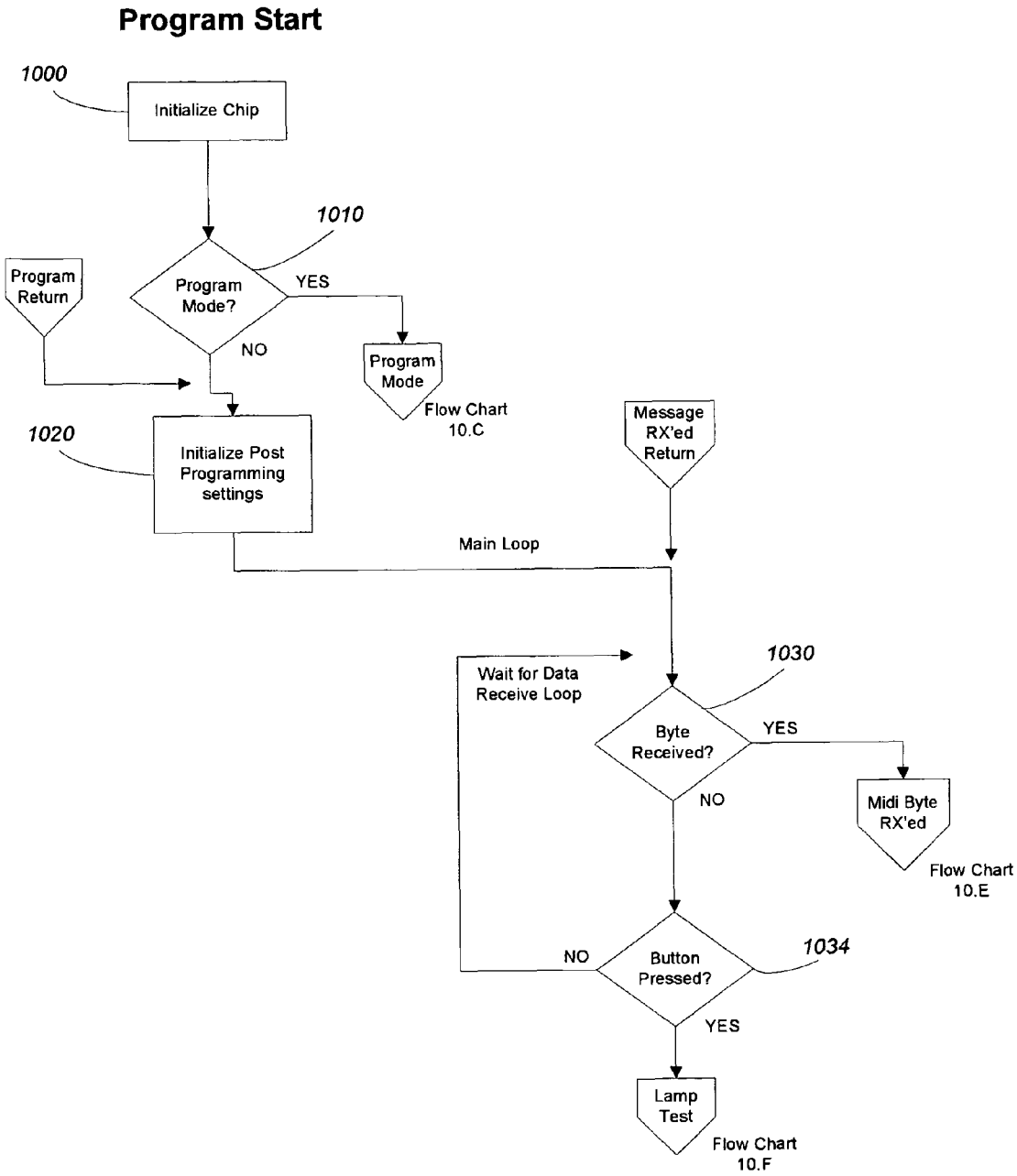
FIG. 10*b* through 10*f* are additional flow charts for software that may be installed within an MML module.

Flowcharts in FIGS. 10*b* through 10*f* provide more detail. In FIG. 10*b*, a CPU is initialized at block 1000. If the program mode is selected then block 1010 will redirect program control to block 1036 in FIG. 10*c* to initialize the program mode and then, via decision blocks 1037 and 1040 (FIG. 10*c*), enter a loop for programming the eight LED positions for specific MIDI messages, and for selecting whether a row will respond to channel information in a MIDI message, and selecting whether the data indicator for the row illuminates in response to incoming data. If the respective program button for that row is pressed by tapping (i.e., held down shorter than three seconds) while in this loop, the respective LED position is skipped and the current settings (i.e., programming) for control of that LED are not changed. If the switch is held for three seconds or more, the response of the respective LED position can be programmed for special timing clock messages (e.g., F1, F8, or FE) via a sequence beginning at block 1082 (FIG. 10*c*) and including blocks numbered 1076 through 1094, with program control being returned to decision block 1060, from which a counter is advanced at block 1062 and control is returned to block 1037 unless all LED positions (i.e., 8 positions in this example) have been programmed, whereupon control advances from block 1060 to block 1096 (FIG. 10*d*) to continue user changes and review and/or confirmation of stored settings, after which program control is returned to block 1020 (FIG. 10*b*).

As noted earlier, a programming message, of the type to which an LED position is being programmed to respond, may be sent to an MML module when the respective module CPU is in a program mode and used to "train" an LED position on a message to which it is being programmed to respond. When a byte of such a message is received at block 1040 (FIG. 10*c*), step 1048 decodes the byte. If it is a status byte then block 1052 waits until the following byte(s) needed to form an acceptable message to assign to the respective LED position (e.g., see FIG. 6, column 5) have been received, then the code continues to step 1066. If the message was a 'Program Change' (status byte comprising hexadecimal 'CX') message then the program halts for four seconds to allow special features to be programmed. Otherwise step 1068 will store the message and may pause the programming mode temporarily for specific MIDI messages that have a potentially high data rate (see FIG. 6, column 4).

Figure 10C:
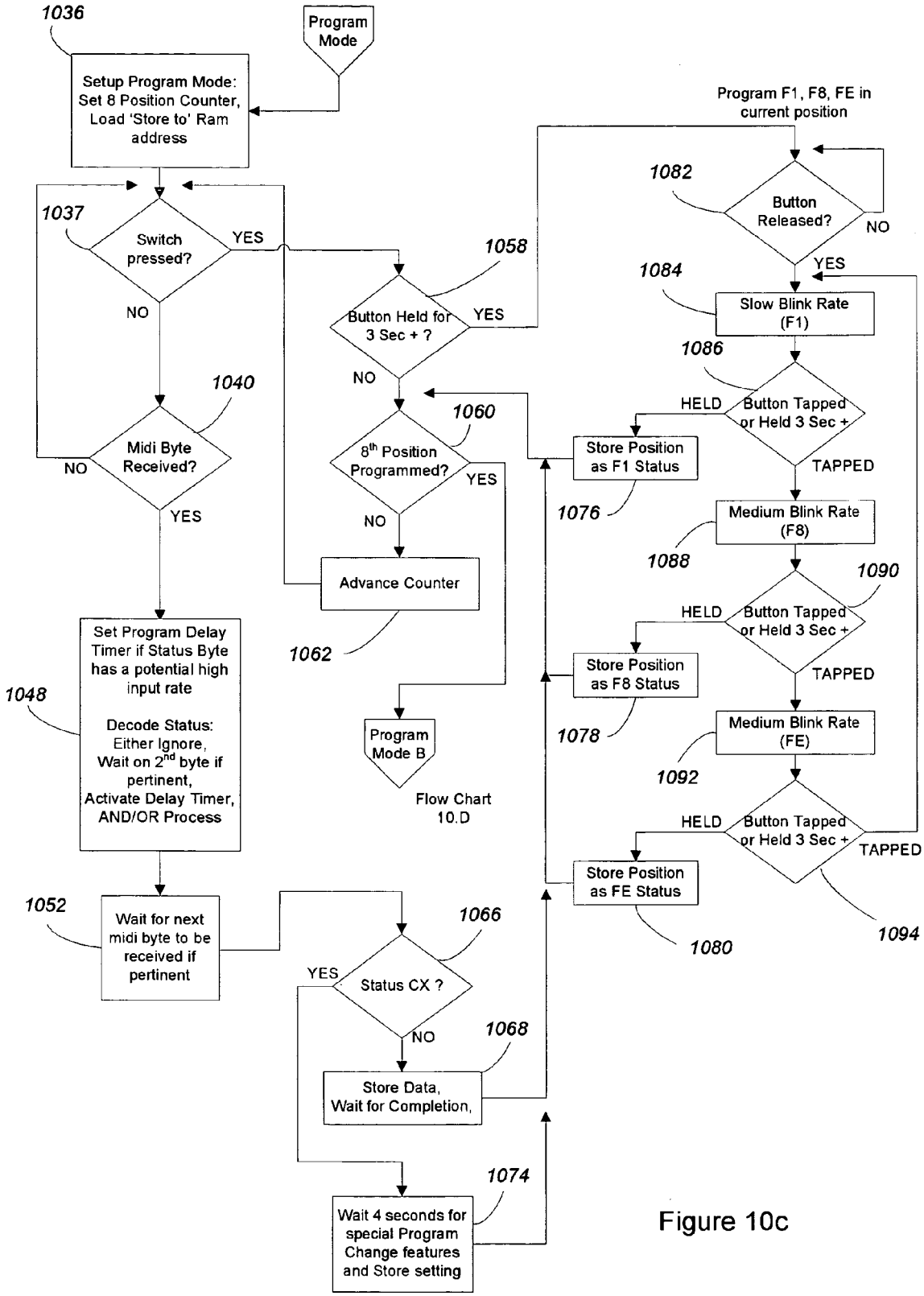
Figure 10D:
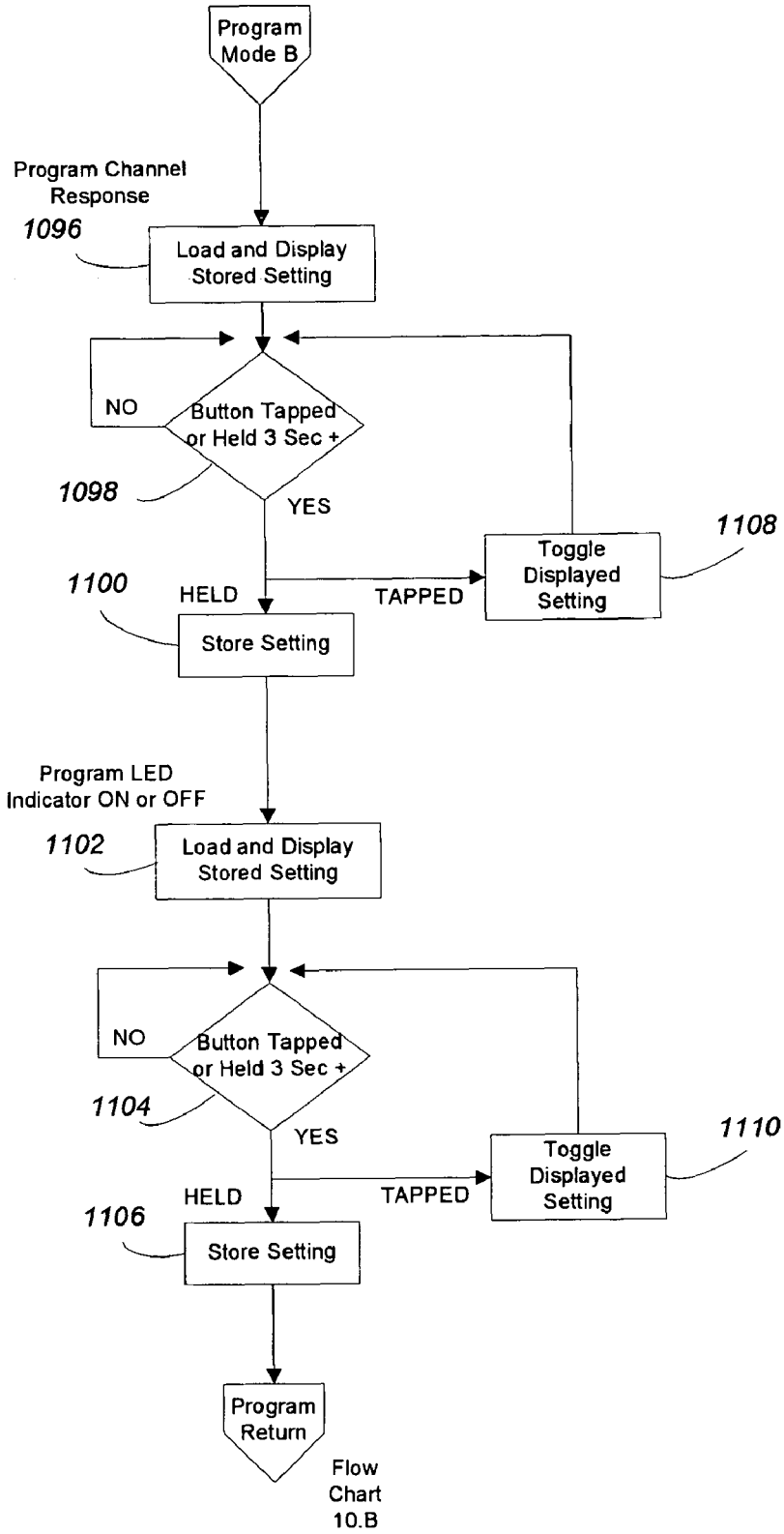

As noted, after all LED positions (e.g., 8 in this example) in a row are programmed or skipped, program control branches from block 1060, FIG. 10*c*, to block 1096, FIG. 10*d*, which allows the setting of the CPU global channel response, and setting the CPU global incoming data response indicator to be turned on or off.

A respective row of eight LEDs may be programmed to either respond to or ignore channel information in a MIDI message. This programming selection is made in a sequence beginning at block 1096 (FIG. 10*d*) and ending at block 1100. At block 1096, the current setting for a selected row is loaded and displayed via that row's LEDs in a predefined pattern (e.g., LEDs 1 through 4 being illuminated with LEDs 5 through 8 not illuminated may indicate 'channel response' is 'on,' where LEDs 5 through 8 being illuminated with LEDs 1 through 4 not illuminated may mean 'channel response' is turned 'off'). If the respective program button is tapped, the current setting (e.g., respond to channel information) will toggle on or off until the button is held for 3 seconds or more. That is, program control remains in a loop at block 1098 until the program button is held down for more than 3 seconds, after which control moves to block 1100, where action is taken to store the currently displayed setting.

The respective row's data indicator (e.g., indicator 142, FIG. 8*a*) may be programmed to blink for every byte received or simply not respond when data is received. Block 1102, FIG. 10*d*, will display the current setting (e.g., via LED patterns of that row, as described earlier). If the respective Program button for the row is tapped the current setting (e.g., blink for each data byte) will toggle between 'incoming data' indicator response 'on' or 'off.' Program control remains in a loop at block 1104 until the Program button for the row is held down for more than 3 seconds, after which control moves to block 1106, where action is taken to store the currently displayed setting, and program control returns to block 1020, FIG. 10*b*.

Upon exiting the programming mode, or if the program mode was bypassed upon powering up ("NO" branch, block 1010, FIG. 10*b*), program control continues to block 1020 of FIG. 10*b*, where post programming settings are initialized and all boot up and stored settings are recalled, then program control enters a MIDI data receive mode loop comprising blocks 1030 and 1034. Program control will continue to loop between blocks 1030 and 1034 until either a MIDI byte is received or the Program button for the row is pressed.

Figure 10E:
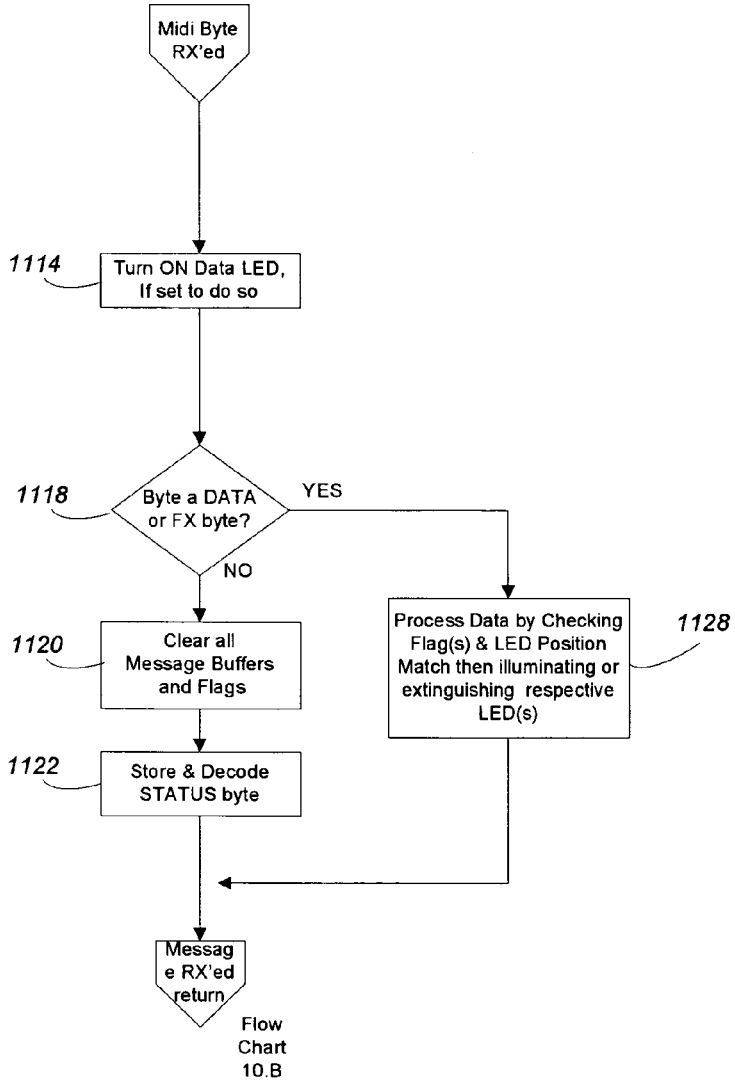
Figure 10F:
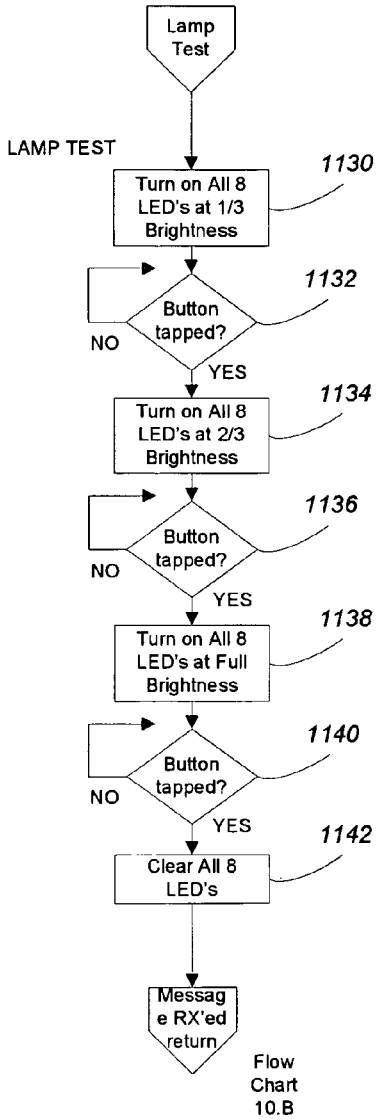

If the Program button is pressed, then control branches from block 1034 to a lamp test mode beginning at block 1130, FIG. 10*f*. The 1st tap will illuminate the LEDs at 33% brightness at block 1130, the 2nd tap will cause control to branch out of a loop at block 1132 and move to block 1134, where LEDs are illuminated at 66% brightness, and the 3rd tap will cause control to branch out of a loop at block 1136 and continue to block 1138, where LEDs are illuminated at 100% brightness. Tapping the Program button for the row once more will cause program control to branch out of a loop at block 1140 and move to block 1142, where all LEDs for the row are cleared (turned oil), and then program control returns to a receive mode at block 1030, FIG. 10*b*.

Continuing from block 1030 FIG. 10*b*, if a MIDI byte is received, then program control passes to block 1114, FIG. 10*e*, where the respective data indicator LED may be illuminated in response to programmed settings. Control then passes to decision block 1118 where the received byte is decoded to determine if it is an FX status byte or a DATA byte. If the received byte is an FX byte or a data byte of a MIDI message then control passes to block 1128 where the message is processed. If the message is incomplete (e.g., $2^{nd}$ byte of 3) then pertinent message values are stored for the next byte(s) to be received to complete the message. At block 1128, if the message is complete, valid and message parameters match criteria programmed for any of the eight LED positions in that row, then the illumination status of the respective matching LED position(s) are updated responsive to parameters of the incoming message. For example, brightness of a matching LED may be changed responsive to a change in a velocity data value in a "NOTE ON" MIDI message. Upon completion of processing for a message or message byte in block 1128, program control returns to block 1030, FIG. 10*b*, to await more data. At block 1118, FIG. 10*e*, if a received byte is not a DATA byte or an FX status byte, then the received byte would be a 9X through EX status byte and program control passes to block 1120, which clears message buffers and flags to set up for processing a new message. Control then passes to block 1122 which decodes and stores the status byte and returns to block 1030, FIG. 10*b*, to await more data.

MA1 Module

An MA1 module is a MIDI message decoder, analyzer, and display module with a buffer to store, and allow a user to scroll through, previous MIDI messages. An MA1 module may be programmed for many different functions and custom configurations. Multiple MA1 modules may be ganged together, for example, with each one programmed to display selected messages by filtering out other messages, so that a user can see the latest information at a quick glance. An MA1 module has two receive modes of operation: decode and hex mode, as may be selected and set in programming mode.

In the decode mode, an MA1 module will decode any incoming MIDI message and display the message type, channel number, and decimal equivalent of the data. Any message type can also be filtered from being displayed or stored.

In the Hex mode, an MA1 module displays received data in a hexadecimal format, without decoding, for more technical viewing.

An MA1 module has special filtering functions in both decode and hex mode for 'Midi Time Code' (F1), 'Time Clock' (F8), and 'Active Sensing' (FE) messages. An indicator shows if those messages are present whether they are filtered or not.

Figure 11A:
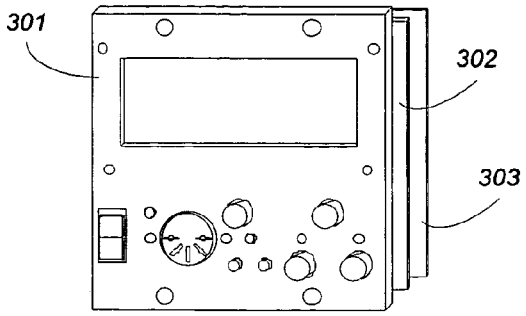
FIGS. 11*a* and 11*b* are isometric illustrations of front and rear panels, respectively, of an MA1 module of the instant invention, showing circuit boards attached to the front panel.
Figure 11B:
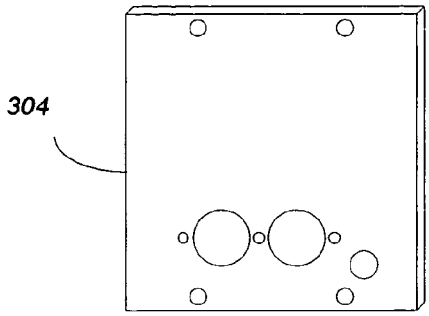

FIGS. 11*a* and 11*b* show components of an MA1 module before they are mounted into a chassis. An MA1 face plate 301 may have printed circuit boards 302, 303 attached and then be mounted to a chassis. Rear panel 304 may have input/output and power connector access holes to allow signal and power cables to be attached to connectors on circuit board 303, or, in some embodiments, suitable receptacle connectors may be integrated into rear panel 304 and attached to one or more circuit boards by cable or other means.

Figure 12A:
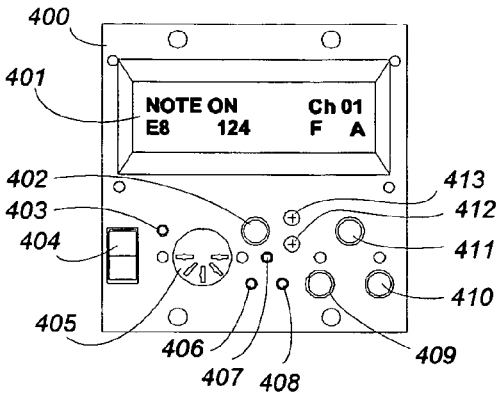
FIGS. 12*a* and 12*b* are annotated illustrations of front and rear panels of an MA1 module.
Figure 12B:
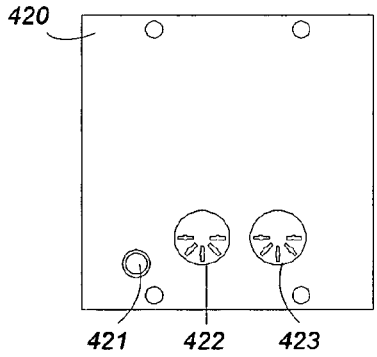

FIGS. 12*a* and 12*b* provide more detailed and annotated illustrations of components of an MA1 module. As illustrated in FIG. 12*a*, a liquid crystal display, switches, potentiometer adjustment access, LED indicators, and printed circuit boards may be attached to, or provided for in, front mount panel 400. A representative liquid crystal display 401 shows an example of a displayed message. Front/rear input selection switch 402 permits selection of inputs from connectors on the front or the rear of the MA1 module, and LED 403 indicates if front connector 405 is selected. Module global power switch 404 may be configured to supply power to just the MA1 module or also to other modules in a chassis. An MA1 module front panel may also include a module global reset button 406 that re-initiates all CPUs in the module, an incoming data LED indicator 407, which may be an LED responsive to incoming data, or Hold mode, a chassis reset button 408 that will reset any module within a chassis configured to be reset from a chassis reset button (e.g., via the ribbon cable/bus as described earlier herein). A LEFT scroll button 409, a RIGHT scroll button 410 and a HOLD button 411 allow a user to select and scroll through data on display 401, which can be adjusted using LCD contrast adjustment potentiometer 412 and back light adjustment potentiometer 413. Additional functions of switches 409, 410, and 411 may include: entering and making changes in the program mode, and, by pressing and holding all three buttons during a reset or power on, the module input selection will toggle between the ribbon cable/bus and the front/rear MIDI connectors.

As noted, rear mount panel 420 has openings for access to connectors for power input 421, MIDI input 422, and MIDI THRU 423.

Figure 13:
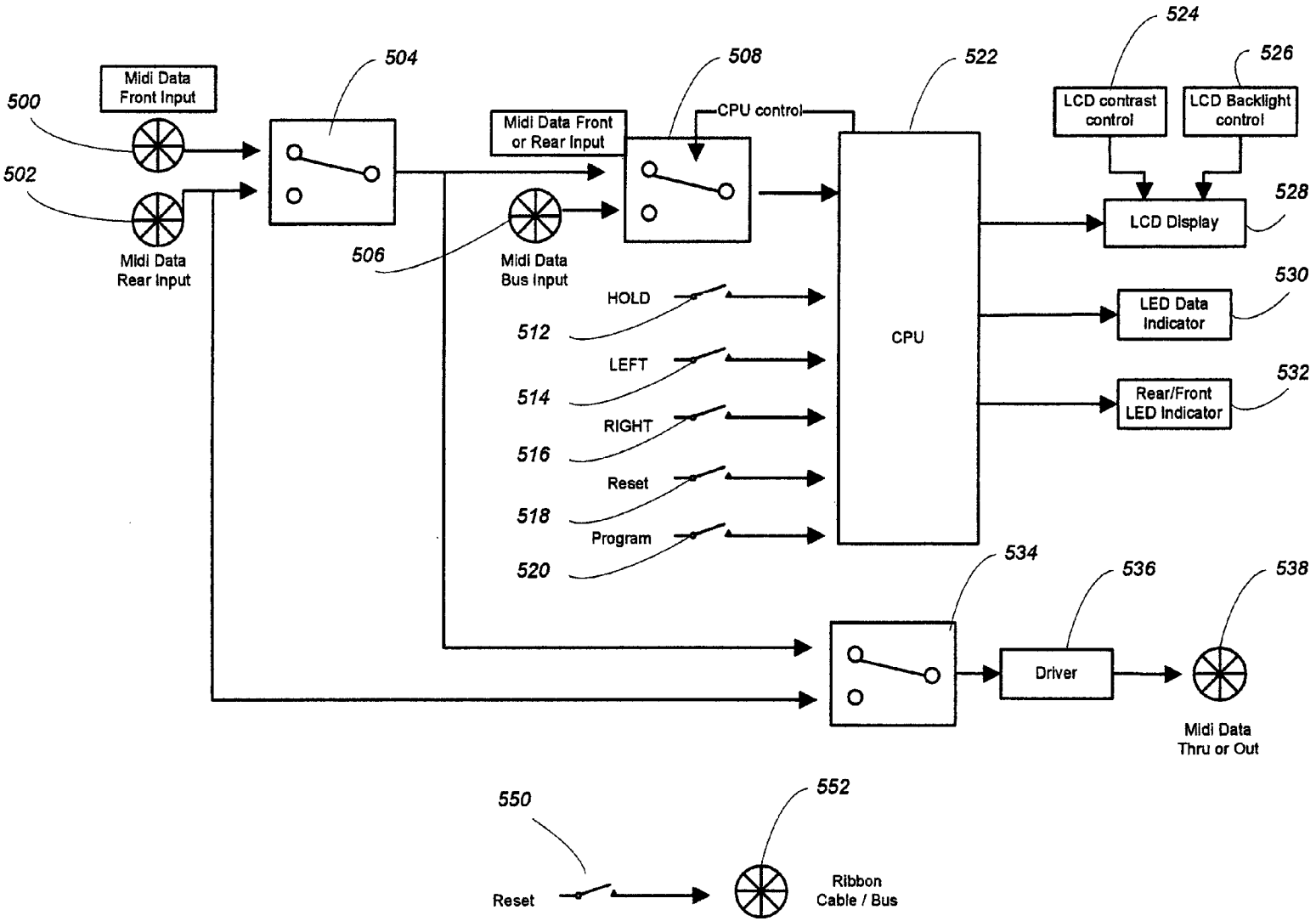
FIG. 13 is an electronic block diagram for electronics in an MA1 module.

FIG. 13 is an electronic block diagram for electronics in an MA1 module. Front MIDI input connector 500 and rear MIDI input connector 502 provide for MIDI data input, and mechanical switch 504 selects between the front and rear inputs. Ribbon cable 506 can provide a third input source of MIDI data generated from another module within the same chassis, and may be selected via user programmable options through a CPU controlled switch 508. Front access switches 512 through 520 provide user control over CPU options. Hold switch 512 (controlled by hold button 411, FIG. 12*a*) may be used to suspend data reception and allow previously received messages to be viewed and scrolled through using 'Left' and 'Right' switches 514 and 516, respectively, controlled by Left and Right scroll buttons 409, 410, respectively. Switch 518 (closed by module global reset button 406, FIG. 12*a*) may be used to reset CPU 522 and clear the display and internal buffers for the local module only. Switch 520 may be used to direct CPU 522 into a program mode for changing operational options. Potentiometers 524 and 526 may be used to adjust LCD contrast and back light, respectively, for liquid crystal display 528. LED 530 indicates MIDI data activity and LED 532 indicates whether the front or rear input is selected. A printed circuit board jumper 534 selects a source for output MIDI connector 538 through driver 536. The output can either be 'THRU' by repeating MIDI data from input connector 502 or it can be an 'OUT' which repeats MIDI data from a point after front/rear selector switch 504.

Switch 550, FIG. 13 (closed by chassis reset button 408, FIG. 12*a*) will reset any module configured to allow reset within a chassis connected via ribbon cable/bus 552.

Power switch 404 (FIG. 12*a*) may be configured to turn power on and off to the local MA1 module only or supply power to the ribbon cable/bus 552 which in turn may supply power to other modules within a chassis. Alternatively, an MA1 module may be configured to take power from ribbon cable/bus 552 supplied by another module or other source.

Figure 14A:
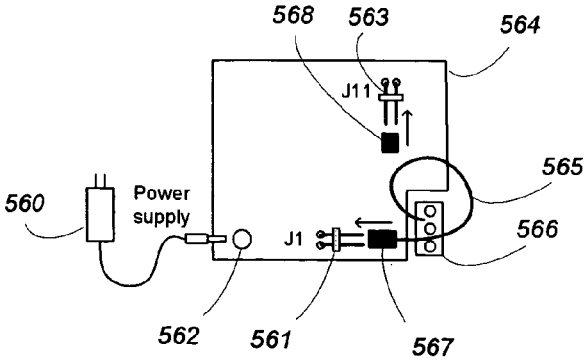
FIGS. 14*a* and 14*b* are illustrations of a portion of a circuit board for an MA1 module showing how jumper and connector configurations may be modified to control how power is applied to this and other boards in a chassis.
Figure 14B:
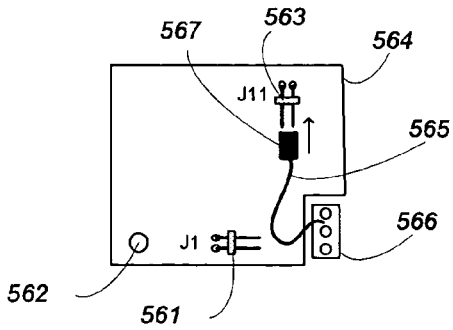

FIGS. 14*a* and 14*b* illustrate how a power source for a module may be selected via configuration of headers 561 and 563. FIG. 14*a* is an example illustrating how headers 561 and 563 may be configured to allow an MA1 module to use an external power supply 560 for its own power and also supply power to other modules within a chassis. Header 561 on rear printed circuit board 564 accepts power from external power supply 560 and routes it to switch 566 via 2 wires 565 connected to connector 567 which may be mated with header 561, which supplies power to the local MA1 module. Header 563, if shunt 568 is installed, provides a connection with a power supply via front panel switch 566, thereby making power available to other modules connected to, and configured to accept power from, ribbon cable/bus 552. FIG. 14*b* shows an example of the rear of printed circuit board 564 configured to accept power from ribbon cable/bus 552 rather than external power supply 560. An MA1 module in this configuration, with no connector attached to header 561, receives power from ribbon cable/bus 552 via header 563, and power switch 566, via two wires 565 installed into a 2-pin housing 567 connected to header 563, switches power to the local MA1 module only, and there is no need for an external power supply attached to connector 562.

MA1 Operation and Software Flow

Figure 15:
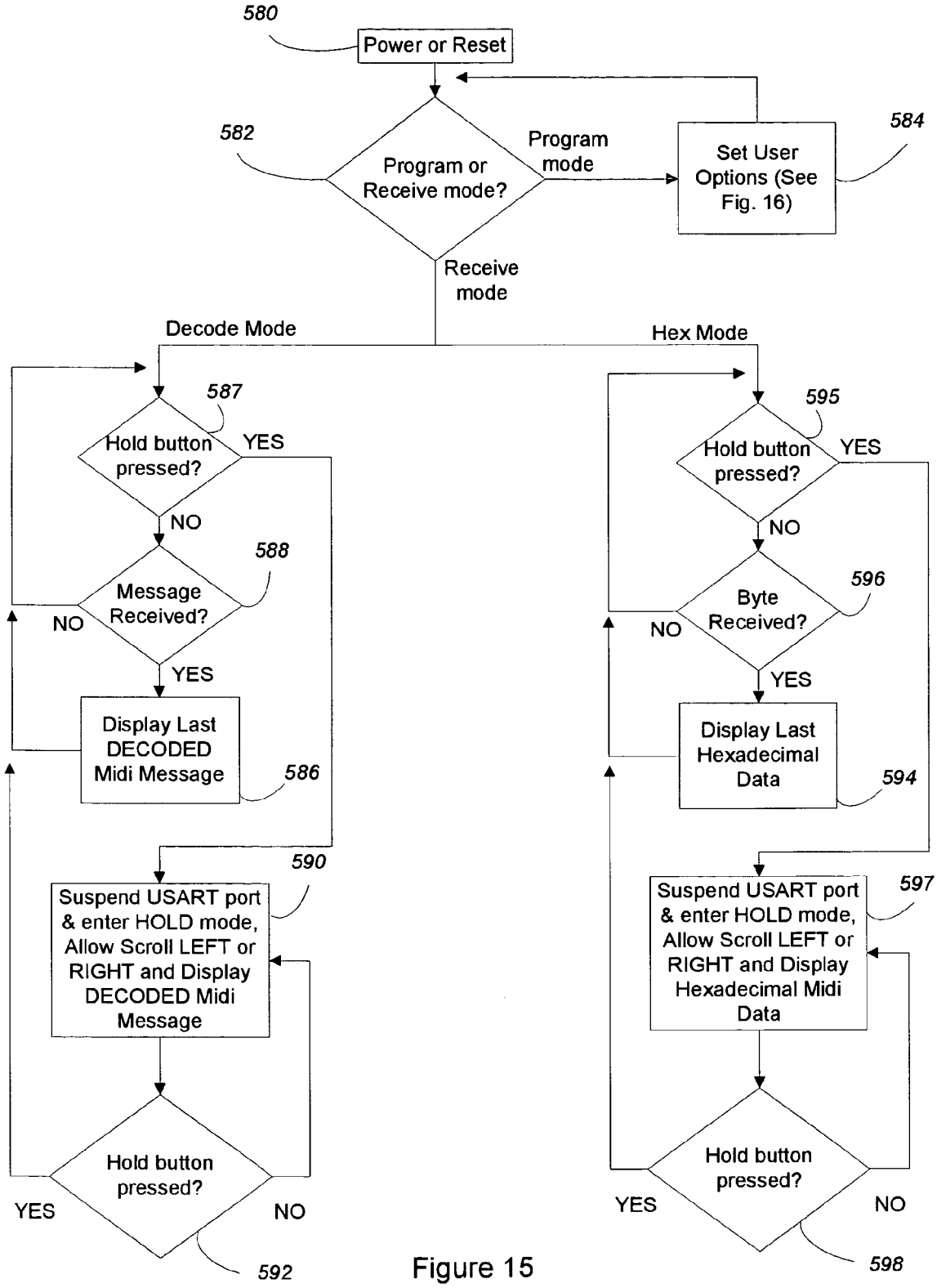
FIG. 15 is a top level flowchart for operational software for an MA1 module.

FIG. 15 shows a top level operation flow chart for an MA1 module. An MA1 module has several modes of operation. When an MA1 module is energized with power, or reset, program control initiates at block 580 and proceeds to block 582 where a check is made to determine whether the program button is pressed, whereupon the module enters a program mode and program control proceeds to block 584. Otherwise, the module enters a HEX or decode receive mode, determined by preprogrammed settings, and program control proceeds to block 587 if in a decode mode or block 595 if in HEX mode. If a message is received in the decode mode at block 588, then block 586 will decode and display the message and return control back to block 587. While waiting on a message, block 587 checks if the hold button (411, FIG. 12*a*) has been pressed. If so, block 590 suspends the receive mode and enters the HOLD mode and allows the user to scroll through previous messages. When the HOLD button is pressed again, block 592 exits the HOLD mode and resumes receiving data. If the module is in HEX receive mode and a byte is received, then block 596 redirects program control to block 594 to display the last byte received, and then program control returns to block 595. While waiting on a byte, receive block 595 checks if the hold button has been pressed. If so, block 597 suspends the receive mode, enters the HOLD mode, and allows the user to scroll through and display previous data bytes. When the HOLD button is pressed again, block 598 reactivates the USART port, exits the HOLD mode, and returns control to block 595 to resume receiving data.

Figure 16:
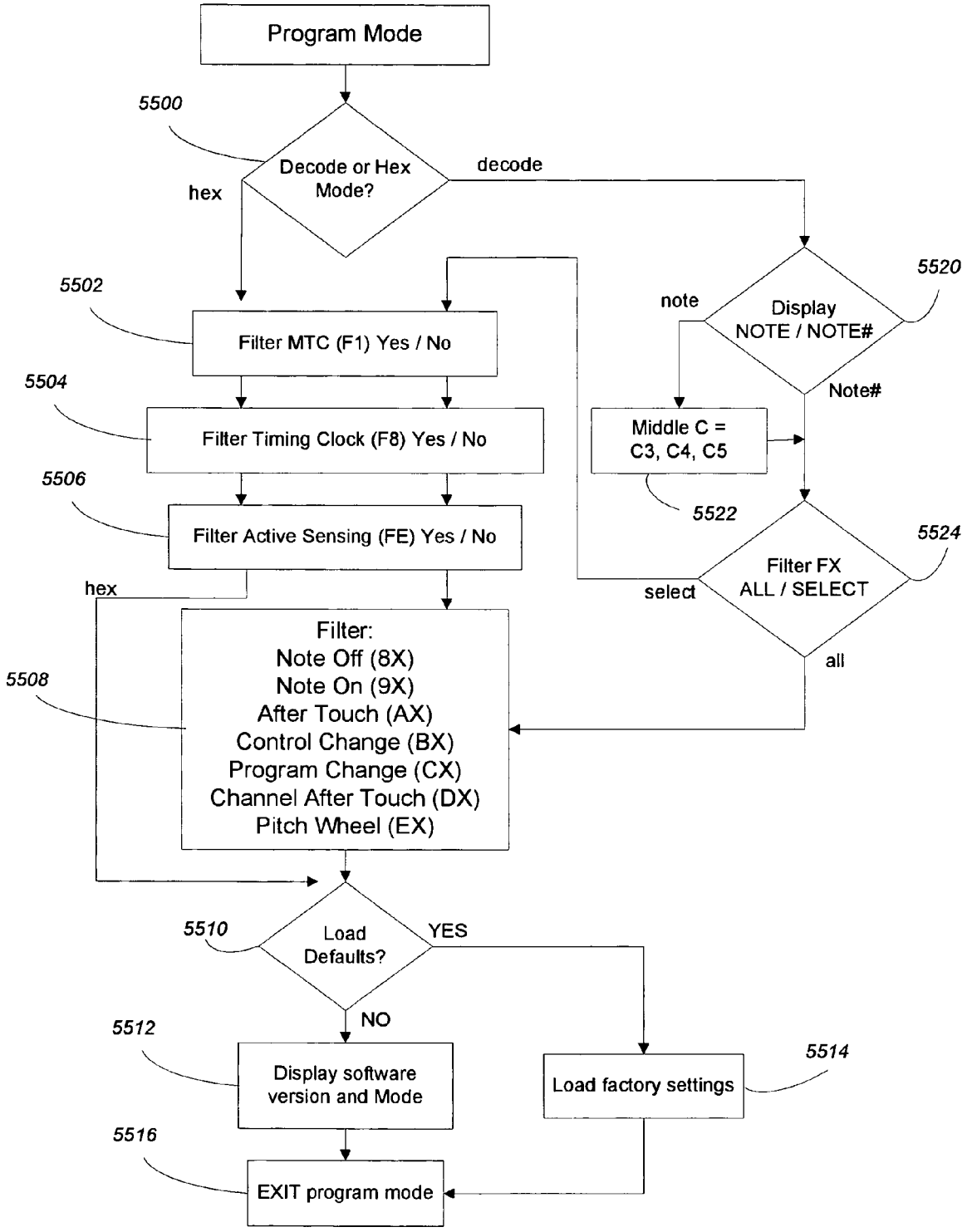
FIG. 16 is a software flowchart for the programming mode of an MA1 module.

FIG. 16 is a software flow chart for the programming mode of an MA1 module, also referred to herein as a program mode. The receive mode of the module is determined at block 5500 by pressing either the LEFT or RIGHT buttons (buttons 409, 410, respectively, FIG. 12*a*) which will toggle between HEX and Decode modes, with the setting selected here determining the remaining program selections that can be made. 'Decode mode' decodes the incoming data, and 'Hex mode' displays the incoming data in a hexadecimal format without decoding. Responsive to user selection via LEFT or RIGHT buttons noted above, program control branches from block 5500 to permit programming of settings appropriate to the detected receive mode.

If 'HEX' mode is selected at block 5500 then program control steps to blocks 5502, 5504, and 5506 to allow a user to program options to store and display, or delete and filter out, all F1, F8, and FE messages, respectively. Program control then steps to decision block 5510 to determine if factory defaults are to be loaded via a YES/NO selection using LEFT or RIGHT buttons and pressing the HOLD button to execute. If factory defaults are to be loaded, then program control steps to block 5514 to load factory defaults, after which program control steps to block 5516 to exit program mode. If "load defaults" is not selected at block 5510, then program control steps to block 5512 which displays the CPU software revision identifier and mode of operation on liquid crystal display 401, FIG. 12*a*. Program control then steps to block 5516 to exit the program mode and return the module to a receive mode at block 582, FIG. 15.

At block 5500, if 'Decode' mode is selected, program control steps to block 5520 where a user is allowed to select whether note data in a MIDI message is displayed as a musical note (for example: 'C#1') or as a note number (for example: '32'). If musical note is selected then block 5522 is executed to allow a user to define the bank number of middle C for the present configuration. By either route from block 5520, program control arrives at block 5524 which allows a user to select whether to filter out (i.e., not store or display) all FX messages or if F1, F8, and/or FE will be individually set to be filtered or not. If a user selected to set filter options for FX messages individually, program control proceeds though blocks 5502, 5504, and 5506 for user selections for individual message types before arriving at block 5508. If a user elects to filter all FX messages at block 5524, then program control proceeds directly to block 5508. Block 5508 includes a seven step process which turns a filter option on or off for all other messages, including:

1. 8X—Note Off
2. 9X—Note On
3. AX—Polyphonic After Touch
4. BX—Control Change
5. CX—Program Change
6. DX—Channel After Touch
7. EX—Pitch Wheel.

From block 5508, program control proceeds to block 5510 where a user is allowed to select whether to load defaults or not as described earlier, from which program flow proceeds as described earlier, and then exits program mode at block 5516, returning the MA1 module to receive mode at block 582, FIG. 15.

Figure 17:
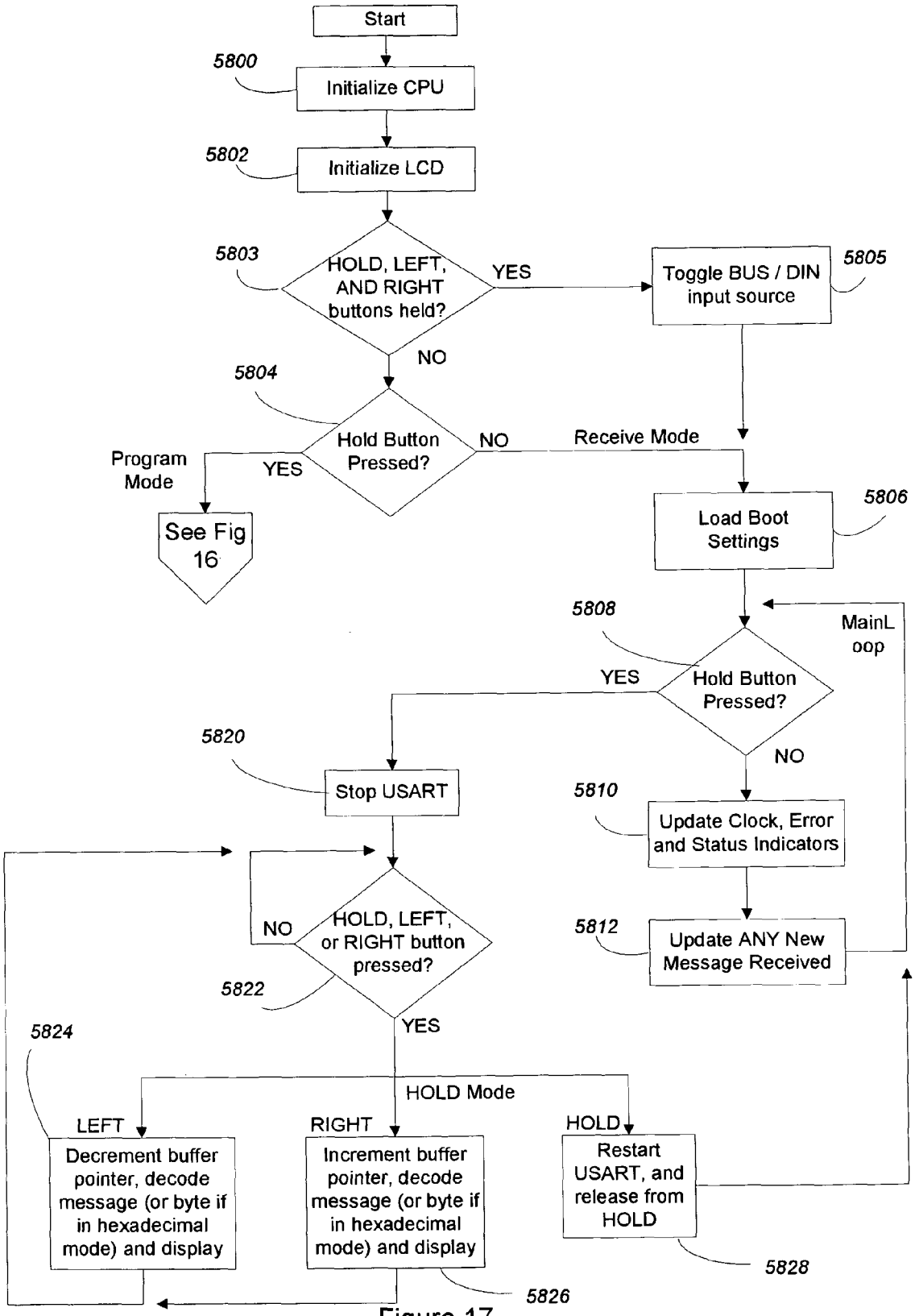
FIG. 17 is a software flowchart that provides additional detail regarding software flow for an MA1 module.

The flowchart in FIG. 17 provides additional information regarding CPU software flow for an MA1 module. Blocks 5800 and 5802 initialize the CPU and LCD, respectively, when power is applied to the MA1 module, or if the module is reset using module global reset button 406 (FIG. 12*a*). In an example embodiment described here, if the HOLD (program) button 411 (FIG. 12*a*), LEFT and RIGHT scroll buttons 409, 410 (FIG. 12*a*) are all three held down during power up or reset when program control reaches block 5803, then at block 5805 the CPU will toggle the input source from the ribbon cable/bus to the din/MIDI input, or vice-versa, and the setting is stored. If only HOLD (program) button 411 is held down by a user during power up or reset then program control passes through block 5803 to block 5804, where it is determined the user is requesting to enter the program mode, and program control branches to block 5500, FIG. 16. If program mode is not selected at block 5804, program control branches to block 5806 which loads a boot configuration; which may be factory settings or previously programmed user custom settings. Settings loaded at block 5806 determine the data that will be displayed on the module.

The MA1 module then enters its main software loop comprising blocks 5808, 5810, and 5812. Within this main loop, if the HOLD button is pressed when program control passes through decision block 5808, program control branches to block 5820. Otherwise, control passes to block 5810 where data receive status is updated, if necessary, responsive to any updates to received data, input errors, or changes to clock messages, then control passes to block 5812 where, depending upon receive mode (decode or HEX) any newly received message (in decode mode) or byte (in hex mode) is processed and displayed.

As noted, if the HOLD button is pressed when program control passes through decision block 5808, the module enters the HOLD mode and program control passes to block 5820 which stops the USART port from receiving any new data and awaits either HOLD, LEFT, or RIGHT button (411, 409, 410, respectively, FIG. 12*a*) to be pressed at block 5822, with the contents of the last received message or byte being displayed on liquid crystal display (401, FIG. 12*a*). If the LEFT button is pressed, control passes to block 5824 where a buffer pointer is decremented to access and display the previous message (if in decode receive mode) or byte (if in HEX receive mode). In decode mode, the previous message is decoded and displayed in liquid crystal display 401. If in HEX mode, byte contents are displayed in hexadecimal format in display 401. If at block 5822 the RIGHT button is pressed, then control passes to block 5826 where a buffer pointer is incremented to access the next stored message or byte if the pointer was previously moved to a previous message or byte, otherwise the pointer remains at the last message or byte received before the HOLD button was pressed to switch from receive to HOLD mode. Contents of the newly accessed byte or decoded message are then displayed as described above. After either the LEFT or RIGHT scroll button is pressed and control passes through block 5824 or block 5826, respectively, program control returns to decision block 5822. Thus, in this mode, a user can continue to press LEFT or RIGHT scroll buttons to view contents, in display 401, of messages or bytes stored within the CPU internal buffer, thus allowing a user to view contents of several messages or bytes received just prior to pressing the HOLD button at block 5808. If the HOLD button 411 is pressed again while in the HOLD mode then control branches from block 5822 to block 5828 which restarts the USART port to begin receiving data again. Program control then returns to the main loop at block 5808.

Figure 18:
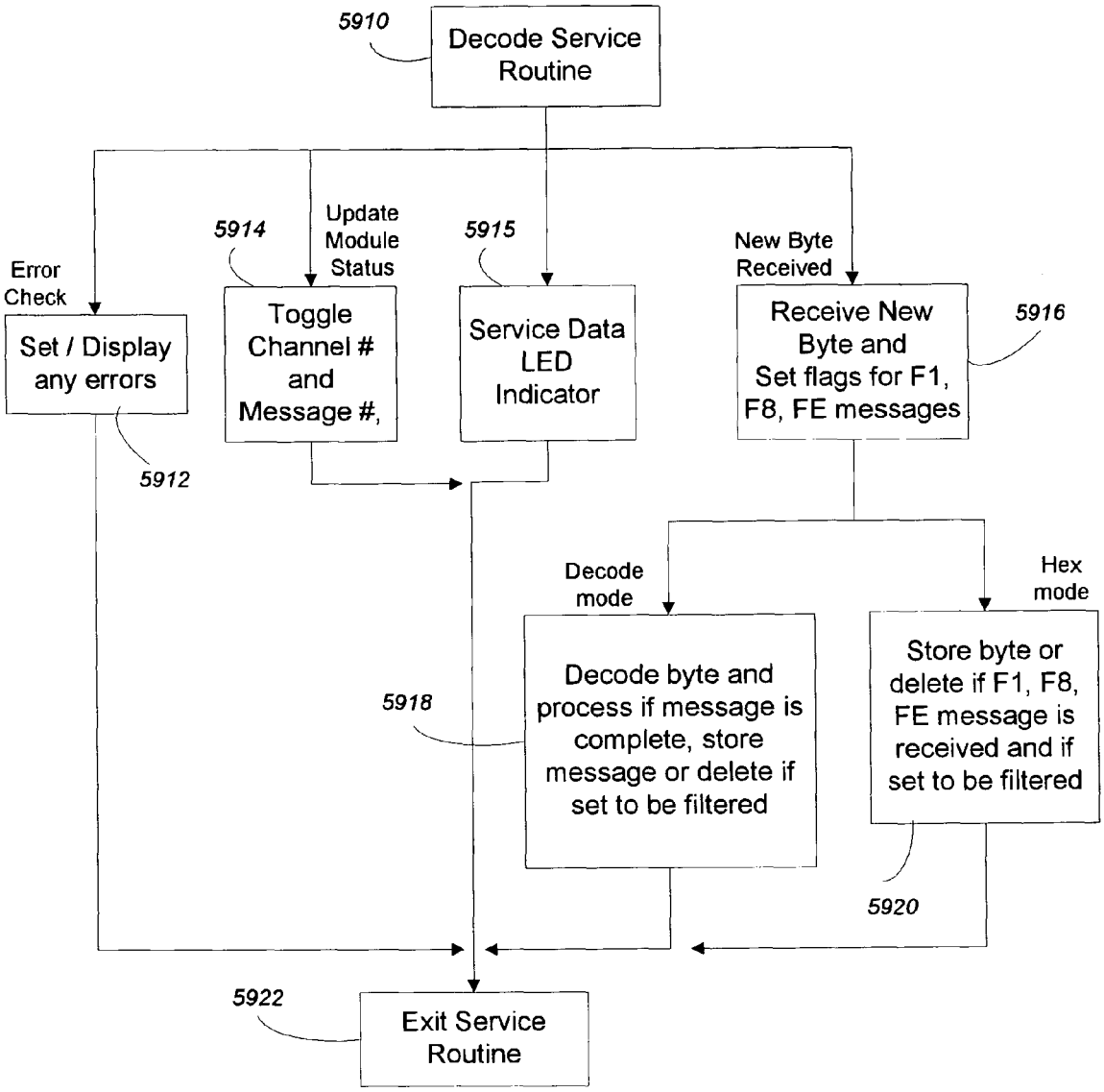
FIG. 18 is a flowchart for a service routine that supports other software executing on an MA1 module.

FIG. 18 is a flowchart for a Service Routine that may execute by a timed basis, or responsive to the USART register receiving a new byte, to check for errors, update module status, or decode new data received. An Interrupt Service Routine (ISR) could be executed if, for example, if the Hold mode is entered, block 5808 (FIG. 17), a timer starts and the ISR is turned on to toggle the Channel #, and Message # every second or so, which occupy the same section of the LCD, or if in the receive mode a byte is received LED 407 (FIG. 12*a*) is illuminated and a timer starts and the ISR is turned on, for this function, and upon the timer ending the ISR turns the LED off, in effect extending its 'on' time from microseconds to possibly several hundred milliseconds. Upon receiving a interrupt service request, block 5910 decodes which interrupt was requested and directs program control to the respective block. While in the receive mode, interrupt block 5912 will execute on a time interval, typically one time per second, and checks if any errors were encountered while receiving new data. While in the DECODE hold mode, interrupt block 5914 will also execute on a time interval, typically one time per second, and is used to toggle the Channel number and Message number in a message display. While in the HEX or DECODE receive mode and a byte is received, a timer starts (either block 588 or 596, FIG. 15) and upon ending will execute block 5915 (FIG. 18) to turn off the data indicator. While in the receive mode, when a new byte has been received, the USART port triggers interrupt 5916 which sets flags for indicators if the byte was an F1, F8, or FE message, block 5810 (FIG. 17), will update these new settings. Control then branches to either Decode mode (block 5918) or Hex mode (block 5920) processing which decodes, stores, or deletes data according to program mode configurations set previously. After execution of any of blocks 5912, 5914, 5915, 5918, or 5920, program control flows to block 5922 to exit the Service Routine and resumes the higher level code from the point at which the higher level code stopped to service the interrupt. An interrupt request can suspend normal software execution so the interrupt may be serviced using one or more interrupt routines, and then normal execution resumes where it left off.

Figure 19A:
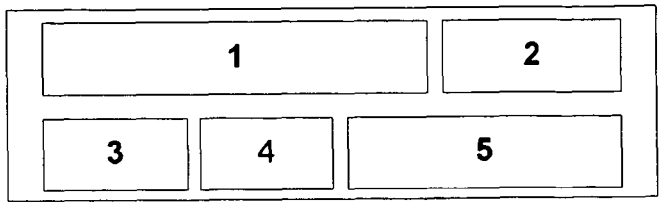
FIGS. 19*a* through 19*e* are illustrations of a display panel showing how different sections are used in different display modes for an MA1 or MTC module.

LCD (Liquid Crystal Display) display 401 shows the data in different formats according to a selected receive/display mode. FIG. 19*a* shows the LCD display broken down into sections for the decode mode:

Section 1. MIDI Function

Section 2. Channel number

Section 3. First data byte in decoded decimal format

Section 4. Second data byte in decoded decimal format

Section 5. Module Status *(see "Module Status" below)

System Exclusive Messages (F0) are displayed differently. Section 1 of FIG. 19*a* displays the total number of bytes in a system exclusive message. Section 2 of FIG. 19*a* displays the byte number directly above that byte. The bottom row sections 3, 4, and 5 show data bytes within the system exclusive message.

Figure 19B:
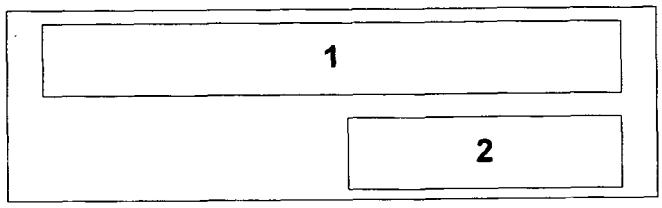

FIG. 19*b* shows the LCD display area broken down into sections for the hex receive mode, as indicated below:

Section 1. Incoming hex data, newest byte far right

Section 2. Module Status (see "Module Status" below)

Figure 19C:
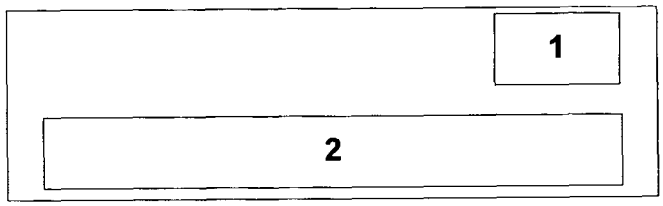

FIG. 19*c* shows the LCD display area broken down into sections for the hex hold mode:

Section 1. Byte number of the byte directly below

Section 2. Scrollable hex data

Figure 19D:
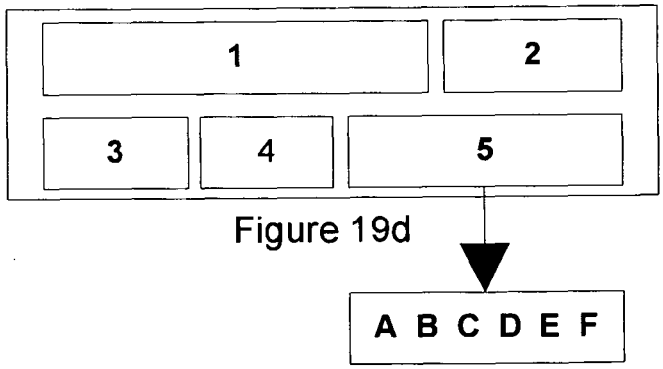

Module Status is a six character area of the display dedicated to showing the status of the module since powering or the last reset. In FIG. 19*d*, section 5 is broken down into six positions to display Module Status: A, B, C, D, E, and F.

Position A may either be:

'f' which represents a framing error or a

't' which represents a time out error.

Position B may either be:

'?' unknown message has been received or an

'o' overrun error has occurred.

Position C with value 'F' represents if any filter is on or active.

Position D with value 'M' indicates 'Midi Time Code' being received.

Position E with value 'C' indicates 'Timing clock' is being received.

Position F with value 'A' indicates 'Active Sensing' is being received.

As the above status changes and messages are received, flags are set and/or cleared, and the liquid crystal display is updated about every second.

MTC Module

An MTC module is a Midi Time Code Reader that displays Midi Time Code information. An MTC module is physically the same hardware as the MA1 module. However, MTC module software and hence operation are different from an MA1 module, as explained below.

MTC Operation and Software Flow

Figure 19E:
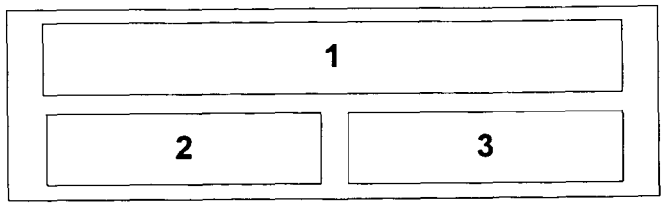
Figure 20:
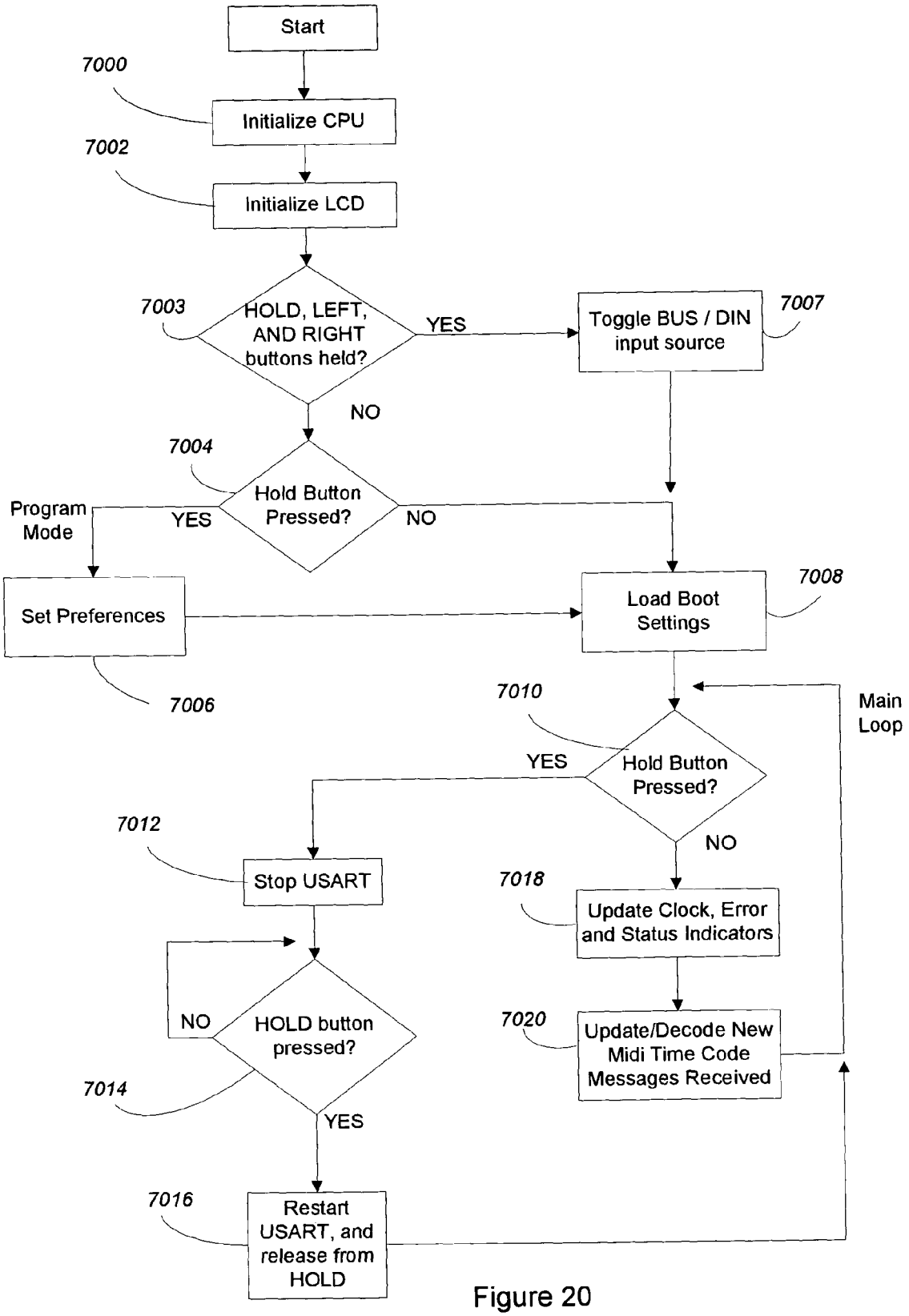
FIG. 20 is a flowchart of operational software for an MTC module.

FIG. 20 is a software flow chart of operational software for an MTC module. After power is applied or the module is reset, block 7000 initializes the CPU, and block 7002 initializes the LCD (Liquid Crystal Display) (401, FIG. 12*a*). If all three buttons, HOLD, LEFT and RIGHT (411, 409, 410, respectively, FIG. 12*a*) are pressed and held down at power up or after a reset, program control will branch from decision block 7003 to block 7007 which toggles the signal input source from the ribbon cable/bus to MIDI/din connector source, or vice versa. Control then passes to block 7008 where processing continues as described later herein. If HOLD, LEFT, and RIGHT buttons are not being held down when program control passes to block 7003, then program control passes to block 7004 which determines whether only the program (HOLD) button is pressed. FIG. 19*e* shows an LCD display broken down into sections for the decode mode:

Section 1. Midi Time Code decoded information, displayed as time information, for example: 10:23:14:07—where 10 represents the hours, 23 the minutes, 14 the seconds, and 07 the frames. (In video terms it usually takes 24 to 30 frames to make up one second of video, and the time code generating device will define this rate and will advance the 'seconds' when the frame count has reached its maximum of 24 to 30 frames depending on the format is being used in a particular embodiment or application. The MTC module will simply decode and display the data as it is received.)

Section 2. Midi Time Code statistics: Drop frame or non drop frame, and user bit information.

Section 3. Module Status (see 'Module Status' in the MA1 module description)

MLC and MLC-S Module

An MLC module is a dual MIDI-to-Line-Level and Line-Level-to-MIDI converter. The optional MLC-S module adds input source select switch control, data indicators, and an additional input and output. Each side ('A' and 'B') of an MLC module is capable of converting the electronic signal format of a MIDI data stream from an unbalanced current driven protocol, as in a standard MIDI cable connection, to a format suitable for longer distance transmission, such as a balanced voltage driven protocol, and is also capable of receiving a MIDI data stream in a format suitable for longer distance transmission, and converting the signal format back to a conventional MIDI signal format for transmission over conventional MIDI cables. Typically, one side (e.g., the 'A' side) of the dual converter module will be used to receive a MIDI data stream in conventional MIDI signal format and convert and transmit the data stream in a signal format suitable for longer distance transmission, while the other side (e.g., side 'B') is typically used to receive a MIDI data stream in a signal format suitable for longer distance transmission and convert the MIDI data stream to a conventional MIDI signal format for shorter distance transmission via conventional MIDI signal cables to equipment configured to receive conventional MIDI signals. Signal conversion capabilities of a rack-mountable MLC module support convenient integration of specific short and long distance transmission paths using MIDI specific message data formats modulated into different signal formats for transmission over different media (i.e., different physical layers). An unbalanced current driven protocol, as used in standard MIDI interfaces over standard MIDI cables, is reliable for distances of up to only about 50 feet or so. A balanced voltage driven signal modulation can transmit the information content of a MIDI data stream reliably for distances of up to 4000 feet or more on twisted wire pairs, such as in CAT5e cables as used in Ethernet networks, and can be looped or daisy chained up to 32 times. Other modulation techniques with suitable drivers and media may also be used for a long distance transmission format, including, for example, fiber optic media and various wireless media, including infrared links and/or wireless radio links and networks supporting ranges of up to a mile or so, but longer ranges are also possible and may be used in some embodiments and applications. An ability to convert the information content of a MIDI data stream from one transmission format to another is particularly useful in configurations, such as yard and park displays and the like, where it is desirable to use standard MIDI data protocol between MIDI components as used in a central location for development, control, monitoring, and troubleshooting of a MIDI coordinated display or show, but where some components to be controlled and monitored may be located at distances significantly greater than can be reliably supported by conventional MIDI signal transmission protocols and cables.

Figure 21:
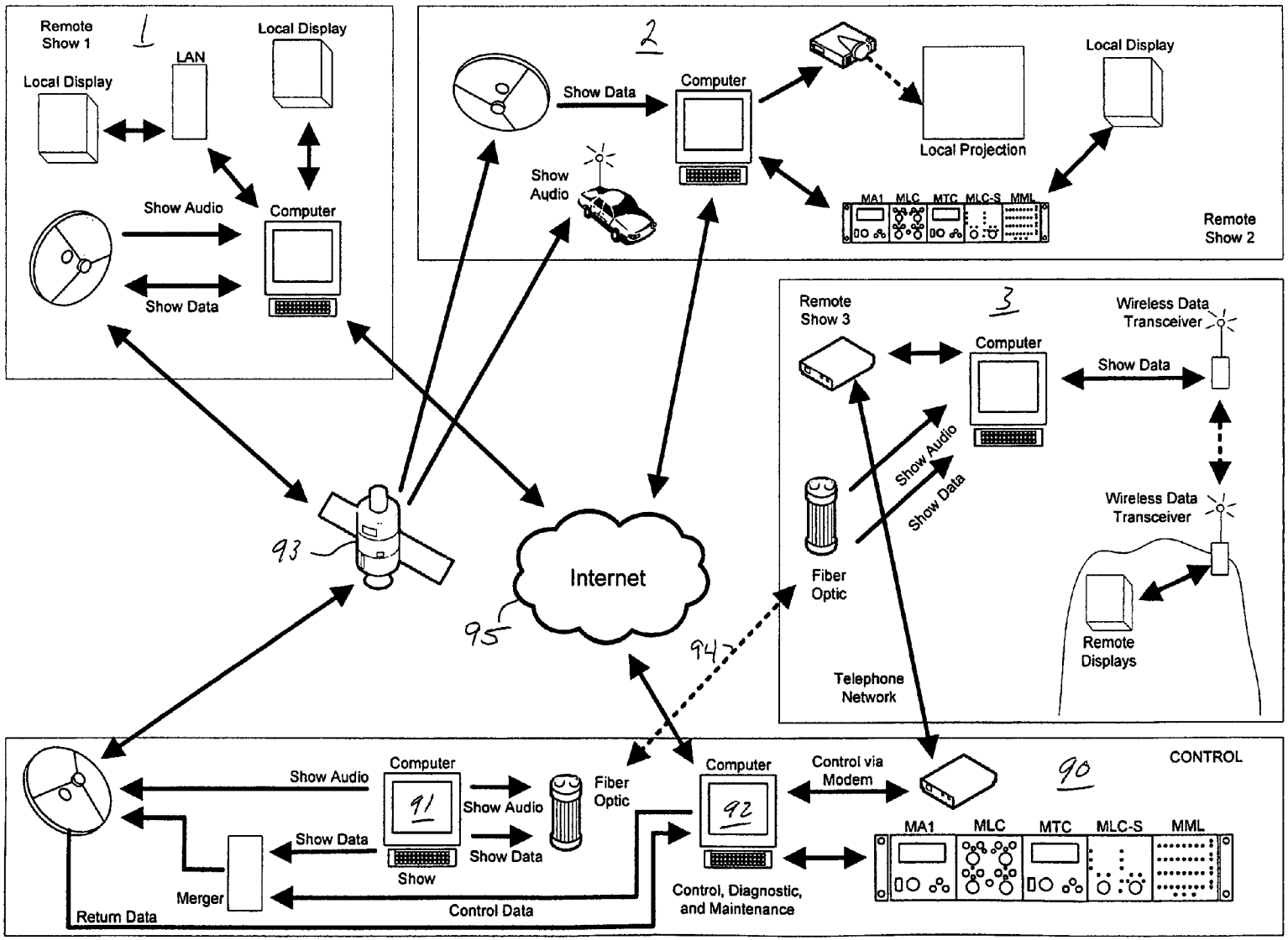
FIG. 21 illustrates how elements of the instant invention may be used to control, monitor, or troubleshoot animated displays or entertainment shows from a remote location.

As illustrated in FIG. 21, which shows a central control facility 90 that may have a show computer 91 and a control and diagnostic computer 92 connected by satellite 93, fiber optic cable 94, internet 95, or other communications media to remotely controlled or monitored shows 1, 2, 3. The computers 91 and 92 may also be conventionally connected to the Internet to connect show and monitoring data appropriately to remote shows 1, 2 and 3. These shows may occur simultaneously or separately. As such, and with appropriate signal conversions, some embodiments may use telecommunications links and/or the Internet to provide a signal path for MIDI messages between segments or components of a distributed display system to permit, for example, one or more computers in a park display in a remote location to be controlled, or accessed for troubleshooting, over the Internet from a central location that may be used, for example, to access multiple independent or coordinated animated displays, including, for example, multiple bicentennial celebration displays across multiple locations in a city. For some applications, especially distributed applications as noted above, MML, MA1, and MTC modules may be programmed in a central location and then transported and installed in remote locations for greater efficiency and quality control in using modules of the instant invention to support installation, checkout, and troubleshooting of such distributed displays. Different means may be used for transmitting such signals as show data, control data, and audio, either merged, independently, and possibly over several different types of media for one or more destinations simultaneously, or even multiple transmissions with multiple destinations. Each destination may or may not return data, or may return on a different transmission path.

Figure 22:
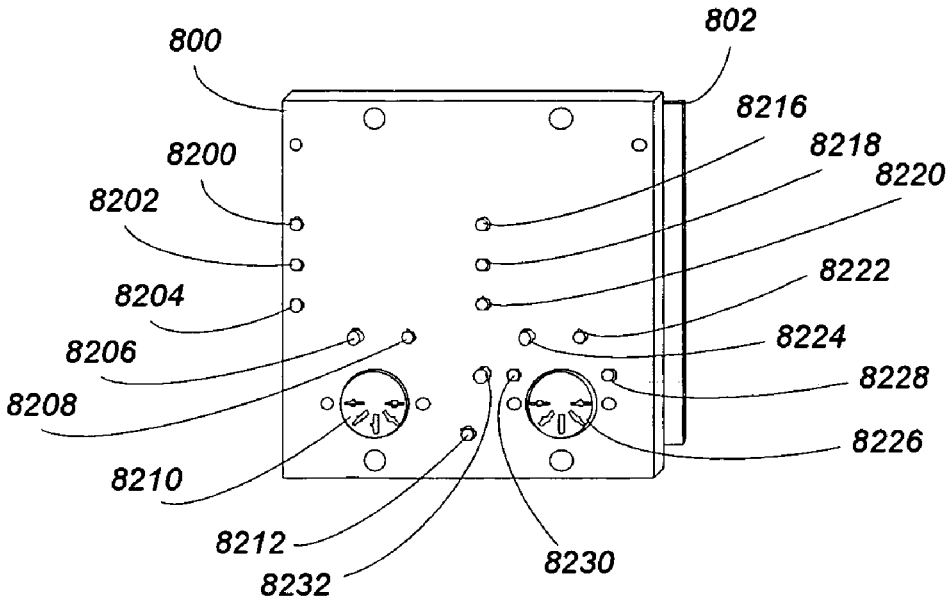
FIG. 22 is an illustration of an MLC-S module annotated with reference numbers.
Figure 23:
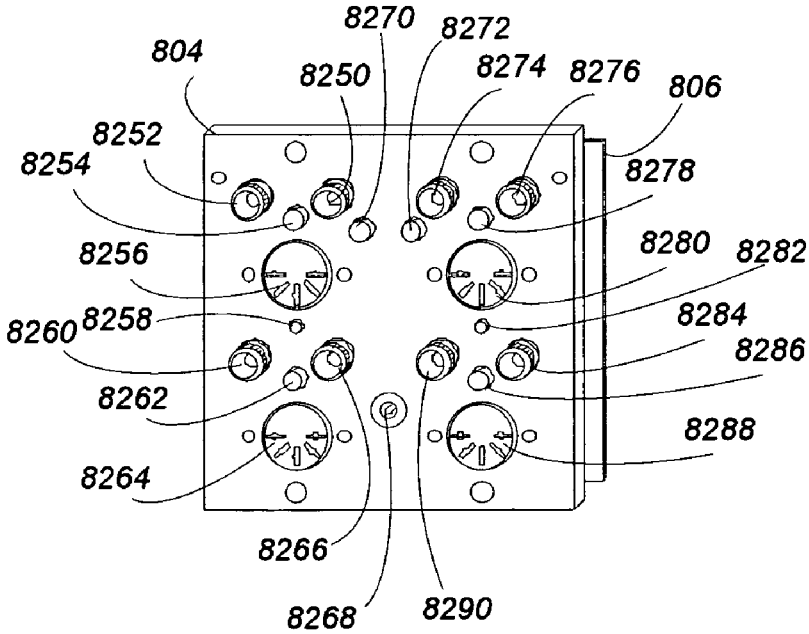
FIG. 23 is an illustration of an MLC module annotated with reference numbers.

FIGS. 22 and 23 show the front panel of an MLC-S and an MLC module, respectively. As noted, an MLC module may be used alone to provide two independent converters in one combined module with each converter providing conversions of MIDI data streams from conventional MIDI signal format to a format for longer distance transmission, and vice versa (i.e., also provides conversions of input signals received at selected input terminals in a long distance format back to conventional MIDI signals for transmission over conventional MIDI signal cables to equipment designed to interface with conventional MIDI signal formats and levels). However, a standalone MLC module does not have full source selection switching capability. However, when an MLC module is coupled together with a MLC-S module, the combination will provide a user with dual 3-way input source select options for use with signal conversion capabilities provided by the coupled MLC module. MLC-S front unit 800, FIG. 22, coupled to printed circuit board 802, includes switch control buttons and LED indicators showing which source is selected for output. When an MLC-S and MLC module are used together, MLC front panel 804 (FIG. 23), coupled to printed circuit board 806, are usually mounted to the rear of a chassis, mating with an MLC-S front unit 800, mounted on the front of a chassis, to create a combined converter module with multiple input switching options. An "A or B" switch (8232, FIG. 22) on the face of an MLC-S module allows a user to switch the MIDI signal source connected to a "midi-OUT" port connector (8226, FIG. 22) on the front of an MLC-S module from the A side or the B side of an MLC-S. MLC-S and MLC modules may be 'coupled' via 14 pin male/female headers.

An MLC-S module also has an A side and a B side. The A side of an MLC-S module has one input selection switch. If pressed or tapped for less than 3 seconds the next input source LED will blink representing the possible next input source that may be selected if the input select switch is pressed and held for 3 seconds or more to execute an input source change request wherein the input source will be switched to that represented by the blinking LED, the LED will turn on steady, and the selected input will be stored. If the button is tapped a 2nd time then the next input select source LED will blink, and a change to that source may be executed as before by holding the select switch down for more than 3 seconds. If the select switch button is not pressed or held for 3 seconds or more, then after 10 seconds the CPU will time out and abort the operation without making any changes to another input source.

The functions are the same on the B side of an MLC-S module except that the B side has an added auxiliary switch and two LEDs. The auxiliary switch allows the output source to be toggled between A or B and the respective LED will illuminate showing which side is selected for output.

Referring to FIG. 22, which shows the front face of an MLC-S module, LED indicators 8200, 8202, and 8204 show which input is selected via switch 8206 for output on the 'A' side, (e.g., FRONT midi input, REAR midi input, or BUS input,—from a MIDI input on the front of the MLC-s or a MIDI input on an MLC module coupled to the MLC-S module, but mounted on the rear side of a chassis, or from a ribbon cable/bus data connecting another module to the combination of the MLC-S and MLC module). An MLC has two outputs per side, any source selected on its respective side, whether an MLC-S is attached or not, will be sent out of both MIDI and Line outputs, only on its respective side. Selector switch 8206 will change inputs as described above. LED data indicator 8208 will illuminate when data is being received from the selected input. Front MIDI input connector 8210 is selectable from either the A or B side. Module global power indicating LED 8212 illuminates when power is applied to the module. LED indicators 8216, 8218, and 8220 show which input is selected for output on the 'B' side. Selector switch 8224 allows selection of inputs as described earlier. LED data indicator 8222 will illuminate when data is being received from the selected input on the 'B' side. The data out source (A or B side) for MIDI output connector 8226 is selected via switch 8232. 'A' side LED indicator 8230 and 'B' side LED indicator 8228 show which of the two outputs are selected.

In FIG. 23, connectors 8250 and 8252 provide Line Level input for the A side and connector 8256 is the MIDI input for the A side. Switch 8270 switches between the two inputs. Switch 8254 is a termination switch for the Line Level input, and usually is terminated (selected) on the beginning and ending of a cable connection. Data indicator LED 8258 illuminates when data is received on the selected input. Connectors 8260 and 8266 provide the Line Level output with termination switch 8262. Other features include MIDI output connector 8264 and power input connector 8268.

B side inputs and outputs are of the same types as described for the A side inputs and outputs. Connectors 8274 and 8276 provide the B side Line Level input and connector 8280 is the B side MIDI input. Switch 8272 switches between the two inputs. Switch 8278 is a termination switch for the Line Level input. Data indicator LED 8282 illuminates when data is received on the selected input. Connectors 8290 and 8284 provide the Line Level output together with termination switch 8286. MIDI output is provided through connector 8288.

Figure 24B:
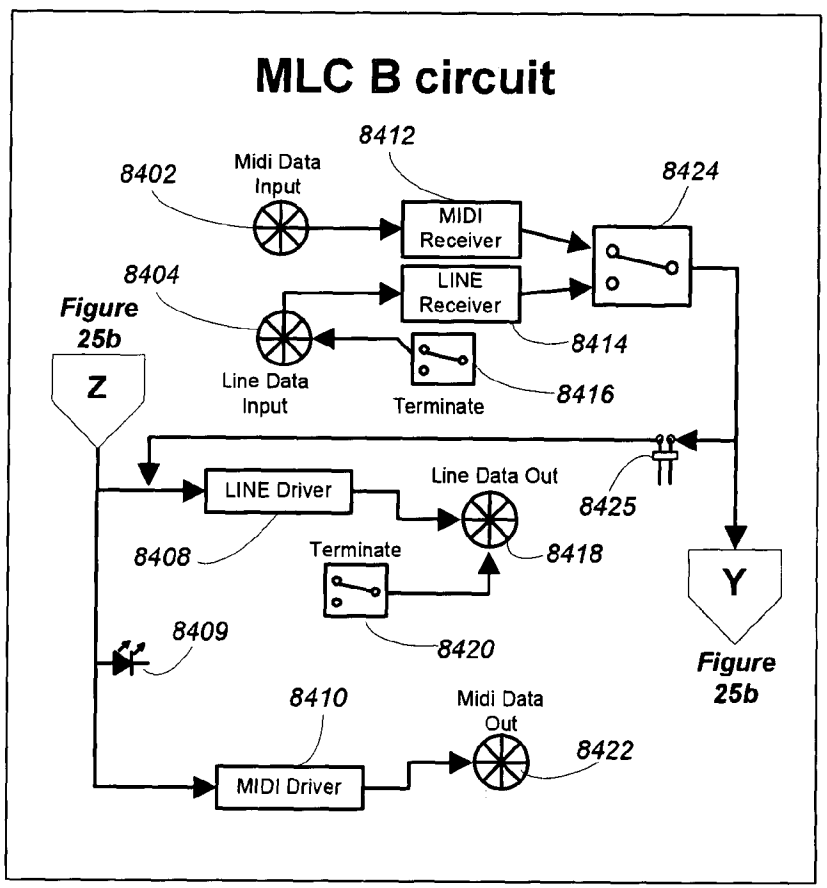
FIGS. 24*a* and 24*b* are electronic block diagrams for electronics in the A side and B side, respectively, of an MLC module.
Figure 24A:
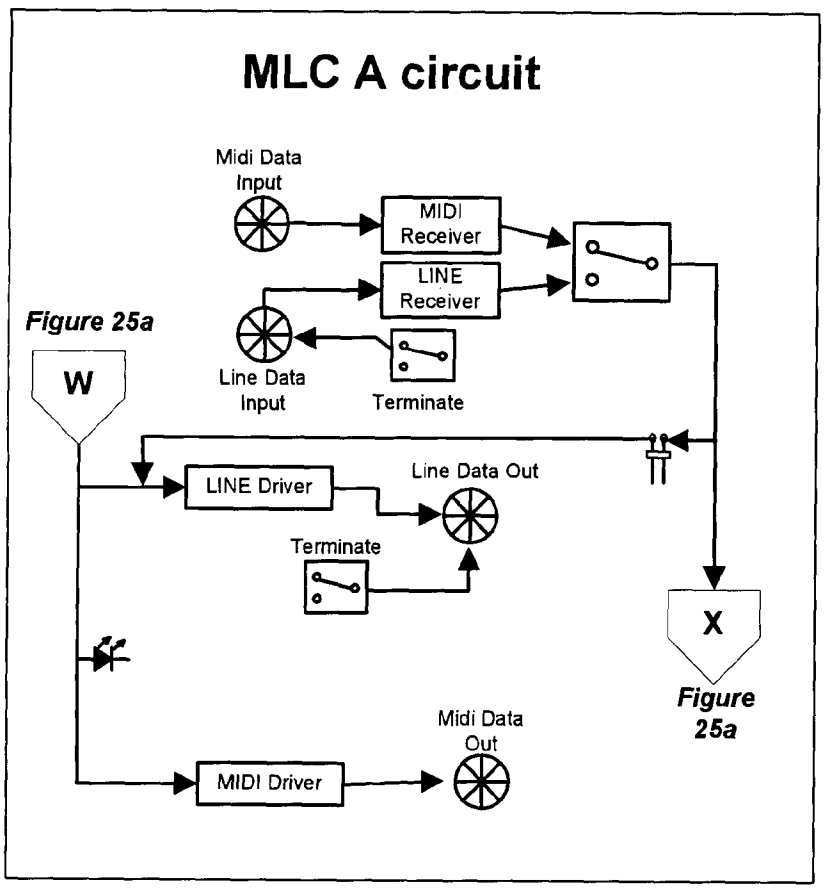

FIG. 24*a* shows the A side electronic circuit block diagram for an MLC module. The A side electronic circuit block diagram is the same as the B side electronic circuit block diagram which is shown in FIG. 24*b* and described below.

Referring to FIG. 24*b*, connector 8402 is a MIDI input connector (e.g., matching connector 8280, FIG. 23) and connector 8404 is a Line Level input connector (e.g., matching connectors 8274, 8276, FIG. 23). MIDI receiver/buffer/isolate circuit 8412 and Line Level receiver/buffer circuit 8414 source a user selectable switch 8424 (e.g., matching switch 8272, FIG. 23) which allows a user to choose between one of the two inputs. Switch 8416 (e.g., matching switch 8278, FIG. 23) is a termination option for Line level input connector 8404. The selected input data sources Line Data output 8418 (e.g., to connectors 8290, 8284, FIG. 23) and MIDI data output 8422 (e.g., to connector 8288, FIG. 23) via buffer/drivers 8408 and 8410. Switch 8420 (e.g., matching switch 8286, FIG. 23) is a termination switch for Line Level output connector 8418. If this circuit is used without the MLC-S module then header 8425, if shunted, will source the two outputs 8418, 8422 and LED 8409. LED 8409 is an input data indicator (e.g., indicator 8282, FIG. 23).

Figures 25A, 25B:
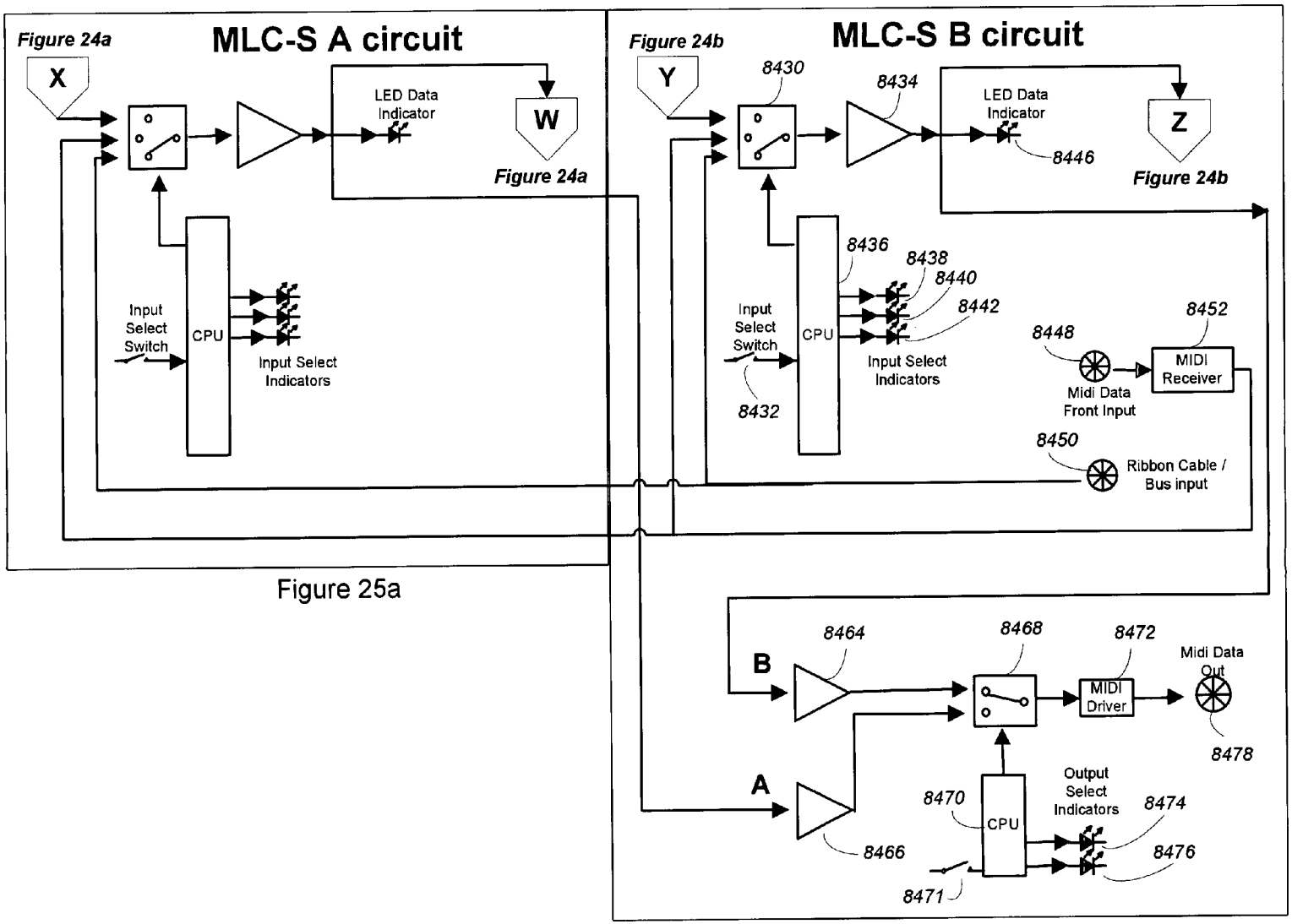
FIGS. 25*a* and 25*b* are electronic block diagrams for electronics in the A side and B side, respectively, of an MLC-S module.

FIG. 25*a* shows the A side circuit block diagram of an MLC-S module and FIG. 25*b* shows the B side electronic block diagram. The A side circuit is the same as the B side except for an added circuit (items 8464 thru 8478) in the B side.

FIGS. 25*a* and 25*b* illustrate circuits in an optional MLC-S module that may be used with an MLC module. When used together, MLC and MLC-S modules are typically mated back to back, connected via a 14 pin male and female connectors—providing connections matching W, X, Y, Z on FIGS. 24*a,b* and 25*a,b*, with the MLC-S module on the front of a chassis or equipment rack, and allow a user to select a source to output using controls on the front panel of the MLC-S module. Referring to FIG. 25*b*, CPU controlled switch 8430 is activated by a user pressing input select switch 8432 (e.g., switch 8224, FIG. 22). CPU 8436 receives the user input, sends the selection information to switch 8430, and illuminates an LED (either 8438, 8440, or 8442) (e.g., matching LED indicators 8216, 8218, 8220, FIG. 22) corresponding to the selection. The selected data source is buffered by 8434 and sources data indicator LED 8446 (e.g., matching LED 8222, FIG. 22), outputs on a connected MLC module as described earlier, and sources, via buffer 8464, switch 8468 (e.g., matching switch 8232, FIG. 22), which selects an input source for MIDI output connector 8478 (e.g., matching midi OUT connector 8226, FIG. 22). MIDI input connector 8448 (e.g., matching connector 8210, FIG. 22) and receiver/buffer/isolate circuit 8452 source both the A and B side input select switches (e.g., matching switch 8430 for B side in FIG. 25*b*, also matching A side switch 8206 and B side switch 8224, FIG. 22). Ribbon cable/bus input 8450 provides another optional input for data sourced from another module in the chassis. Components 8464 thru 8478 comprise a MIDI output source select circuit as shown in the lower part of FIG. 25*b*, which is part of the 'B' side circuitry of an MLC-S module. The output source select circuit includes a B side selected data source buffer 8464 that sources switch 8468 controlled by CPU 8470, which is the same CPU as item 8436, just repeated in the diagram for clarity of illustration. An A side selected data source buffer 8466 also sources switch 8468. The CPU responds to a user press on button 8471 (e.g., matching switch 8232, FIG. 22), toggles electronic switch 8468, and illuminates one of two LED's, 8474 and 8476 (e.g., matching LED indicators 8230 and 8228, FIG. 22), to indicate the selected source. The selected data source is then buffered 8472 and output via connector 8478.

In summary, A and B side CPUs are programmed as 3 way toggle switches with LED indicators showing which input source is selected. The B side CPU has an additional function, namely an auxiliary toggle switch with LED indicators that switches either A or B to a MIDI out connector.

Figure 26:
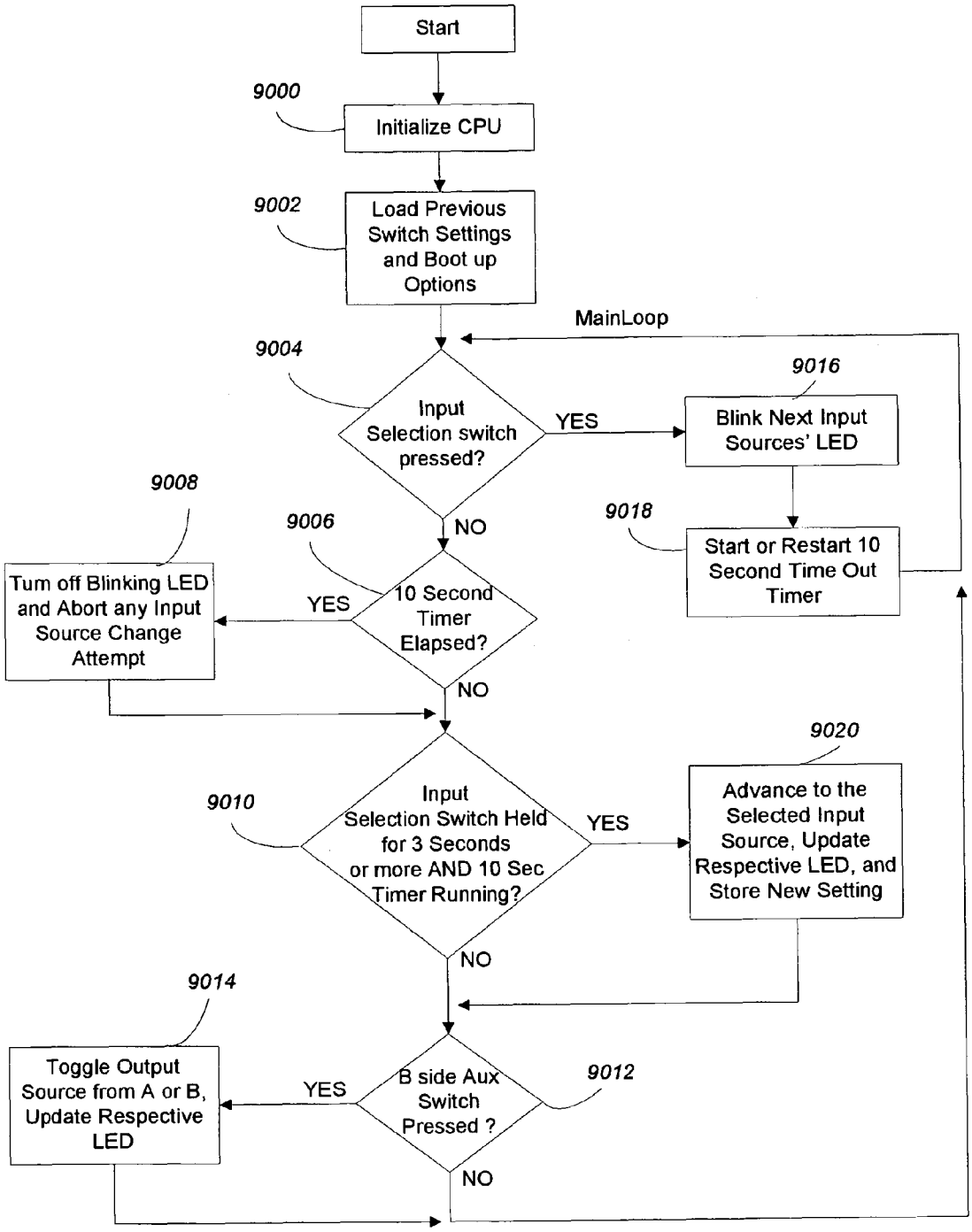
FIG. 26 is a flowchart for software for an MLC-S module.

FIG. 26 is a flowchart that describes the software flow for the CPUs of an MLC-S module. Block 9000 initializes the CPU it is executing on at power on or reset. Block 9002 recalls previous switch settings and boot options. The remaining code comprises a main loop for operation of an MLC-S module. Block 9004 checks if the input selection switch (e.g., switch 8224, FIG. 22) is pressed for less than 3 seconds and if so passes program control to block 9016 which increments a selection pointer and then illuminates, in blinking mode, an LED (e.g., LED 8216, 8218, or 8220, FIG. 22) representing the next input that is selected if the input selection is switched from its current configuration. Control then passes to block 9018 which starts a timer (e.g., a 10 second timer in this example), or resets the example 10 second timer for another 10 seconds if the timer is already running, and control then returns to the 'main loop.' If the input selection switch is not pressed when control passes through block 9004, control passes to block 9006 which determines if the 10 second timer has elapsed. If so, then control passes to block 9008 where the requested input source change is aborted and flags or other indicators are restored to their respective states prior to the input selection switch being pressed, after which control is passed to block 9010, where, under these conditions (i.e., 10 second timer has elapsed and is not running) control passes through to block 9012 where a check is made to determine it the B side MIDI data out select source switch (switch 8471, FIG. 25*b*) is pressed. If so, block 9014 will toggle the output source from A or B and illuminate the corresponding indicator LED (e.g., LED 8230 or 8228, FIG. 22) before returning control to block 9004. If at block 9006 the 10 second timer has not elapsed then program control passes directly to block 9010 where, if the input selection switch has been held for more that 3 seconds and the 10 second timer is still running, program control is passed to block 9020, which causes the actual switching to the selected next input source, updates indicator LEDs, and stores the new settings before passing control back to the main loop.

If the auxiliary switch (also referred to above as a source select switch) is pressed, block 9014 is executed and will toggle the output source from A to B or B to A and update the LED indicator accordingly before returning control to block 9004. Otherwise, control passes directly from block 9012 to block 9004.

LMD2 Dimmer Pack

An LMD2 dimming unit, also referred to herein as a dimmer pack, operates switches, dimmer circuits, and other outputs responsive to MIDI messages received via an input MIDI data stream, which typically has been converted to a format suitable for long distance transmission, as described earlier herein. In contrast to prior art dimmer packs, the AC receptacles of Applicant's dimmer packs are independently programmable with respect to note and channel assignments. In other words, any channel and note value may be applied to any electrical receptacle or output, lending greater flexibility to the system. LMD2 electronics are typically installed in a weatherproof enclosure suitable for outdoor use, but may also be installed in a different enclosure, if desired, for indoor use. An LMD2 dimmer pack has innovative software routines, electronic circuits, and features that are particularly useful in implementing, controlling, and monitoring large outdoor displays, such as: individual programmable outputs, security mode, real time clock, diagnostic data acquisition (such as AC amperage, AC voltage, AC frequency, DC voltage, +5 volt, and temperature readings), programmable preset peak values to be compared and calculated with newly acquired diagnostic data to set violation flags to alert users of potential problems and/or warnings, and storage of such values along with a time stamp via the internal time clock. An additional feature, auto diagnostics, allows a CPU, which may be a programmable integrated circuit, such as a Microchip™ 16F877A, in an LMD2 dimmer pack to automatically acquire selected (any or all) diagnostic data based on a preset time cycle while in a full operational mode or while in the security mode. Another feature is an auto dimming feature. Typically, to dim an output, a MIDI message is received for each step of the dimming process. However, as an added novel feature, one custom message of six will automatically step the duty or brightness: up slow, up medium, up fast, or down slow, down medium, or down fast. If desired, any of the six commands can be stopped with a seventh custom message and will hold the current value.

A custom control room software program, described below (FIG. 32), has many features including a polling feature that could alert an operator or technician if an LMD2 or other connected device was unplugged, or not communicating. This control room software program has a software switch that enables or disables a security mode wherein attempted theft or tampering may be detected. The security mode has full functionality as mentioned above with the exception that the dimming function is disabled. Security mode is indicated via status LED 9597 (FIG. 27) blinking steadily. In the security mode a red LED, on the LMD2, blinks to let a field technician know the unit is in a security mode.

Other features of an LMD2 dimmer pack include optional circuit board changes to allow a contact closure AC power supplied output (e.g., via electromagnetic relay) instead of a triac driven output, a dry contact switch output for user interfaceable outputs, +5 volt switch outputs (either on or off), or a +5 volt duty cycle output. These alternate outputs, for example, may allow an LMD2 dimmer pack to switch an external source on and off such as power for fluorescent lights or another device that requires a different power supply from what the LMD2 could supply. Other alternate outputs may also be used in some embodiments. Another option port is available for: a verification or redistribution module, standard MIDI input and output connectors, LED indicators showing the statistics for the 8 outputs (e.g., an 8 LED buffered board could be installed to display, via LED brightness levels, the output levels from the LMD2 of the 8 LMD2 outputs). Other future modules may also use the optional port. Another feature is a jitter or rapid blink feature that automatically turns on and off a selected output with a preset time interval adjusting rate and will end with that position fully on.

Figure 27:
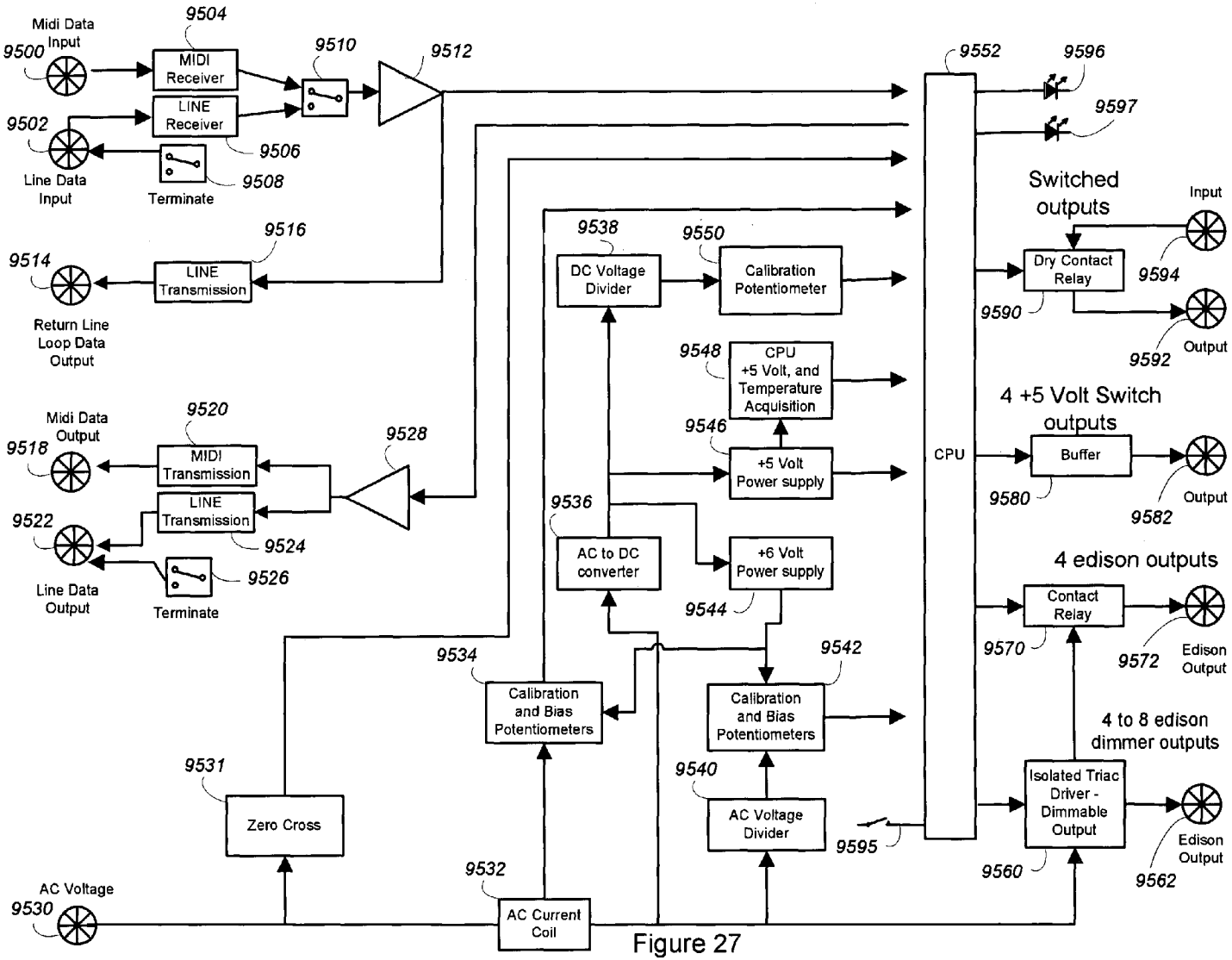
FIG. 27 is an electronic block diagram for LMD2 dimmer unit electronics.

FIG. 27 is an electronic block diagram for LMD2 dimmer unit electronics. MIDI data input connector 9500, line data input 9502, MIDI receiver 9504, line receiver 9506, termination switch 9508 (for the line level input), source selection switch 9510, input buffer 9512, zero crossing detector 9531, portions of CPU 9552, portions of isolated triac driver dimmable output device 9560, and Edison output 9562 may be part of existing MIDI dimming units. New circuitry and software are added in the instant invention to increase functionality including: auto dimming, auto jittering, long distance data reception, internal diagnostic hardware and software including automatic diagnostic acquisition routines and calculations, data transmission of requested information, and with one of several optional modules—original received data can be retransmitted for verification purposes or the original received data can be retransmitted to other LMD2 units, thus extending the distance over which MIDI data streams may be transmitted to support coordination and control of large displays and other features of entertainment shows in recreational parks and the like. Diagnostic data is acquired by hardware and software and each reading has a specific circuit to convert the reading to a CPU range. Diagnostics acquisitions include: AC amperage, AC voltage, AC frequency, DC voltage, +5 volt reading, and internal temperature, and with internal calculations an LMD2 dimmer can store, compare, store peak values, and set preset violation value flags to alert users of potential problems, warnings, over and under expectant range values, or check for blown lamps or other external attachment conditions.

Referring to FIG. 27, AC Amperage is measured by running input power wire 9530 through an AC current coil 9532. Voltage from coil 9532 is biased and calibrated to a 0 to +5 volt range using calibration and bias circuit 9534. CPU 9552 converts the voltage to a digital representation to be stored, compared, or transmitted, or to make any necessary calculation or take other desired action. AC voltage is acquired by reducing and dividing the voltage in AC voltage divider 9540, then applying bias and calibrating to a 0 to +5 volt range using calibration and bias circuit 9542. Bias voltage is supplied by a +6 volt supply circuit 9544 and gives the bias circuit a better range for more accurate CPU A to D conversion. AC frequency measurement uses an input from zero crossing circuit 9531 and measures time interval from one AC zero crossing to the next zero crossing. Output from AC to DC converter circuit 9536 is divided at divider 9538 and calibrated at circuit 9550 to a 0 to +5 volt range for the CPU. DC power from circuit 9536 is also used for the +5 and +6 volt supply power supply circuits (9546, 9544, respectively). The +5 volt power supply circuit is fed to a separate +5 volt A to D converter CPU 9548 to acquire a wide range of power supply power readings even with a CPU input power variable range, as it is reading the same voltage as its supply voltage. CPU 9548 also calculates temperature values via an on board temperature sensor. Main CPU 9552 reads data from +5 volt and temperature acquisition CPU 9548 and stores, compares, transmits or makes any necessary calculation or takes any other desired action.

LMD2 outputs can be 4 or 8 dimmer outputs (9560 and 9562) or 4 of the outputs could be contact relay outputs 9570 and 9572 to supply power to external equipment that cannot be supplied by a triac circuit. Other output options include +5 volt on/off or +5 volt pulse width signal for variable duty cycle outputs via 9580 and 9582 outputs, or dry contact closure 9590 and 9594 to supply an external switch for externally supplied power or user desired options. Data indicator 9596 is used to display the programming mode, lamp test mode and if data is being received. Status indicator LED 9597 is used for confirmation that a new message has been written to permanent memory while in the program mode, if a USART receive error (framing or overrun) has occurred indicated by a steady 'on', indicates the security mode by a steady blink, and indicates that auto diagnostics are on and how many diagnostics are being performed by rapid blinks of about 1 per second.

When data is requested from an LMD2 dimmer pack by use of MIDI command F0 XX F7 (System Exclusive message), the data is buffered 9528 and transmitted by either a MIDI output circuit option 9520 and 9518 or a line output circuit 9524 and line output connectors 9522, where the line output can be terminated by the termination switch 9526. An LMD2 dimmer pack can be set up with an option of re-transmitting incoming data, for verification purposes, via circuit 9516 and output connectors 9514.

Figure 28:
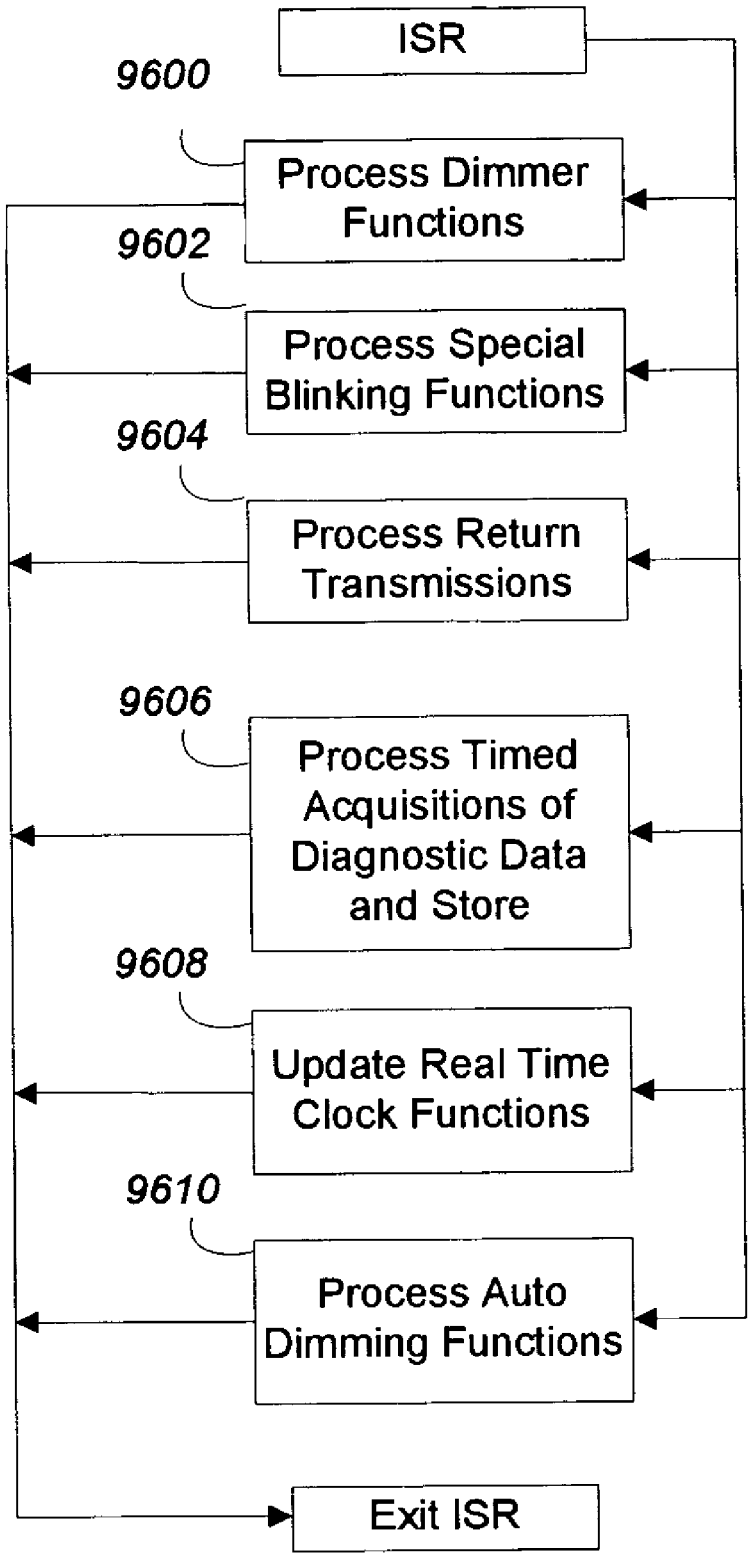
FIG. 28 is a software flowchart for an interrupt service routine for an LMD2 dimmer pack.

FIG. 28 is a software flowchart for an Interrupt Service Routine for an LMD2 dimmer pack. Block 9600 is a common routine for a dimmer unit and handles the necessary steps to maintain or adjust the current duty cycle of a triac driven dimmer. Block 9602 is a jitter feature. A single message received will start the cycle of blinks and will slowly stop blinking (i.e., increase time on versus time off in each blink cycle) until the corresponding output circuit is fully on, simulating a vibration or reverberation. If a request was made to return any data, addressed to a specific LMD2 unit, block 9604 will continue transmitting the data until the message is complete. If the auto diagnostic mode has been initiated by the main loop, then block 9606 will continue acquiring selected diagnostic data, and upon completion, compare it with preset peak high and/or low values and store a new value with a time stamp of occurrence if a newly measured value exceeded a selected stored value. Block 9608 will update a real time clock function to maintain accurate time. Block 9610 processes an auto dimming function by stepping the duty cycle up or down at a slow, medium or fast pace until a parameter has reached its maximum limit value (if fading up) or its minimum limit value (if fading down).

Figure 29:
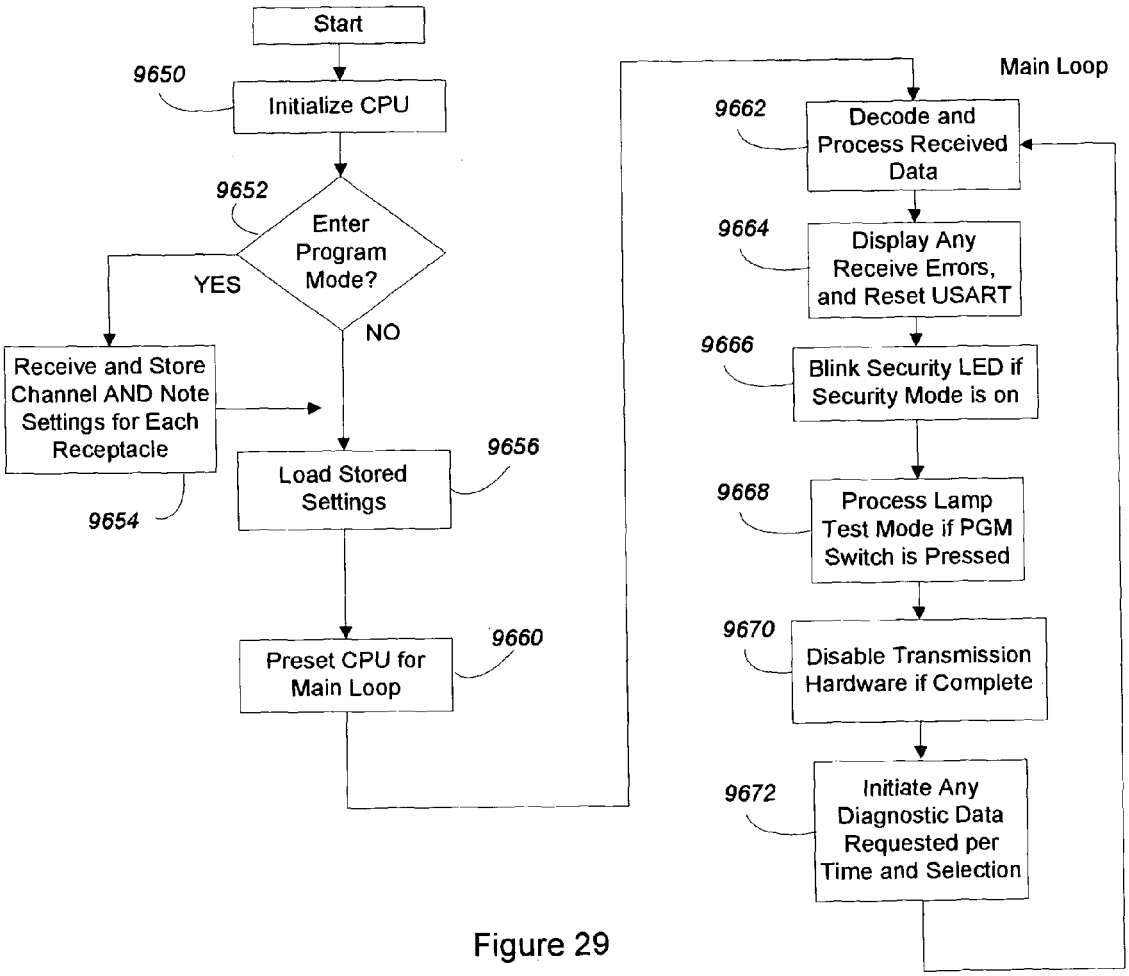
FIG. 29 is a general software flowchart for an LMD2 dimmer pack.

FIG. 29 is a flowchart describing a representative general software flow of an LMD2 dimmer pack. Block 9650 initializes the CPU upon power up or reset. Block 9652 redirects program control to a programming mode if program switch 9595 (FIG. 27) is pressed upon power up or a reset. Block 9654 provides a program mode that allows a user to program each of the outputs (eight in this example embodiment) to a specific MIDI channel and note value. Once these values are programmed, they are stored in permanent memory. Block 9656 then load newly stored or previously stored values, and block 9660 configures the CPU for entering a main loop which responds to messages and, along with the ISR, processes all routines necessary to respond to messages and functions. Block 9662 decodes and processes any pertinent messages received. An LMD2 dimmer unit allows individual output positions (e.g., power outlets or switches) to be programmed with any channel and note value. A 'note on' with channel and note value match for any of the eight outputs in this example embodiment will result in the duty cycle of that triac output being adjusted to match the velocity value of the matching message. A 'note off', channel and note value match for any of the eight outputs will result in the duty cycle of that triac output being adjusted to 0, and a 'channel volume' message with a channel value match for any of the eight outputs will result in the duty cycle of that triac output being adjusted to match the calculated result of the pertinent data byte value, via formula; current note velocity value—(127−new channel volume value)=Output velocity value. Any switch outputs may be adjusted to turn on with a velocity value greater than some selected value (e.g., 1) and turn off with a velocity value (e.g., 0) less than the selected value. Block 9664 will check for any receive errors and will turn on or blink the error LED if there has been an 'overrun' or 'framing error' detected on the CPU USART port, and will reset the USART port if any errors were detected. Block 9666 will blink the security LED with a constant rate indicating that the unit is in the security mode. The dimming functions are disabled when an LMD2 unit is in a security mode. Block 9668 will process a lamp test mode (if the program button is pressed while in a normal operating mode), and will cycle through 33%, 66% and 100% triac output duty cycle or brightness in a manner similar to that explained earlier for an MML module. Block 9670 insures that the transmission hardware is turned off after its respective transmission is completed to avoid interference with other parallel units' transmissions. If an auto diagnostic feature is activated, block 9672 will initiate the acquisition of a selected diagnostic reading, and will be continued and completed (if necessary) by the ISR. Status indicator 9597 will fast blink as a diagnostic reading is taking place. The CPU will repeat these steps and ISR's indefinitely. Interrupt routines are called as modes and flags are set and timers elapse, and some are called from normal software loops and others are run responsive to hardware status changes. As an example, if a diagnostic reading is requested in block 9662, block 9672 initiates the reading, acquires the data, turns on the Interrupt, and begins transmitting. Once the USART is ready for the next byte to be transmitted the USART triggers an interrupt, which will execute block 9604. This process repeats until all the data bytes have been transmitted, then the ISR sets a complete flag, and the transmission hardware is turned off at 'main loop' block 9670.

Figure 30A:
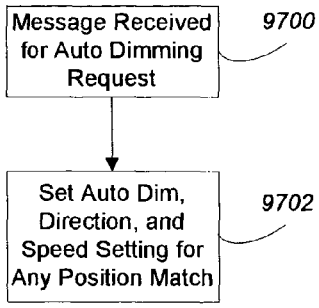
FIGS. 30*a* and 30*b* are flowcharts for software implementing an auto-dimming feature of an LMD2 dimmer pack.
Figure 30B:
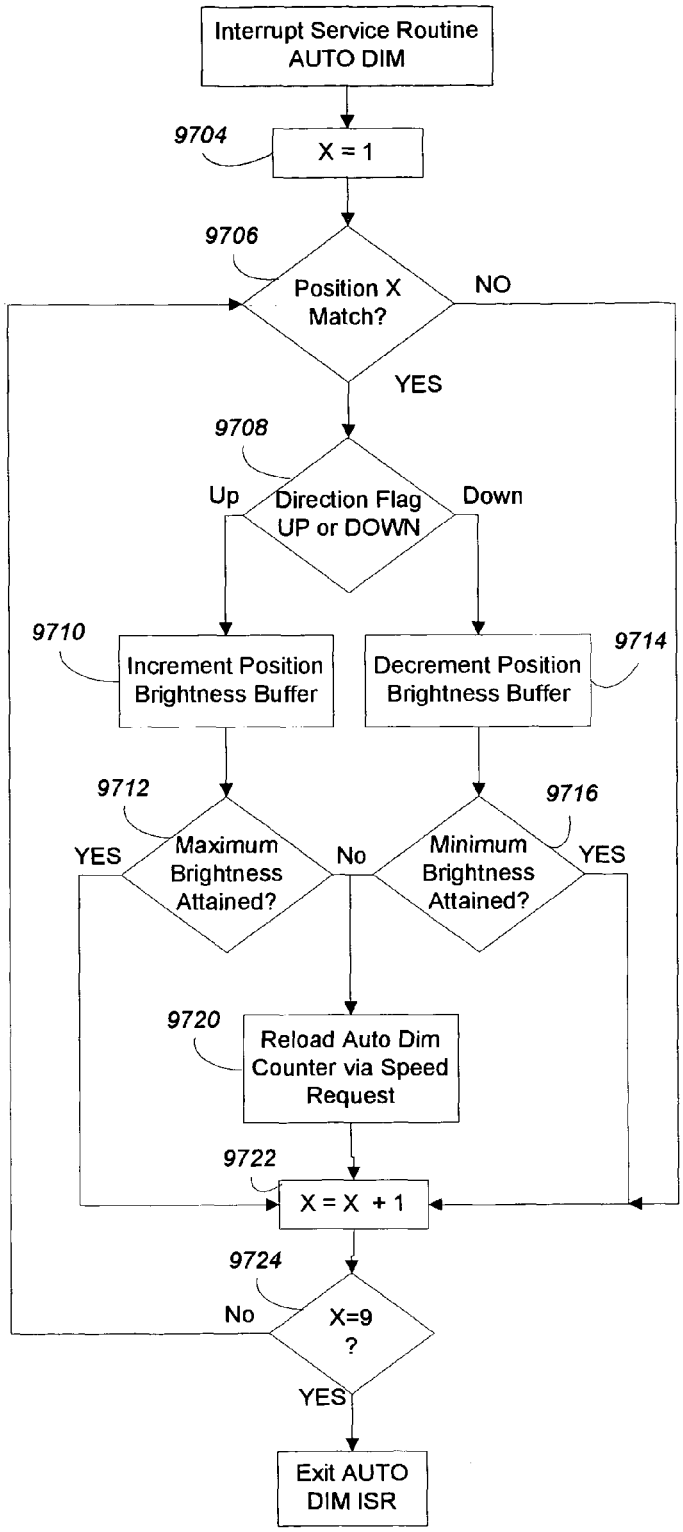

FIGS. 30*a* and 30*b* describe in detail the 'auto dimming' feature of an LMD2. If an 'auto dimming' message is received in the processing of incoming messages in block 9662 (FIG. 29), and the preprogrammed assignments match, then program control passes to block 9700 (FIG. 30*a*) and thence to block 9702 where flags are set for either dimming up or down and the speed or rate of change of dimming value, variably programmable as slow, medium, or fast. Once an 'auto-dimming' request is initiated an ISR routine continues the operation, starting with block 9704 which sets a counter to begin checking all eight output positions. Each 'auto-dimming' message received is addressed to a specific output by a specific match on channel and note value (not only a channel match) and each of the eight outputs in this example embodiment can be auto dimmed separately. If there is not a note and channel match for the currently enumerated output position in the scan, then control passes to block 9722 which increments the counter and block 9724 which determines if all output positions have been checked, and if not, returns control to block 9706 to check the next position. If there is a note and channel match then the up/down flag is checked at block 9708, responsive to the incoming message, for either increasing or decreasing the duty cycle. If the direction is up then the brightness step values are incremented in block 9710 and checked to determine if the maximum value has been reached at block 9712. If the direction is down then the brightness step values are decremented at block 9714, and checked to determine if the minimum value has been reached at block 9716. If the maximum and minimum values have been reached the auto dim feature is turned off for the respective position. If not the buffer is reloaded at block 9720 with a speed variable number, and the position counter is advanced at block 9722 to continue to the next position. If at block 9724 all eight positions have been checked, then the auto dim routine ends. Interrupts will continue until all eight positions are complete.

Figure 31:
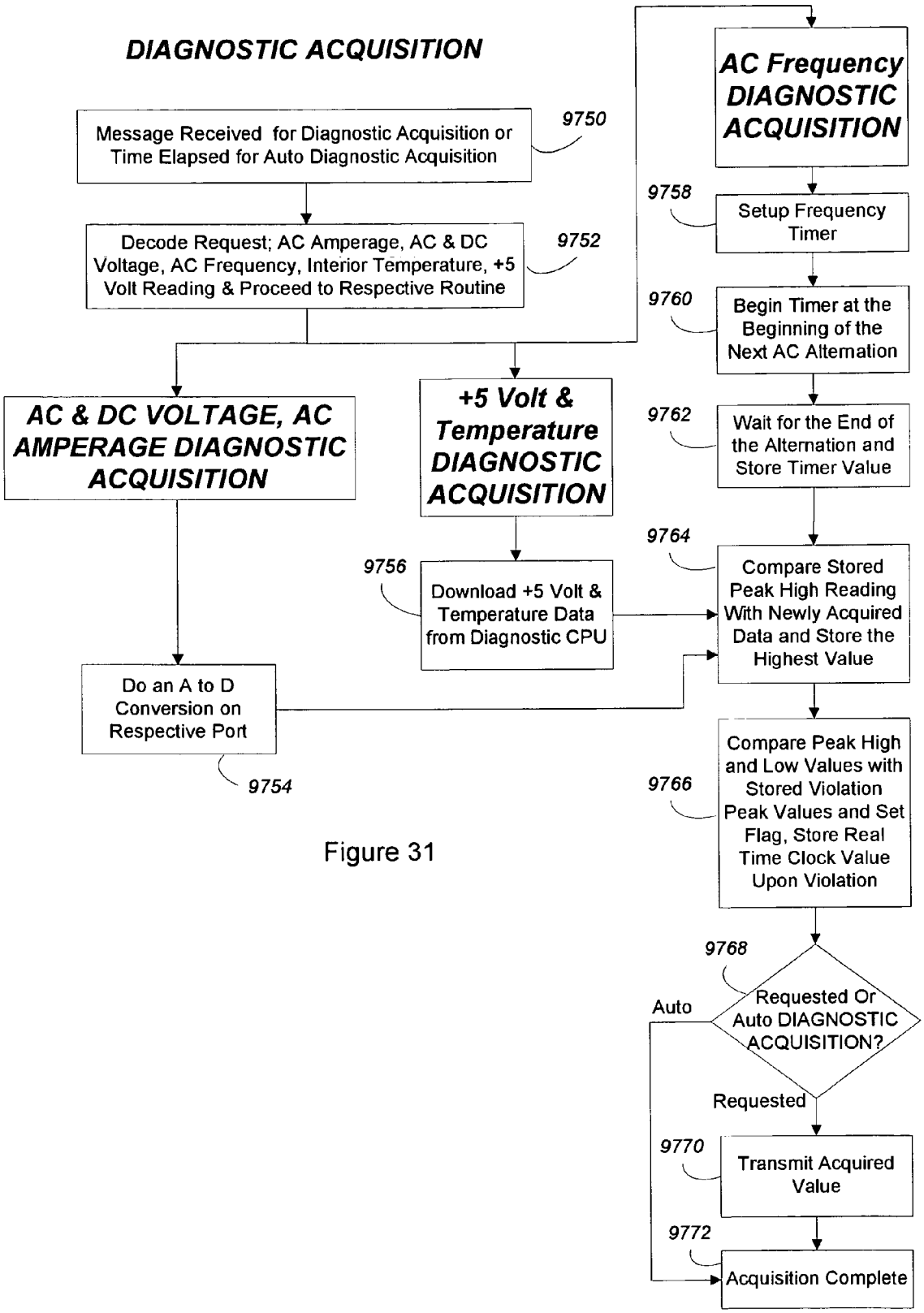
FIG. 31 is a flowchart showing how diagnostic data is acquired, processed, and transmitted from an LMD2 dimmer pack.

FIG. 31 describes in detail a 'diagnostic acquisition' routine. Block 9750 initiates a 'diagnostic acquisition' routine responsive to a specific MIDI message requesting an acquisition or as part of an automatic routine that checks via a preprogrammed time and runs a diagnostic acquisition routine on any pre selected reading. Block 9752 decodes an acquisition request and directs the code to the appropriate routine. For an AC voltage and AC amperage reading, block 9754, the CPU reads the respective port and performs an A to D conversion at a predetermined precise time in the AC cycle (e.g., acquisition may be made at the positive going alternation at the peak point) to acquire a reading that can be converted to a desired voltage or amperage reading. For a DC voltage reading the CPU may do an A to D conversion at any time of the AC cycle. After the acquisition, block 9764 may compare previously acquired data with the newly acquired data and store the high and/or low value of the two. Block 9766 compares the pre-stored (threshold) peak high and/or low values with the newly acquired values and determines if the value is over or under the threshold. If a violation (threshold exceeded) has occurred then the data is stored along with a real time clock stamp. Block 9768 directs the code to transmit the acquired data via block 9770 if acquired responsive to a message request. If the data was not requested or if the acquisition was initiated by the 'auto diagnostic' routine, the acquisition ends at block 9772, but the stored values may be requested via later message request. For the +5 volt and temperature readings, block 9756 downloads the data from a separate CPU 9548 (FIG. 27) that makes these measurements, as noted earlier. Once a request is made for this information, the main CPU downloads the digital data from the +5 volt and temperature CPU. The code continues to step to blocks 9764 through 9772 as described above. For AC frequency readings a timer is set up, at block 9758. At the beginning of the next AC zero crossing, the timer begins at block 9760. At the next zero crossing, the counter value is stored at block 9762. The time difference, between AC zero crossings, is used to calculate the AC frequency. The code continues to step to 9764 through 9772 as described above. As an additional feature, AC voltage, AC amperage and DC voltage acquisitions can be acquired in quick succession (100 times or so within a single cycle) and those values stored and then transmitted, which can then be graphed on a computer to show a recreation of the waveform, which is useful to determine whether there is noise on the line or if there is a component failure.

Figure 32:
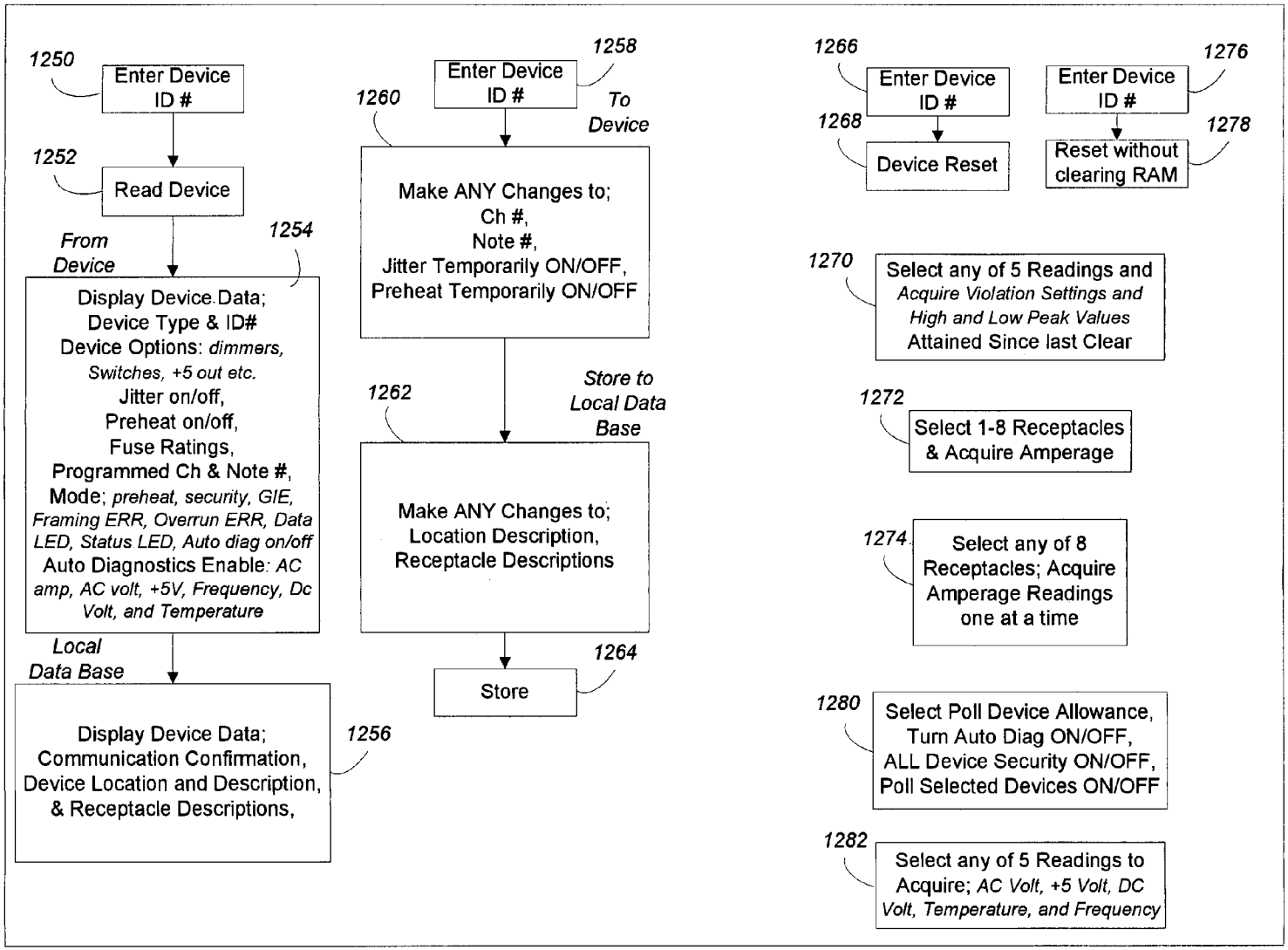
FIG. 32 is a flowchart and block diagram of software of the instant invention that may be used to control or monitor performance of other elements.

FIG. 32 shows detail for the windows based software program that is used to monitor, control, analyze, manipulate and any other remote process necessary for the operation of an LMD2 or any other device in the communication loop. This computer based program was developed to communicate and calculate acquisitions and changes quickly and in a user friendly layout. The main communicating window has several selectable functions that display specific information about a device. Block 1250 through 1256 illustrate a device READ function wherein a user enters a device number such as 0007 in block 1250, then by pressing the READ button 1252, data is transmitted to all devices and the addressed device, 0007, returns requested data such as Device Settings and preselected options and operating conditions such as AC voltage and Temperature. In addition to receiving this data from the device, the windows based program, which may include a data base, may be loaded with other descriptions and information about the device such as device location and attached equipment on each receptacle. Blocks 1258 through 1264 allow a user to make changes to a device (or all devices using a global command), such as reprogramming the receptacle assigned channel and note number, turning on and off functions, remote resets etc. as shown in block 1260 after the user enters a device ID number at 1258. Local data base changes can be made, such as changing device descriptions and locations at 1262. Once the device ID is entered and the change or changes have been made, the user presses STORE button 1264, and data displayed on the screen shows the local data base data and for the device data, the device having received the change request, changed it, stored it and then rereading the data from the device is then shown giving confirmation that the data displayed is truly the device data. Other window functions include a device reset, by entering the device ID in block 1266 and pressing the RESET button the device is forced into a software reset. Another option is to reset the device without clearing the internal RAM values but restarting the device software, reinitializing some ports and functions. The user enters the device id in block 1276 and then presses the RESET W/O CLEAR button, 1278 to initiate the request. Reading peak value violations from a device block 1270 allows a user to select a device and acquire these violation values. To acquire the amperage readings, block 1272 provides an 'immediate' AC amperage request button. One of eight buttons can be selected and will acquire an AC amperage reading on the respective receptacle on that device. Block 1274 allows a user to select any of 8 receptacles and then select 'GET', the software then turns on the selected receptacle, pauses about 250 milliseconds (to stabilize) then requests an AC amperage acquisition. The amperage data is then read, calculated and displayed, this process continuing until all receptacles are read. Block 1282, Diagnostic acquisitions, can be requested by first selecting the readings to be acquired and then selecting the GET button. The device acquires the data and transmits it back, the data being decoded, calculated and displayed. Block 1280 is used to automatically POLL selected devices, via a selection list, and using a timer will address each device individually requesting status data that may include information about the device, such as whether the device is attached, peak values exceeded, USART errors, auto diagnostics on/off, preheat on/off, security mode on/off, etc.

From this program, changes can be made to devices that could be thousands of feet away from a local port or could be connected to a remote central hub via an intranet for local area communications or the internet, for any of the above monitor and control, to be performed from a global master station with multiple administrative, monitoring and control interfaces or stations. By connecting in this manner, multiple and/or simultaneous shows or performances could be monitored, controlled, and analyzed, or any other remote feature or function, for operational purposes.

Figure 33B:
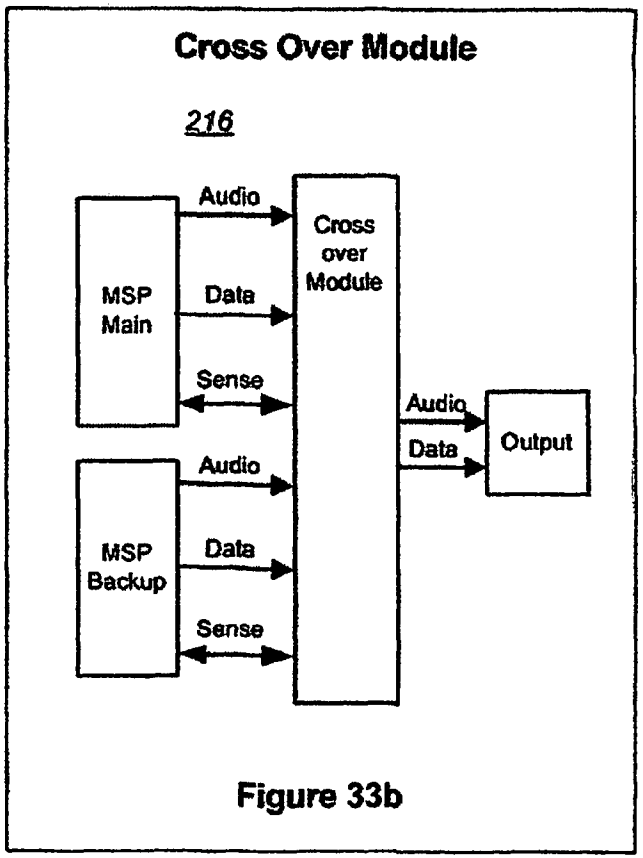
FIG. 33*b* is an electronic block diagram of a crossover module for switching to a backup module.
Figure 33A:
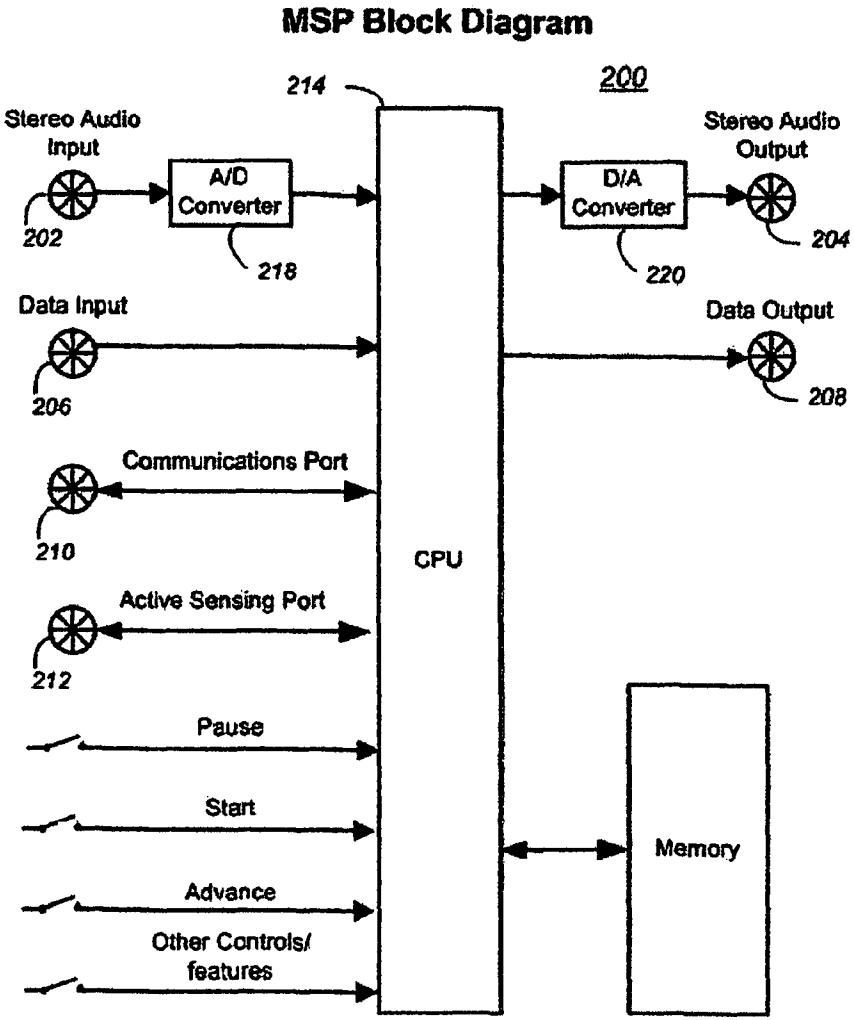
FIG. 33*a* is an electronic block diagram of a recording and playback module for recording and storing a stereo input and a data input, and playing back simultaneously on demand the stereo input and data input.

As shown in FIGS. 33*a* and 33*b*, other modules that may be used with the instant invention include a hardware based show playback module 200, MSP, which may allow a show comprising stereo audio and a data stream to be output simultaneously. The module may include stereo audio input 202 and outputs 204 for recording and playback, data input 206 and outputs 208, and a communications port 210 for connecting to a computer for downloading and uploading audio and data files and for editing a preloaded show. The module may be equipped with an active sensing input/output port 212 that would allow two modules to be coupled together, one as a main module the other as a backup module, with a third cross over module 214 that may sense if the main module was active and, if not, may automatically switch to the back up module. In more detail, an MSP may include an Analog to Digital converter (A to D) 216 to convert the stereo audio pair into digital format for storage, and a Digital to Analog converter (D to A) 218 to convert the digital format to an analog output. Data input 206 may include the show information and may be stored for recall upon playback, and transmitted via the data output port 208. Communication sport 210 may allow data to pass to and from a PC for audio and data file transfers and may allow for editing of stored data. The CPU 212 may include code that would allow all of the functions to operate and communicate with onboard memory, A to D and D to A converters, and data input and output, and generate or receive an active sense signal to the cross over module. A front access panel with switches that may provide functionalities such as; Show pause, Show start, Show Advance, and other controls connected to the CPU.

It should be obvious to one skilled in the art that other devices, such as pyrotechnics, lasers, video projectors, and such could be coupled to and controlled through LMD2 units or other devices in the manner described herein, or could be configured to interface with and be directly responsive to MIDI data streams coupled via conventional MIDI cables or via other transmission media, including cables carrying line-level signals as well as wireless links and networks, using apparatus and methods disclosed herein, and thus fall fairly within the scope of the claims below, wherein

I claim:

1. A system comprising:

a MIDI data stream generator for generating a MIDI data stream, a plurality of single operational mode circuit means, each of which having a different single operational mode function responsive only to a respective different single component or aspect of said MIDI data stream and providing a signal indication of said single operational mode function, a plurality of discrete housings, each discrete housing containing a one single operational mode circuit means of said plurality of said single operational mode circuit means, each of said plurality of housings having connectors configured so that any or all of said plurality of single operational mode circuit means therein are selectively connectable to said MIDI data stream, means responsive to said signal indication of said single operational function, for responding to said signal.

2. A MIDI system as set forth in claim 1 wherein said means responsive to said signal indication comprises a plurality of discrete LEDs, each of said plurality of LEDs being independently programmable by a user to indicate reception of a separate and distinct selected MIDI message, one separate and distinct selected MIDI message for each LED of said plurality of LEDs.

3. A MIDI system as set forth in claim 2 wherein discrete ones of said plurality of discrete LEDs illuminated to indicate reception of separate and distinct selected ones of said MIDI messages vary intensity of illumination in accordance with one of the group comprising:

a velocity indication, a control change, a program change, a pitch wheel indication.

4. A MIDI system as set forth in claim 2 wherein said plurality of discrete LEDs further comprises 32 discrete LEDs, each of said 32 discrete LEDs being independently controllable by a user for indicating a respective MIDI message in accordance with the table of FIG. 6.

5. A system comprising:

at least one musical instrument digital interface (MIDI) data stream generator for generating at least one MIDI data stream;

a plurality of separate and discrete logic circuits, each logic circuit of said plurality of separate and discrete logic circuits responsive only to a respective selected component of said MIDI data stream, each said selected component being a different component from other selected components, and each said logic circuit providing control signals responsive to a respective said selected component of said MIDI data stream, said plurality of logic circuits each resident in a respective separate and discrete housing, connectors coupled to each of said logic circuits and configured so that any or all of said plurality of separate and discrete logic circuits are connectable to said MIDI data stream, allowing a user to configure said system using any or all of said separate and discrete logic circuits, a device operated by said control signals.

6. A system as set forth in claim 5 wherein said device operated by said control signals is a visual display.

7. A system as set forth in claim 6 wherein said visual display is mounted on said housing and further comprises a plurality of independently programmable LEDs coupled to at least one of said plurality of separate and discrete logic circuits, and further wherein said selected component of said MIDI data stream comprises MIDI messages, with at least some of said plurality of independently programmable LEDs being user-programmed and illuminated to indicate reception by said at least one of said plurality of separate and discrete logic circuits of a specific respective selected MIDI message, one selected message being indicated by one of said at least some of said plurality of said independently programmable LEDs.

8. A system as set forth in claim 7 wherein said at least one of said plurality of separate and discrete logic circuit indicating reception of specific respective selected MIDI messages is further configured so that said at least some of said LEDs are illuminated with variable brightness in accordance with the group comprising:

a velocity indication, a control change, a program change, a pitch wheel indication.

9. A system as set forth in claim 6 wherein said device further comprises a data display.

10. A system as set forth in claim 9 wherein one of said plurality of separate and discrete logic circuits is configured to store a portion of a received said MIDI data stream, and further configured to allow a user to scroll, pause and observe MIDI messages on said data display in a received and stored said portion of said MIDI data stream.

11. A system as set forth in claim 10 wherein said one of said plurality of separate and discrete logic circuits is configured to be switchable between showing said stored MIDI messages on said data display in a first, decoded format including at least one of a message type, a channel number and a decimal equivalent, or showing said stored MIDI messages in a hexadecimal format.

12. A system as set forth in claim 10 wherein said one of said plurality of separate and discrete logic circuits is configured to filter said MIDI data stream and display only selected types of said MIDI messages on said data display.

13. A system as set forth in claim 9 wherein said at least one of said plurality of separate and discrete logic circuits is configured so that said data display provides MIDI time code statistics.

14. A system as set forth in claim 13 wherein said time code statistics include 24-30 frames per second, drop frame/non-drop frame and user bit information.

15. A system as set forth in claim 5 wherein at least one of said plurality of separate and discrete logic circuits further comprises first circuitry configured to convert said MIDI data stream to a signal format suitable for long distance transmission.

16. A system as set forth in claim 15 wherein said visual display comprises a decorative visual display remotely located from MIDI components of said system including said MIDI data stream generator and said housing containing said first circuitry configured to convert said MIDI data stream to a signal format suitable for long distance transmission, said decorative visual display responsive to said MIDI data stream in said signal format suitable for long distance transmission.

17. A system as set forth in claim 16 further comprising a plurality of individually addressable power outlets in a single enclosure proximate said remotely located visual display, said power outlets coupled to said housing containing said first circuitry configured to convert said MIDI data stream to a signal format suitable for long distance transmission, each of said power outlets including second circuitry responsive to a respective selected message in said MIDI data stream, for selectively powering individual portions of said decorative display.

18. A system as set forth in claim 17 wherein said power outlets are further configured having third logic responsive to said logic in said housing, said third logic configured to produce a plurality of special effects by said display, said plurality of special effects each being responsive to a different respective said selected message in said MIDI data stream.

19. A system as set forth in claim 18 wherein said special effects selected by said third logic comprises:

a jitter effect, a blinking effect that slows with time.

20. A system as set forth in claim 9 wherein said logic is configured to display data receive status including timing information, framing information, timing errors and clock messages.

21. A method for constructing and using a MIDI system comprising:

developing at least one MIDI data stream, developing a plurality of separate and discrete signals, each representative of a respective single, different component or aspect of said MIDI data stream, and each signal of said signals developed by a respective separate and discrete circuit of a plurality of separate and discrete circuits, enclosing each said separate and discrete circuit in a respective separate and discrete enclosure, one separate and discrete circuit for each said enclosure, configuring each separate and discrete enclosure so that a respective said circuit therein is selectively connectable to said MIDI data stream, selecting any or all of a plurality of enclosures each housing a respective said separate and discrete circuit in order to build and configure said MIDI system, using a said signal from a respective said circuit selected to be in said system to operate a device.

22. A method as set forth in claim 21 further comprising using a first circuit of said separate and discrete circuits for storing a portion of said MIDI data stream and providing respective signals to said device, and further using said device to allow a user to observe said MIDI messages on said device by scrolling through and pausing a stored said portion of said MIDi data stream.

23. A method as set forth in claim 21 further comprising using a second circuit of said separate and discrete circuits to control illumination of selected ones of a plurality of lamps responsive to selected ones of MIDI messages in said MIDI data stream.

24. A method as set forth in claim 23 further comprising using said second circuit to individually vary an illumination level of illuminated ones of said lamps.

25. A method as set forth in claim 24 wherein said varying an illumination level further comprises varying said illumination level responsive to at least one of the group comprising:

a velocity indication, a control change, a program change, and a pitch wheel indication.

26. A method as set forth in claim 23 further comprising:

converting said MIDI data stream to a signal format suitable for long distance transmission, transmitting a converted said MIDI data stream to a remotely located display including said plurality of lamps, illuminating one or more of said lamps of said remotely located display responsive to said selected ones of said MIDI messages.

27. A method as set forth in claim 26 further comprising providing third circuitry responsive to selected ones of said MIDI messages, aid third circuitry creating special effects that include a jitter effect and a blinking effect that slows with time responsive to said selected ones of said MIDI messages.

28. A method as set forth in claim 21 further comprising using signals from a circuit of said circuits to display data receive status including timing information, framing information, clock errors and clock messages.

29. A method as set forth in claim 21 further comprising using signals from a circuit of said circuits to display MIDI time code statistics including 24-30 frames per second, drop frame/non-drop frame and user bit information.

* * * * *